US011208219B2

(12) United States Patent
Yokoyama et al.

(10) Patent No.: US 11,208,219 B2
(45) Date of Patent: Dec. 28, 2021

(54) DRUG PACKAGING DEVICE

(71) Applicant: YUYAMA MFG. CO., LTD., Osaka (JP)

(72) Inventors: Keisuke Yokoyama, Osaka (JP); Hidenori Tsuji, Osaka (JP); Takama Yamamoto, Osaka (JP); Masanao Nishio, Osaka (JP); Yukinori Koide, Osaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 157 days.

(21) Appl. No.: 16/349,774

(22) PCT Filed: Nov. 14, 2017

(86) PCT No.: PCT/JP2017/040932
§ 371 (c)(1),
(2) Date: May 14, 2019

(87) PCT Pub. No.: WO2018/092771
PCT Pub. Date: May 24, 2018

(65) Prior Publication Data

US 2019/0337647 A1 Nov. 7, 2019

(30) Foreign Application Priority Data

Nov. 15, 2016 (JP) ..... JP2016-222408
Nov. 10, 2017 (JP) ..... JP2017-217711

(51) Int. Cl.
*B65B 1/30* (2006.01)
*B65B 1/04* (2006.01)
*B65B 35/30* (2006.01)

(52) U.S. Cl.
CPC ..... *B65B 1/30* (2013.01); *B65B 1/04* (2013.01); *B65B 35/30* (2013.01)

(58) Field of Classification Search
CPC ..... G07F 17/0092; B65B 1/06; B65B 1/30; B65B 5/105; B65B 39/007; A61J 7/0084
(Continued)

(56) References Cited

U.S. PATENT DOCUMENTS 10,007,764 B2 * 6/2018 Kim ..... A61J 7/0084
2005/0041531 A1 2/2005 Sekura
(Continued)

FOREIGN PATENT DOCUMENTS

CN 101035683 A 9/2007
CN 103260580 A 8/2013
(Continued)

OTHER PUBLICATIONS

Partial Supplementary European Search Report in EP Application No. 17872106.4, dated Aug. 7, 2020. 12pp.
(Continued)

*Primary Examiner* — Valentin Neacsu
(74) *Attorney, Agent, or Firm* — Hauptman Ham, LLP

(57) ABSTRACT

A drug packaging device includes a dispensing portion and a packaging portion. The dispensing portion includes a first dispensing portion including a plurality of drug cassettes and a second dispensing portion configured to receive drugs, which are prepared separately from the drugs stored in the first dispensing portion, and to dispense the drugs. The second dispensing portion includes a first receiving/dispensing portion and a second receiving/dispensing portion. The second receiving/dispensing portion is configured to dispense drugs by the amount required for packaging among a plurality of drugs having been collectively distributed. The first receiving/dispensing portion and the second receiving/dispensing portion are vertically arranged.

15 Claims, 34 Drawing Sheets

(58) Field of Classification Search
USPC ..... 53/52, 493, 495, 154, 167, 562, 568
See application file for complete search history.

(56) References Cited

U.S. PATENT DOCUMENTS

| | | | | |
|---|---|---|---|---|
| 2006/0230710 | A1* | 10/2006 | Ishiwatari | G07F 11/62 53/493 |
| 2007/0150092 | A1* | 6/2007 | Ohmura | G07F 11/62 700/231 |
| 2008/0029530 | A1* | 2/2008 | Yuyama | B41J 35/08 221/2 |
| 2010/0287880 | A1* | 11/2010 | Yasunaga | B65B 5/103 53/64 |
| 2013/0270291 | A1* | 10/2013 | Omura | A61J 7/0084 221/92 |
| 2014/0290190 | A1 | 10/2014 | Morikawa | |
| 2014/0318078 | A1* | 10/2014 | Kondo | B65B 57/14 53/54 |
| 2015/0127145 | A1* | 5/2015 | Kim | G07F 17/0092 700/235 |
| 2015/0209237 | A1* | 7/2015 | Kim | B65D 25/04 220/500 |
| 2016/0229564 | A1* | 8/2016 | Koike | A61J 7/0409 |
| 2016/0270534 | A1* | 9/2016 | Duval | A47B 96/00 |
| 2019/0091106 | A1* | 3/2019 | Kim | G07F 11/165 |

FOREIGN PATENT DOCUMENTS

| | | | | |
|---|---|---|---|---|
| CN | 103764096 | A | 4/2014 | |
| EP | 1800880 | A1 | 6/2007 | |
| JP | 2001-276183 | A | 10/2001 | |
| JP | 2005-500099 | A | 1/2005 | |
| JP | 2012-135388 | A | 7/2012 | |
| JP | 2014-76376 | A | 5/2014 | |
| JP | 2016-26833 | A | 2/2016 | |
| JP | WO 2016136523 | * | 9/2016 | A61J 3/00 |
| WO | 2015/041220 | A1 | 3/2015 | |
| WO | 2016/136523 | A1 | 9/2016 | |

OTHER PUBLICATIONS

International Search Report in PCT/JP2017/040932, dated Feb. 6, 2018. 6pp.
Office Action in CN Application No. 201780069186.8, dated Apr. 2, 2021. 32pp.

* cited by examiner

FIG. 33

160

PRESCRIPTION INPUT

Do INFORMATION IS TO BE CHANGED AS FOLLOWS.
ISSUE THE PRESCRIPTION?

■ COMPARISON Do DATE: 2017/09/06
● PRESCRIPTION WITH DIFFERENT TIMES PER DAY

| PACKAGE TYP | CURRENT PRESCRIPTION | Do PRESCRIPTION |
|---|---|---|
| PACKAGE TYP [ A ] | TIMES PER DAY [ 29 ] | TIMES PER DAY [ 30 ] |

● PRESCRIPTION WITH DIFFERENT CONTENT

| PACKAGE TYP |
|---|
| PACKAGE TYP [ B ] |

YES (Y) NO (N)

DRUG PACKAGING DEVICE

CROSS-REFERENCE TO RELATED APPLICATIONS

This application is National Phase of International Application No. PCT/JP2017/040932, filed on Nov. 14, 2017, and claims priority based on Japanese Patent Application Nos. 2016-222408, filed on Nov. 15, 2016 and 2017-217711, filed on Nov. 10, 2017.

TECHNICAL FIELD

The present invention relates to a drug packaging device.

BACKGROUND ART

Hitherto, there has been provided a drug packaging device as disclosed in Patent Literature 1 described below. This drug packaging device includes a plurality of cassette unit, which are provided on an outer surface of a substantially cylindrical drum, and a manual distribution unit, and a drug dispensed from those can be packaged.

CITATION LIST

Patent Literature

[PTL 1] JP 2001-276183 A

SUMMARY OF INVENTION

Technical Problem

In the drug packaging device of Patent Literature 1 described above, it is stated that an improvement in assemblability and flexible adaptation to change in size can be achieved. However, in recent years, there is a demand for not only a drug packaging device capable of dispensing and distributing a drug by an amount corresponding to one package to each of a plurality of boxes (drug receiving boxes) as in the manual distribution unit but also a drug packaging device including a dispensing portion capable of preparing a plurality of drugs collectively distributed and sequentially dispensing the drugs by an amount required for a package in accordance with prescription information. Moreover, there is also a demand for a drug packaging device having an ordered configuration without impairing operability while including the dispensing portion with such function.

Therefore, the present invention has an object to provide a drug packaging device having an ordered configuration without impairing operability while including a dispensing portion capable of preparing a plurality of drugs collectively distributed by an amount required for a package and sequentially dispensing drugs in accordance with prescription information.

Solution to Problem

In order to solve the above-mentioned problems, according to one embodiment of the present invention, there is provided a drug packaging device, including: a first dispensing portion, which includes a plurality of drug cassette configured to store a drug and individually dispense the stored drug in accordance with prescription information; a second dispensing portion configured to receive a drug prepared other than the drug stored in the first dispensing portion and dispense the drug in accordance with prescription information; and a delivery portion provided on a movement path for a drug for allowing the drugs dispensed from the first dispensing portion and the second dispensing portion toward a packaging portion, wherein the second dispensing portion includes: a first receiving/dispensing portion, which is configured to align and arrange a plurality of drug receiving boxes lengthwise and crosswise, prepare a drug in each of the plurality of drug receiving boxes for dispensing in accordance with prescription information, and to dispense the drug for each drug receiving box; and a second receiving/dispensing portion configured to collectively receive a plurality of drugs of the same kind and dispense the drug required for a package in accordance with prescription information, wherein the first receiving/dispensing portion and the second receiving/dispensing portion are vertically arrayed, and wherein the delivery portion is configured to move and collect part or all of drugs, which have been dispensed from the first dispensing portion and the second dispensing portion and have been fallen, in a direction crossing the direction of falling, and to dispense the drugs toward the packaging portion.

According to the one embodiment of the present invention, the drug packaging device includes, as the dispensing portions, the second dispensing portion in addition to the first dispensing portion including the plurality of drug cassettes. Moreover, the second dispensing portion is configured to prepare and dispense drugs for each of a plurality of accommodation parts with the first receiving/dispensing portion and is configured to sequentially dispense drugs for packaging which are collectively accommodated and prepared with the second receiving/dispensing portion. Therefore, according to the drug packaging device of the present invention, for the drugs which are not provided to the first dispensing portion, a user is only required to, for example, collectively prepared the drugs in the second receiving/dispensing portion, thereby being capable of improving the operation efficiency. Moreover, according to the drug packaging device of the present invention, a user can suitably select the use of the first receiving/dispensing portion and the second receiving/dispensing portion in consideration of characteristics of the drugs. With this, a user is capable of performing a packaging operation further in consideration of the characteristic of the drugs and improving the efficiency of the packaging operation.

Moreover, the drug packaging device of the present invention includes a delivery portion, and moves some or all of the drugs having been dispensed and fallen at the first dispensing portion and the second dispensing portion in a direction crossing the direction of falling, for example, in a specified direction such as a direction toward a center of the main body, thereby being capable of dispensing the drugs toward the packaging portion. Therefore, the drug packaging device of the present invention has a high degree of freedom in setting the movement passage of the drugs in the device, and hence even when the drug dispensing portion including a plurality of configurations such as the first dispensing portion and the second dispensing portion are provided in the device, none of the dispensing portions protrude from the device housing, thereby being capable of providing a drug packaging device with a simple configuration with clear arrangement.

Moreover, in the drug packaging device of the present invention, the first receiving/dispensing portion and the second receiving/dispensing portion are arranged vertically. Therefore, a user can perform a preparation operation for the drugs with respect to the first receiving/dispensing portion and the second receiving/dispensing portion efficiently without requiring movement. Moreover, when the first receiving/dispensing portion and the second receiving/dispensing portion are arranged horizontally, the increase in size of the drug packaging device in the width direction may occur. However, according to the present invention, the first receiving/dispensing portion and the second receiving/dispensing portion are arranged vertically, and hence such problem does not occur. Therefore, according to the present invention, a drug packaging device having a clear configuration can be provided.

It is preferred that the drug packaging device described above include an upper side hopper configured to collect a drug having been dispensed above the delivery portion and to feed the drug to the delivery portion, the upper side hopper include an inclination portion having a peripheral surface inclined so that the opening region becomes narrower from the upper side toward the lower side, and that some or all of the second dispensing portions be arranged so as to enter the region of the inclination portion on the lower side.

With the configuration described above, the region defined on the lower side of the inclination portion of the upper side hopper does not become a dead space, thereby being capable of efficiently using the space as an installation space for the second dispensing portion. With this, the configuration of the drug packaging device can be set clearer.

When the drugs having been dispensed from the dispensing portion is to be caused to fall, and is to be collected and packaged in the drug packaging device, jumping of the drugs is suppressed to be minimum, to thereby improve the collection speed for the drugs and suppressing the problems such as defects in package due to loss of the drugs to minimum. Therefore, it is preferred that sufficient consideration be made on the jumping of the drug having fallen from the dispensing portion in the drug packaging device described above. In particular, in the device including a plurality of drug preparing and dispensing mechanisms are provided as in the present application, it becomes more liable to cause difficulty in improvement of the collection speed. Therefore, it is required to suppress the jumping of the drugs to minimum in consideration of the positional relationship of the respective drug preparing and dispensing mechanisms.

Based on the knowledge described above, it is preferred that, in the drug packaging device described above, it is preferred that the delivery portion include, on a movement passage of the drug moving toward the packaging portion, a storage portion configured to temporarily receive some or all of the drugs prepared for individual packaging and discharge the drugs toward the packaging portion.

With this, problems such as jumping of the drugs, which have been dispensed from the dispensing portion, to unexpected positions can be solved.

The drug packaging device according to the present invention described above may be configured such that the second receiving/dispensing portion is capable of supplying the drugs by being drawn out from the device main body of the drug packaging device, and is capable of dispensing the drugs by being pushed into the device main body.

In the drug packaging device of the present invention, the operation of supplying the drugs by drawing out the second receiving/dispensing portion from the device main body can be performed. Therefore, with the drug packaging device of the present invention, a user can easily perform the operation of supplying the drugs to the second receiving/dispensing portion. Moreover, with the drug packaging device of the present invention, the second receiving/dispensing portion can be brought into a state of being pushed into the device main body. Therefore, with the drug packaging device of the present invention, occurrence of the state in which the second receiving/dispensing portion projects from the device main body can be suppressed to minimum. Moreover, the drugs can be dispensed by pushing the second receiving/dispensing portion into the device main body. With this, occurrence of the problems which may be assumed due to the exposure of the second receiving/dispensing portion to the outside of the device main body, such as erroneous touching by an operator on an operation portion for dispensing the drugs from the second receiving/dispensing portion or entry of dusts into the second receiving/dispensing portion can be suppressed to minimum.

The drug packaging device according to the present invention described above may have a structure that the delivery portion includes a first opening/closing mechanism section including a first opening/closing member being openable and closable, and is configured to temporarily receive the drug having fallen and discharge the drug downward at the first opening/closing mechanism section, and that some or all of surfaces with which the drugs having fallen from the dispensing portion collide in the first opening/closing mechanism section have a multilayer structure formed of plate members arrayed with a clearance.

As described above, some or all of the surfaces with which the drugs having fallen from the dispensing portion collide in the first opening/closing mechanism section have a multilayer structure, thereby being capable of absorbing the shock due to an impact of the drugs and suppressing jumping of the drugs to minimum.

The drug packaging device according to the present invention described above may have a structure that the delivery portion includes a second opening/closing mechanism section including a second opening/closing member being openable and closable, and is configured to temporarily receive the drug having fallen, and to discharge the drug downward at the second opening/closing mechanism section, and that some or all of surfaces with which the drugs having fallen from above collide in the second opening/closing mechanism section is smaller in thickness than other part.

As described above, some or all of the surfaces with which the drugs having fallen from the dispensing portion in the second opening/closing mechanism section are smaller in thickness than other part, thereby being capable of suppressing jumping of the drugs to minimum.

The drug packaging device according to the present invention described above may have a structure that the delivery portion includes a moving mechanism configured to move the drug having been dispensed and fallen at the dispensing portion in a direction crossing the direction of falling.

With the configuration described above, the drugs having been dispensed from the dispensing portion can be moved not only in the falling direction but also in the direction crossing the falling direction. With this, the degree of freedom in setting passage of the drugs is improved, thereby being capable of contributing reduction in size of the drug packaging device. Further, also in the device including the plurality of drug preparing and dispensing mechanism as in the present application, collection speed can be suitably improved.

The drug packaging device according to the present invention described above may have a structure that the drug packaging device includes a hopper configured to collect the drug from an upstream side and send the drug to a downstream side, in which the hopper includes: a hopper main body having an opening area narrowed from an upper side toward a lower side; a tubular portion which communicates to a lower side of the hopper main body; and a neck portion formed between the hopper main body and the tubular portion, in which, in the neck portion, the hopper main body and the tubular portion are gently curved so as to be connected to each other, and that a part below the neck portion is made of a material which is softer than a part above the neck portion.

As described above, when the hopper main body and the tubular portion are gently connected to each other at the neck portion of the hopper, and the part below the neck portion is made of a material softer than the part above the neck portion, jumping of the drugs having been introduced to the hopper can be suppressed to minimum.

The drug packaging device according to the present invention described above may have a structure that the second receiving/dispensing portion includes: a cassette configured to accommodate and dispense the drug; and a base portion configured to give a motive force required for dispensing the drug to the cassette, wherein the cassette includes: a peripheral wall forming member forming a peripheral wall of a drug accommodation portion configured to receive the drug; a first rotation member, which is arranged so as to incline from a bottom side toward an upper end side of the peripheral wall forming member, and is configured to rotate around a first rotation shaft which is inclined with respect to an axis line of the peripheral wall forming member; a second rotation member, which is arranged on an outer periphery on an upper end side of the peripheral wall forming member, and is configured to rotate around a second rotation shaft; and a drug discharge portion configured to discharge the drug, and wherein the drug prepared in the drug accommodation portion is moved to the second rotation member by rotation of the first rotation member, is transferred toward a downstream side in a rotation direction of the second rotation member, and is discharged from the drug discharge portion.

With this, when the drugs are prepared in the drug accommodation portion, through rotation control on the first rotation member and the second rotation member, the drugs can be discharged one after another sequentially, suitably, and smoothly from the second receiving/dispensing portion. With this, for example, the frequency of use of the first receiving/dispensing portion can be suppressed to minimum, and a burden on a user required for supply of drugs by manual distribution operation to respective accommodation parts (drug receiving boxes) of the first receiving/dispensing portion can be alleviated, and occurrence of human errors caused by manual operations can be suppressed to minimum.

Moreover, the drug packaging device according to the present invention described above further includes a drawer member configured to be drawn out from the device main body of the drug packaging device, wherein, when the drawer portion is drawn out, the cassette is drawn out from the device main body in a state of being held by the drawer portion and being separated from the base portion, and wherein, when the drawer portion is returned to the device main body side, the cassette is returned to the device main body side and is brought into a state of being coupled to the base portion.

With the configuration described above, various operations can be performed by drawing out the cassette from the device main body in a state of being separated from the base portion. Moreover, through the operation of returning the drawer portion to the device main body, the cassette is coupled to the base portion, and the state of enabling dispensing of the drug can be attained.

The drug packaging device according to the present invention described above further includes: an identification information reading portion configured to read identification information of the drug attached to an original box of the drug; a specifying information display portion configured to display specifying information for specifying the drug accommodated in the second receiving/dispensing portion; and a checking portion configured to verify a drug specified from the specifying information displayed on the specifying information display portion and a drug specified from the identification information read from the identification information reading portion.

With the configuration described above, at the time of charging the drugs into the second receiving/dispensing portion, identification information is read from the original box, and verification on whether or not the specifying information, which is displayed on the specifying information display portion for specifying the drugs accommodated in the second receiving/dispensing portion, and the identification information match each other can be verified through the checking portion. With this, erroneous handling of the drugs to be charged into the second receiving/dispensing portion can be prevented.

There is a case in which the drugs are required to be packaged for special prescription such as dosage in a predetermined cycle as in the case of the drugs to be dosed in a predetermined cycle such as predetermined number of days or predetermined days. In such case, there is a problem in that, prior to the packaging of the drugs, a pharmacist or the like is required to perform a cumbersome operation of calculating the quantity of the drugs required for the prescription. There has been a demand for alleviation of an operation of the pharmacist and elimination of such cumbersome operation as described above in viewpoint of suppressing erroneous preparation of the drugs.

In order to solve the above-mentioned problems, according to one embodiment of the present invention, there is provided a method of packaging a drug by dispensing and packaging a drug in accordance with prescription information, wherein, when a drug is prescribed for dosage of a predetermined dosage cycle, the dosage cycle and a dosage period from a starting day of dosage to an ending day of dosage is designated, to thereby derive the number of days of dosage of the drug in the dosage period, and individually package the drug corresponding to the number of days of dosage.

According to the method of packaging the drugs of the present invention, even when the drugs are required to be packaged with such special prescription such as dosage in a predetermined cycle as in the case of the drugs to be dosed in a predetermined cycle such as every predetermined number of days (for example, every other one day or every other two days), the pharmacist is not required to perform the cumbersome operations such as calculation of the number of dosage of the drugs. That is, according to the present invention, even when the drugs which are required to be dosed every predetermined cycles are prescribed, in consideration of not only the total days for the case of requiring dosage every day during the dosage period (case of consecutive dosage) but also the total number of days such as dates or days designated as days requiring dosage of the drugs, the total of the days requiring dosage of the drugs in the period designated as the dosage period is derived as the number of dosage days, and packaging can be performed. Thus, according to the method for packaging of the drugs of the present invention, the pharmacist is not required to perform the operation of deriving the number of dosage days, thereby contributing to the alleviation of the operation of the pharmacist and suppression of the erroneous preparation of the drugs.

Moreover, a program according to the present invention is to be used for a drug packaging device configured to dispense and package the drugs in accordance with prescription information. When drugs are prescribed for dosage in a predetermined dosage cycle, through designation of the dosage period from the dosage cycle as well as the dosage period from the starting day of the dosage to the ending day of the dosage, the process of calculating the number of dosage days of the drugs during the dosage period can be achieved in the drug packaging device.

With the program according to the present invention, even when the drugs are required to be packaged with the special prescription for dosage in a predetermined cycle, the drug packaging device can derive the number of dosage days of the drug. Thus, according to the program for packaging of the drugs of the present invention, the pharmacist is not required to perform the operation of deriving the number of dosage days, thereby contributing to the alleviation of the operation of the pharmacist and suppression of the erroneous preparation of the drugs.

According to one embodiment of the present invention, there is provided a drug packaging device, including: a dispensing portion configured to individually dispense drugs in accordance with prescription information; a packaging portion configured to package the drugs; and a controller, wherein the drug packaging device is configured to dispense and package the drugs in accordance with the prescription information, wherein, when drugs are prescribed for dosage with a predetermined dosage cycle, the controller designates the dosage cycle and a dosage period from a starting day of dosage to an ending day of dosage, derives the number of days of dosage of the drugs in the dosage period, allows the drugs corresponding to the number of days of dosage to be dispensed from the dispensing portion, and package the drugs in the packaging portion.

With the configuration described above, when the drugs are required to be packaged with the special prescription for dosage in a predetermined cycle, the number of dosage days for the drugs can be calculated without manual operation by, for example, a pharmacist. Thus, according to the drug packaging device of the present invention, burdens on the pharmacist required to derive the number of dosage days can be alleviated, thereby being capable of contributing to suppression of the erroneous preparation of drugs.

Advantageous Effects of Invention

According to the present invention, there can be provided a drug packaging device capable of accommodating a plurality of kinds of drugs in a plurality of kinds of dispensing portion depending on the use and/or management for the drugs and sequentially dispensing required amounts of drugs in accordance with prescription information from various dispensing portions, especially a drug packaging device including a dispensing portion capable of collectively supplying drugs and sequentially dispensing required amounts of drugs one after another to the package with a clear configuration without impairing the operability.

BRIEF DESCRIPTION OF DRAWINGS

FIG. 33 is an image view for illustrating one example of the interface to be displayed on the drug packaging device.

DESCRIPTION OF EMBODIMENTS

Figure 1:
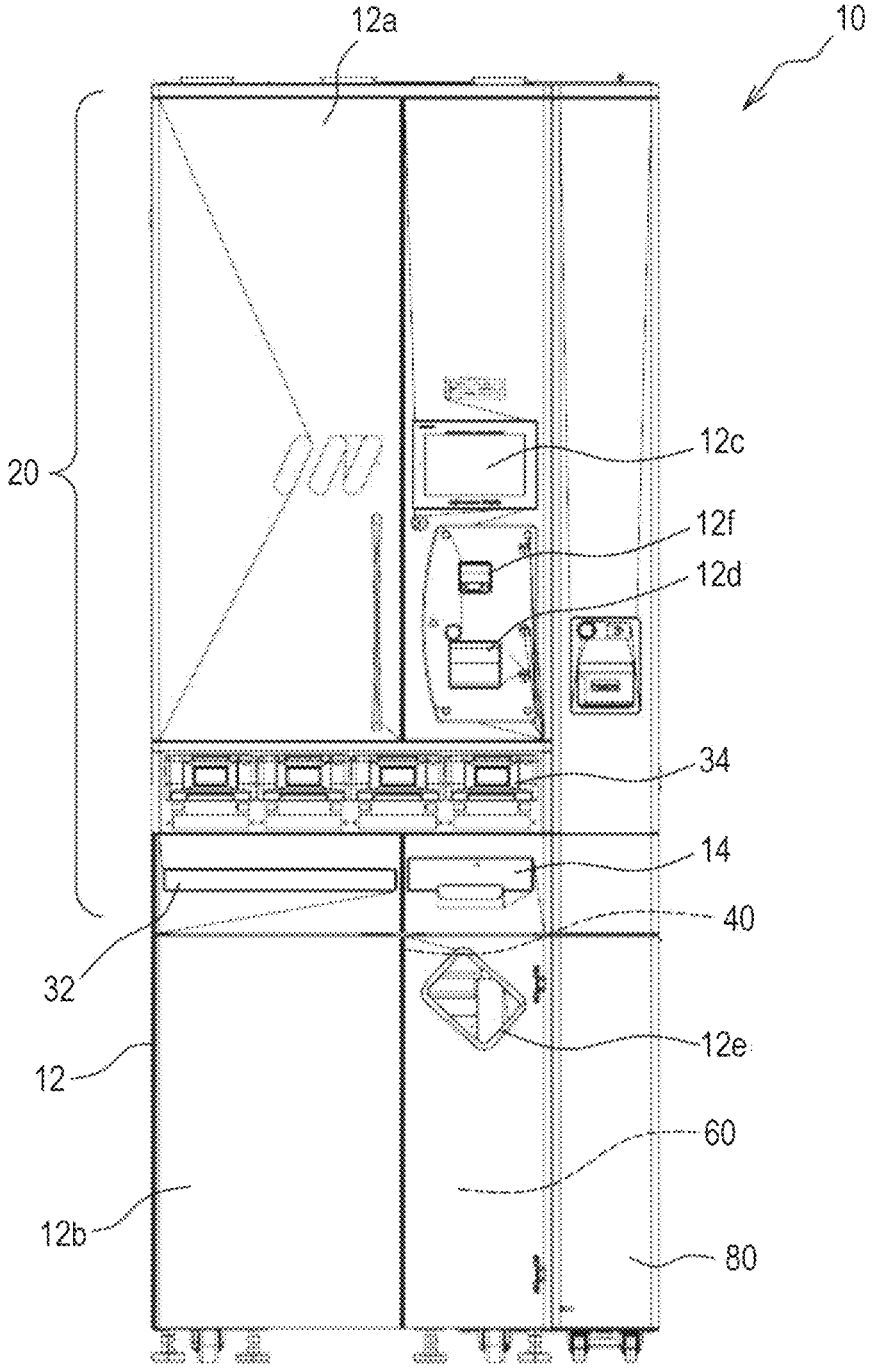
FIG. 1 is a front view of a drug packaging device according to one embodiment of the present invention.
Figure 2:
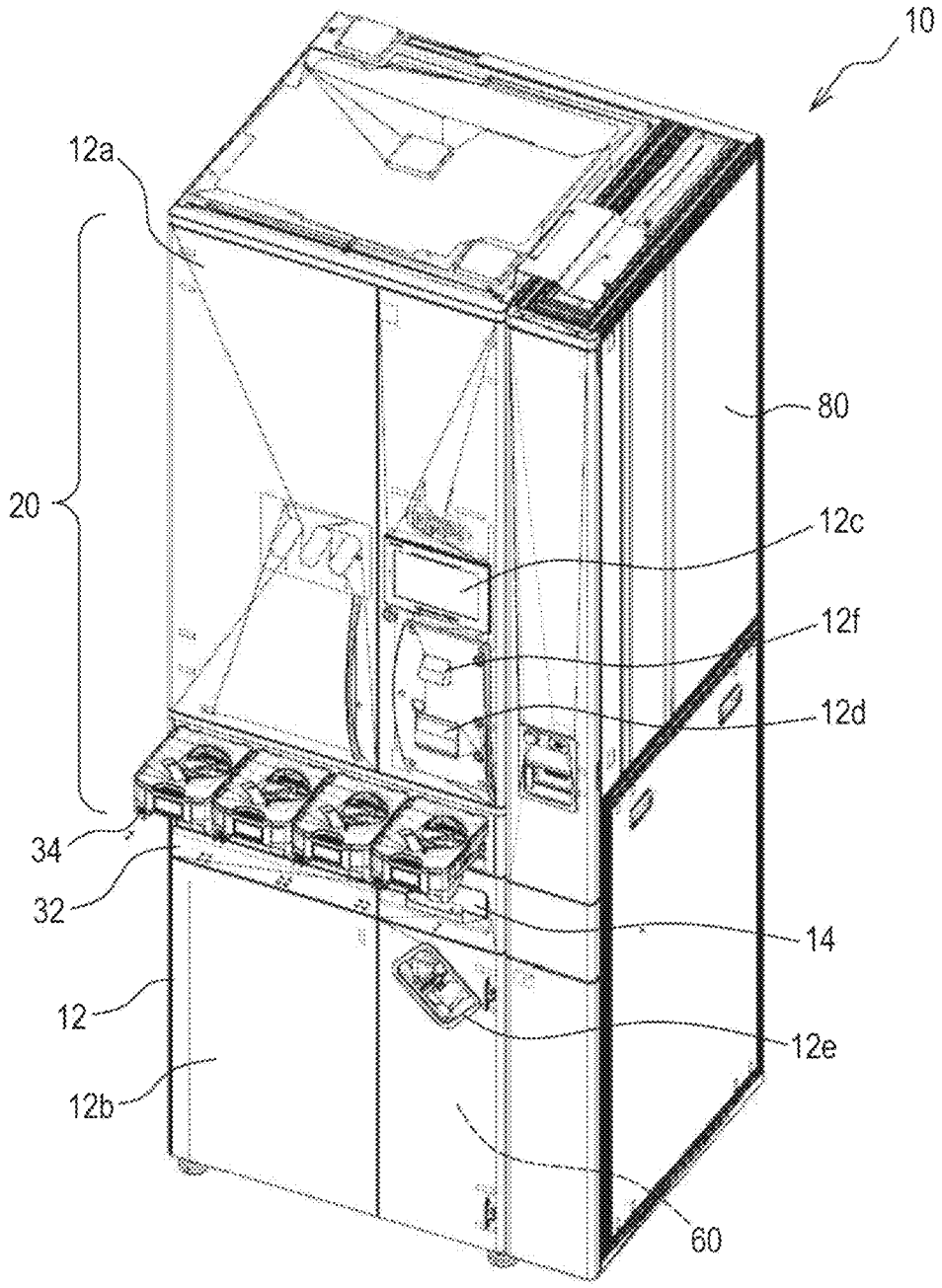
FIG. 2 is a perspective view for illustrating the drug packaging device according to one embodiment of the present invention.
Figure 3:
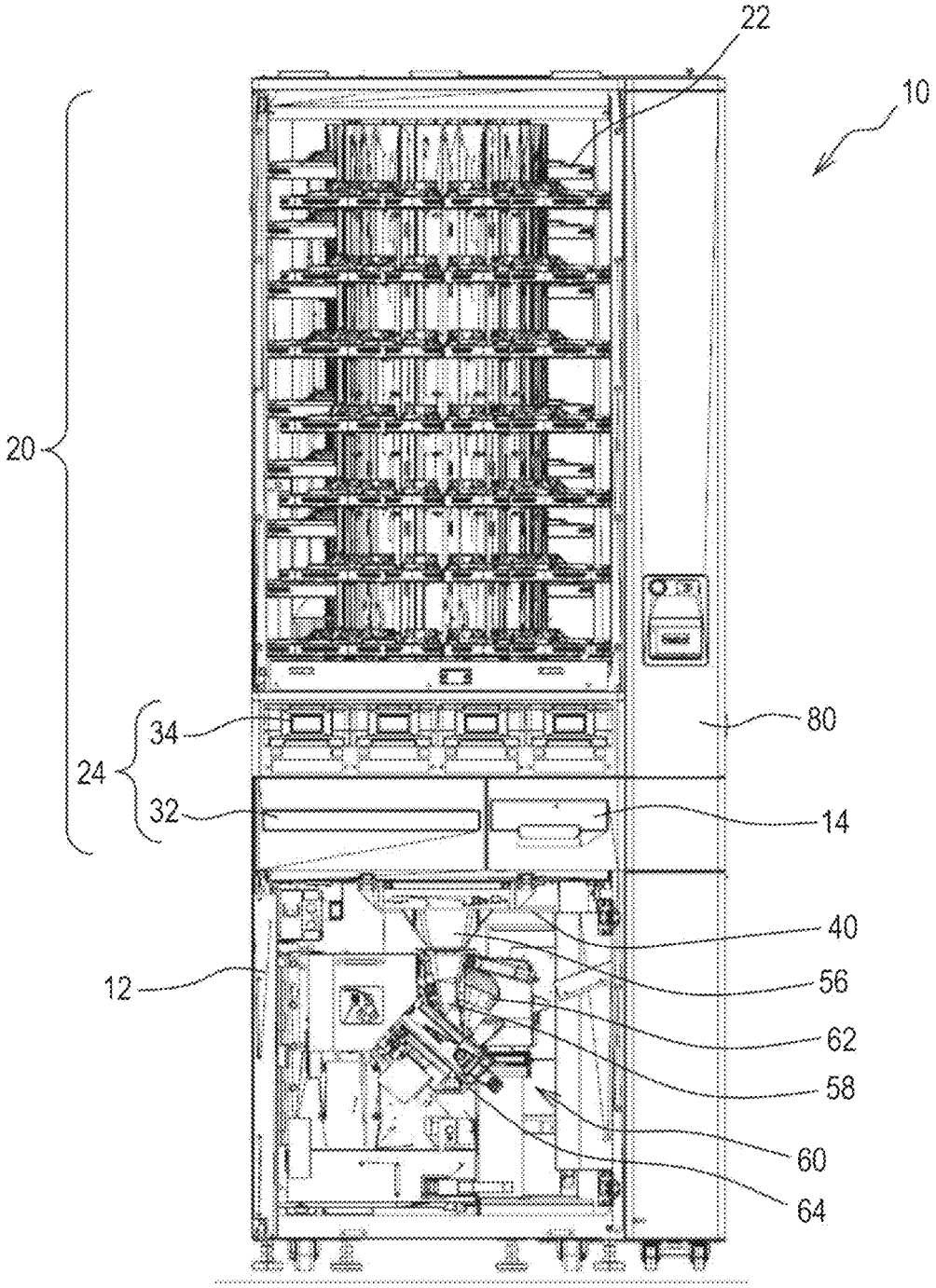
FIG. 3 is a front view for illustrating a device main body of the drug packaging device of FIG. 1 under a state in which doors are removed.

Now, a drug packaging device 10 according to an embodiment of the present invention is described. As illustrated in FIG. 1 to FIG. 3, the drug packaging device 10 includes, for example, a dispensing portion 20, a delivery portion 40, a packaging portion 60, and an auxiliary dispensing portion 80, which are provided to a device main body 12.

The device main body 12 has a shape of a vertically elongated cuboid or a rectangular parallelepiped, and includes doors 12*a* and 12*b* arranged at an upper part and a lower part of a front face. Moreover, at a middle part of the device main body 12 in the height direction, there is provided a cassette arrangement portion 14 in a drawable manner, in addition to a first receiving/dispensing portion 32 and a second receiving/dispensing portion 34 forming a second dispensing portion 24 of the dispensing portion 20 to be described later.

The device main body 12 includes, on the door 12*a* arranged at the upper part, an operation panel 12*c* and a journal printer 12*d* configured to print, for example, data of a drug for use of the first receiving/dispensing portion 32. On the door 12*b* arranged at the lower part, there is provided a discharge port 12*e* configured to discharge a drug bandage formed at the packaging portion 60. On the door 12*a* arranged at the upper part, there is further provided a barcode reader 12*f*. When a barcode on an original box of a drug is placed over the barcode reader 12*f*, a drug cassette 26, which is described later, for the drug moves toward a front side of the door 12*a*.

The cassette arrangement portion 14 is a portion at which the drug cassette 26 is to be arranged, as described later in detail. The cassette arrangement portion 14 serves as an operation table at which the drug cassettes 26 is to be arranged and operated. The cassette arrangement portion 14 can be drawn out from the device main body 12 or pushed toward the device main body 12 side for accommodation, as needed. The cassette arrangement portion 14 has a recess which is formed so as to allow arrangement of the drug cassettes 26 thereon. When the drug cassette 26 is fitted to this recess, a reader/writer (not shown) provided on the cassette arrangement portion 14 side arrives at a position opposed to a tag (not shown) provided on a bottom surface of the drug cassettes 26. The reader/writer is compatible with a communication method called "RFID" (Radio Frequency Identification), and is capable of communicating with the tag of the drug cassettes 26 to read and write required data.

Figure 4:
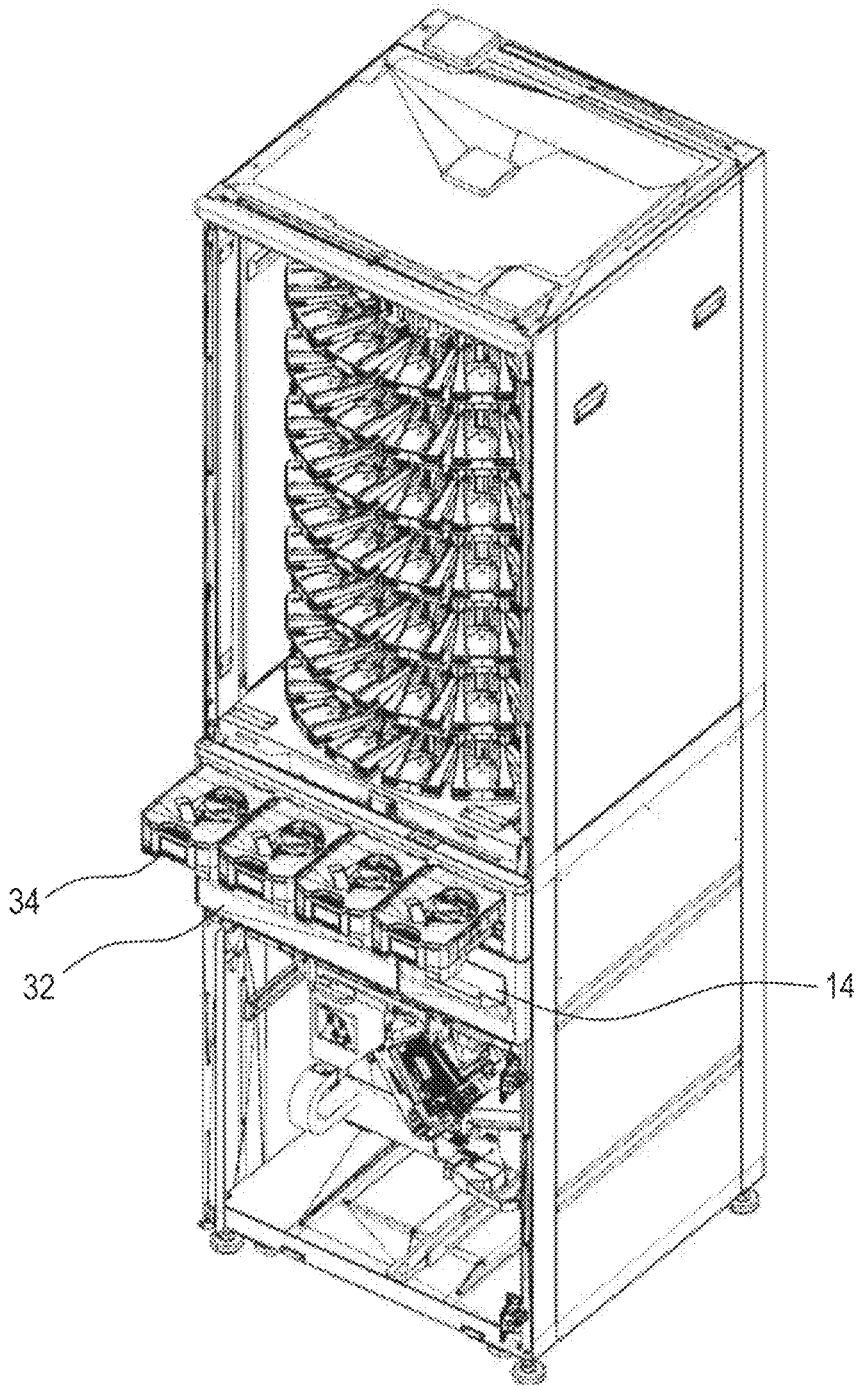
FIG. 4 is a perspective view of the device main body illustrated in FIG. 3.

The dispensing portion 20 is configured to prepare drug in a dispensable form. As illustrated in FIG. 3 and FIG. 4, the dispensing portion 20 includes a first dispensing portion 22 and the second dispensing portion 24.

Figure 5:
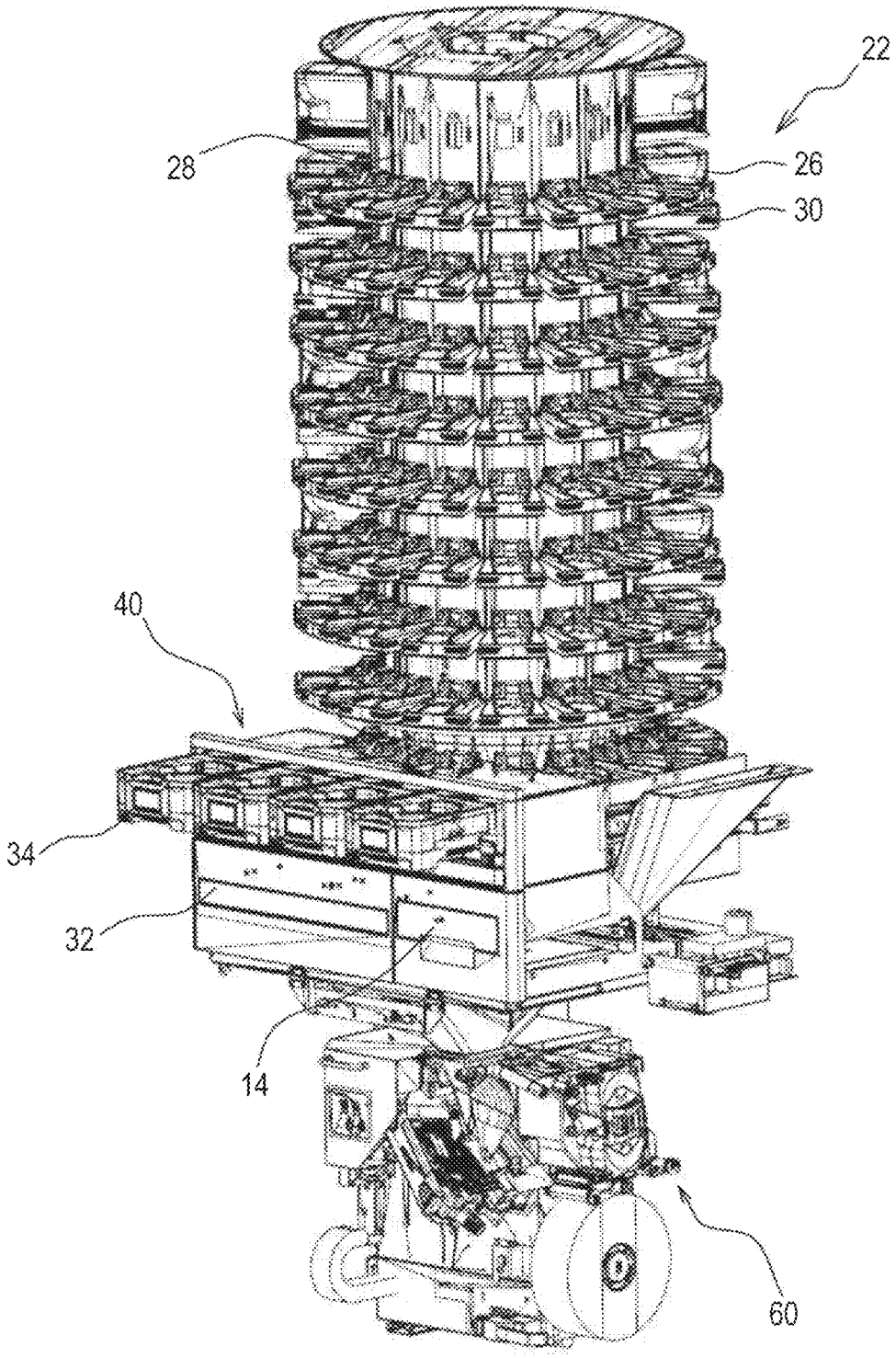
FIG. 5 is a perspective view for illustrating a first dispensing portion, a second dispensing portion, a delivery portion, and a packaging portion.

The first dispensing portion 22 includes a plurality of drug cassettes 26, and is configured to store a drug in each of the drug cassettes 26 and individually dispense the stored drug. The first dispensing portion 22 may be any dispensing portion having such function. In this embodiment, the first dispensing portion 22 has a configuration as illustrated in FIG. 5. Specifically, as illustrated in FIG. 5, the first dispensing portion 22 includes a drum 28 having upper and lower ends rotatably mounted to the device main body 12. On an outer surface of the drum 28, there are arranged support tables 30, which are configured to receive the drug cassettes 26 to be mounted thereon, in a circumferential direction, and are arranged in a plurality of stages in an up-and-down direction. The drug cassettes 26 has a well-known structure capable of accommodating drug inside thereof and discharging the drug one after another by rotation of a rotor. The drug discharged from the drug cassette 26 passes through a passage defined on an inner surface of the drum 28 and is guided to a first drug collection hopper 42 described later.

The second dispensing portion 24 is configured to receive a drug, which is prepared independently of the drug stored in the first dispensing portion 22, and dispense the drug. The second dispensing portion 24 includes a first receiving/dispensing portion 32 and a second receiving/dispensing portion 34. The first receiving/dispensing portion 32 and the second receiving/dispensing portion 34 are arranged vertically on the front side of the device main body 12. Specifically, the second receiving/dispensing portion 34 is arranged above the first receiving/dispensing portion 32.

Figure 6:
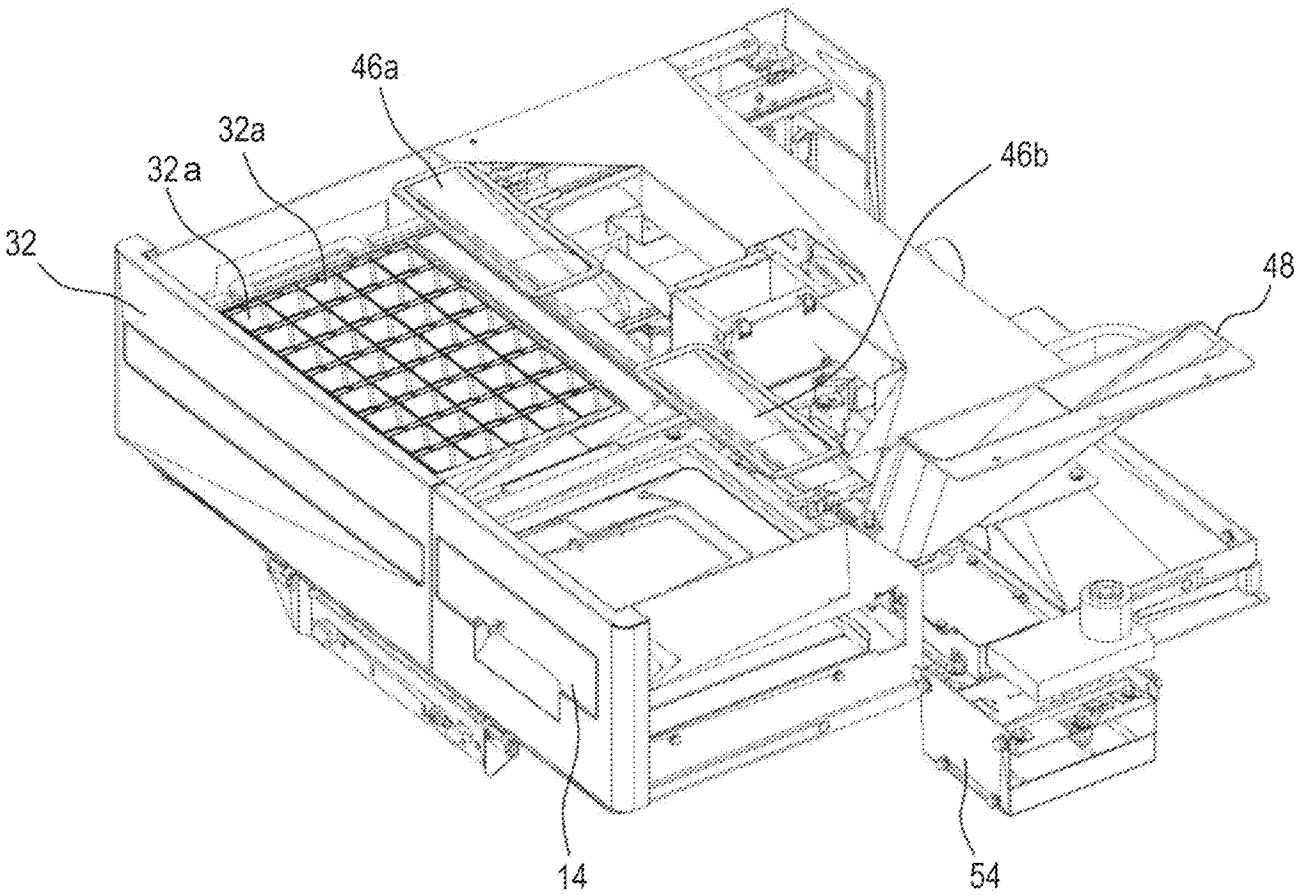
FIG. 6 is a perspective view for illustrating the delivery portion.
Figure 7:
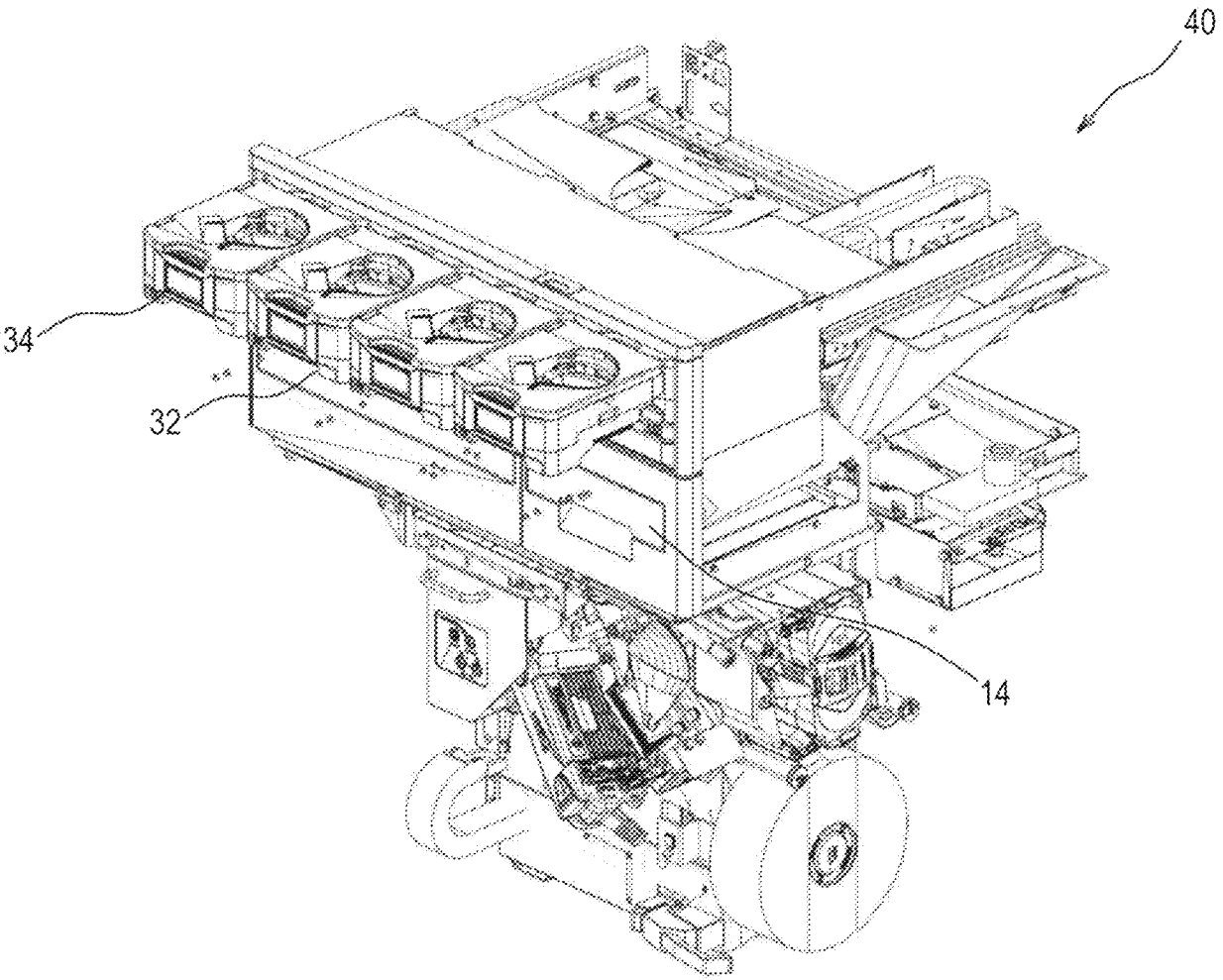
FIG. 7 is a perspective view for illustrating the delivery portion and the packaging portion.
Figure 8:
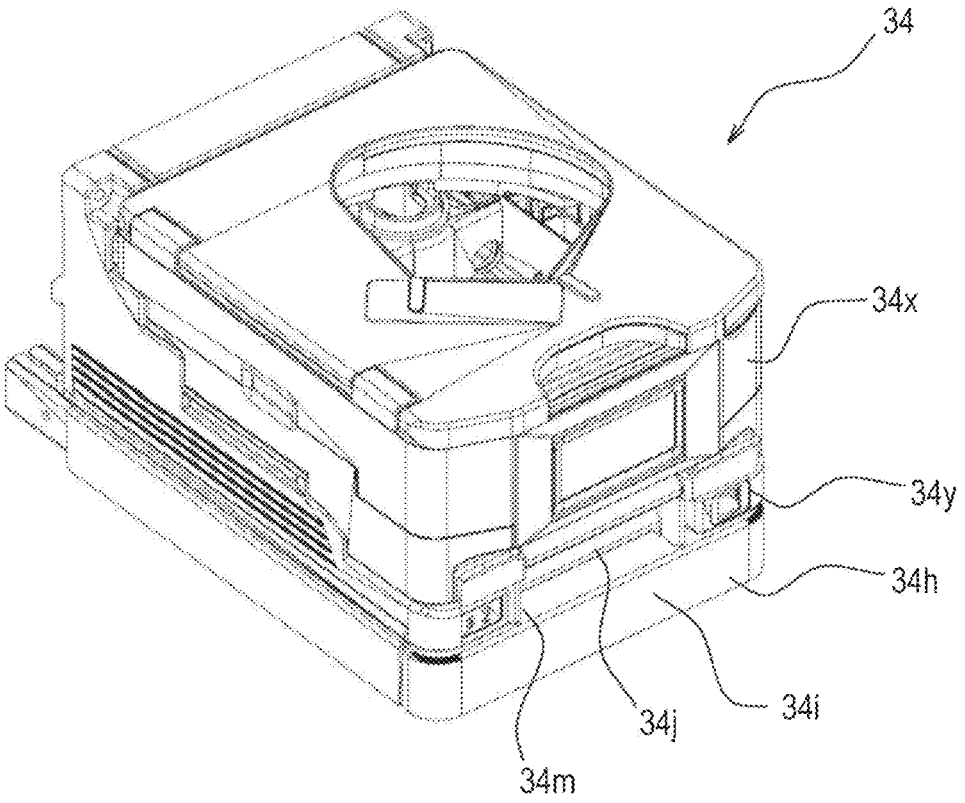
FIG. 8 is a perspective view for illustrating a second receiving/dispensing portion.
Figure 9:
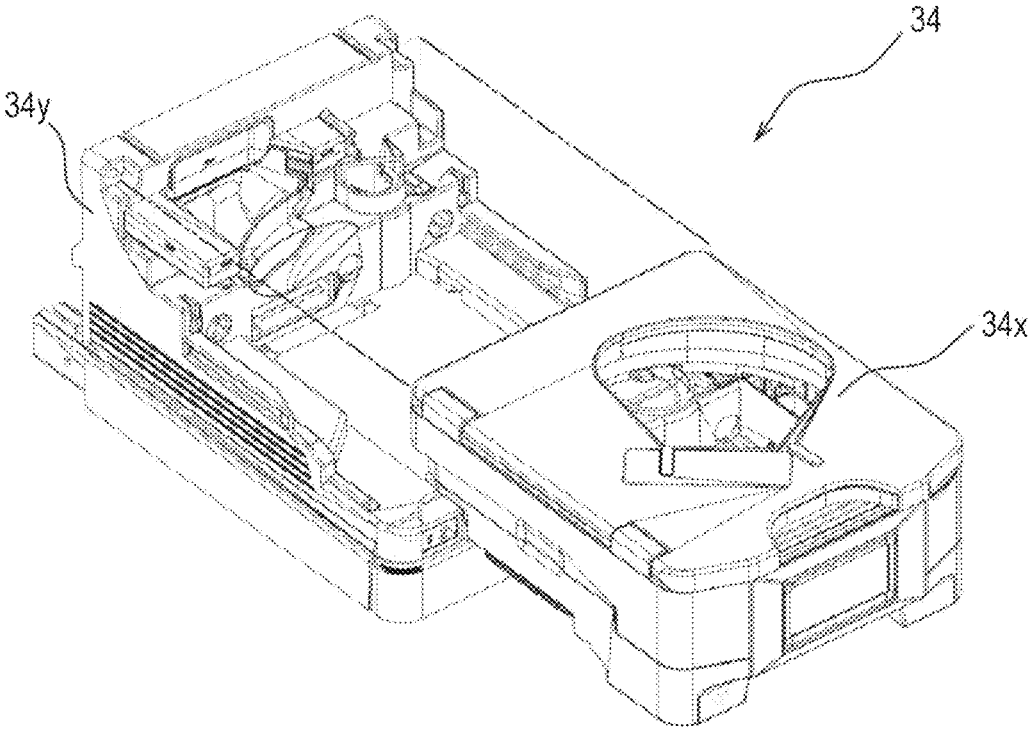
FIG. 9 is a perspective view for illustrating the second receiving/dispensing portion under a state in which a cassette portion is removed.

As illustrated in FIG. 6, the first receiving/dispensing portion 32 includes a plurality of accommodation parts 32*a*, and the drug is distributed to the accommodation parts 32*a* for respective dosage periods based on prescription information so that the drug can be dispensed from each accommodation part 32*a*. The first receiving/dispensing portion 32 (storage portion) has a function to temporarily receive the drug to be distributed and prepared for individual packing and then discharge the drug to the packaging portion 60. The first receiving/dispensing portion 32 can be effectively utilized for the use such as setting, for example, a half-cut drug or a drug less frequently used in the accommodation parts 32*a* having a grid-like form by manual distribution and packaging the drug in the packaging portion 60. The first receiving/dispensing portion 32 is drawn forward on the front side of the device main body 12 so as to enable manual distribution of the drug. After the drug has been prepared in the first receiving/dispensing portion 32 by manual distribution, the first receiving/dispensing portion 32 is set back into the device main body 12 so that the drug prepared by manual distribution can be sequentially dispensed in accordance with prescription.

Figure 10:
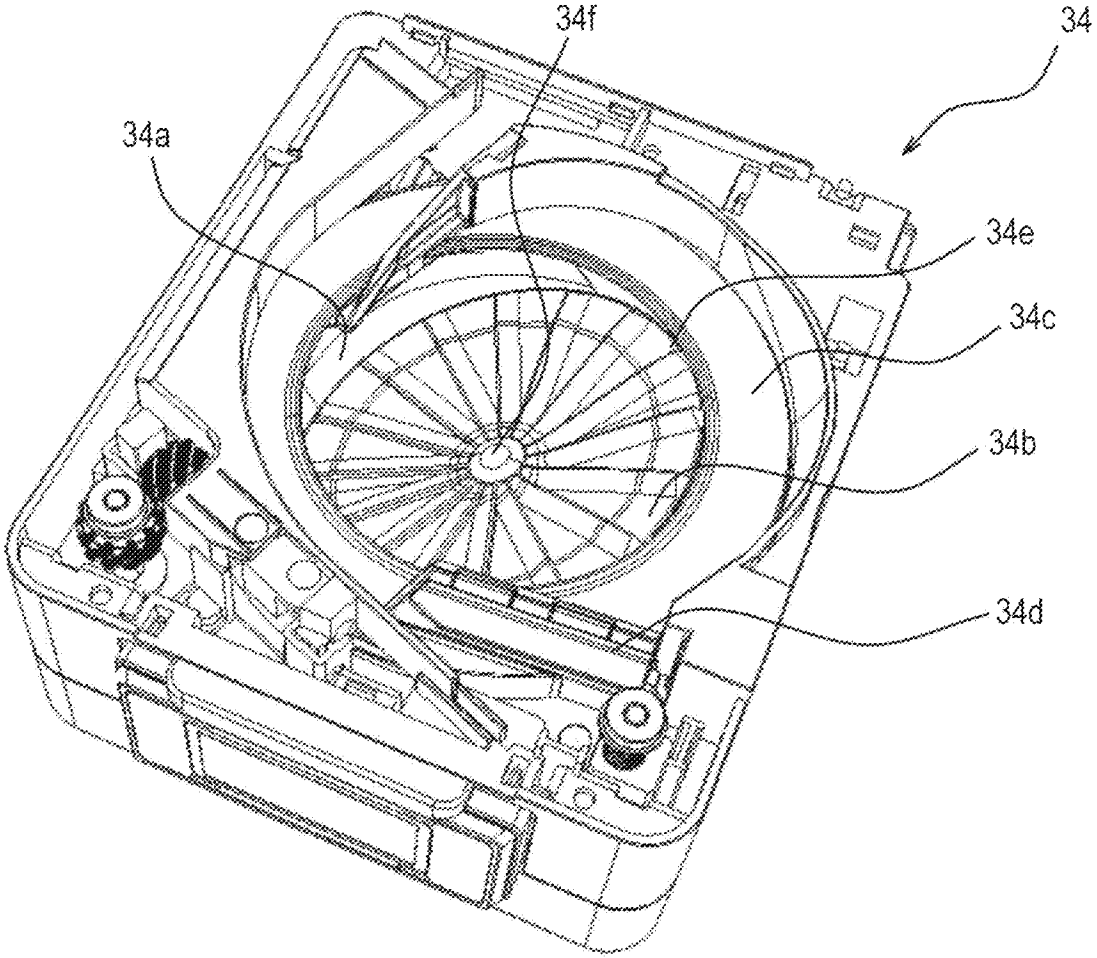
FIG. 10 is a perspective view for illustrating an internal structure of the second receiving/dispensing portion.
Figure 11:
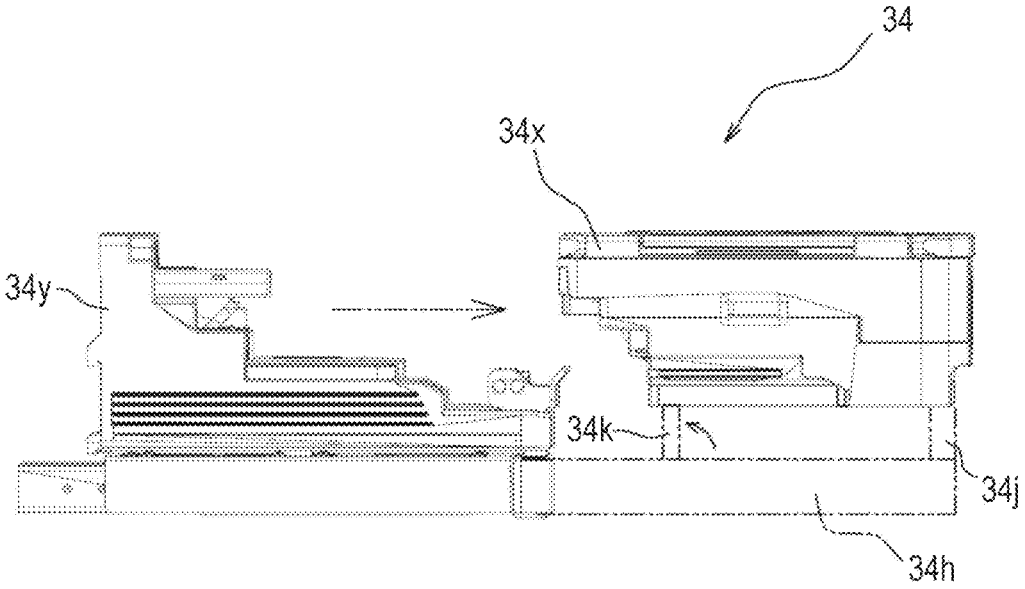
FIG. 11 is a side view for illustrating the second receiving/dispensing portion under a state in which a drawer member is drawn out.

With the second receiving/dispensing portion 34, a plurality of drugs of the same kind are collectively supplied thereto for preparation so that the drugs of the amount required for the individual packaging can be sequentially dispensed. The second receiving/dispensing portion 34 may be any receiving/dispensing portion having such function. In this embodiment, the second receiving/dispensing portion 34 has a configuration as illustrated in, for example, FIG. 10.

Specifically, the second receiving/dispensing portion 34 includes a cassette 34*x* and a motor base 34*y*. The second receiving/dispensing portion 34 has such a configuration that the cassette 34*x* is removably mounted to the motor base 34*y*. The cassette 34*x* includes a peripheral wall forming member 34*a*, a first rotation member 34*b*, a second rotation member 34*c*, and a drug dispensing portion 34*d*. The peripheral wall forming member 34*a* forms a peripheral wall of the drug accommodation portion 34*e* configured to receive the drug. The first rotation member 34*b* is arranged so as to incline from a bottom side toward an upper end side of the peripheral wall forming member 34*a*. The first rotation member 34*b* is configured to receive a motive force from, for example, a motor (not shown) to rotate around a first rotation shaft 34*f* which is inclined with respect to an axis line of the peripheral wall forming member 34*a*. The second rotation member 34*c* is arranged on an outer periphery on the upper end side of the peripheral wall forming member 34*a*. The second rotation member 34*c* is configured to receive a motive force from a motor provided in the motor base 34*y* to rotate around a second rotation shaft. The drug dispensing portion 34*d* is configured to discharge the drug from the second receiving/dispensing portion 34.

The second receiving/dispensing portion 34 rotates the first rotation member 34*b* so as to scoop up the drug prepared in the drug accommodation portion 34*e* and move the drug to the second rotation member 34*c*. Moreover, the second receiving/dispensing portion 34 rotates the second rotation member 34*c* to transfer the drug, which has been moved from the first rotation member 34*b* and placed thereon as described above, to a downstream side in the rotation direction and discharge the drug from the drug dispensing portion 34*d*. Therefore, rotation control is performed on the first rotation member 34*b* and the second rotation member 34*c* based on detection information given by, for example, a sensor (not shown) so that the drugs prepared in the drug accommodation portion 34*e* can be discharged one after another from the drug dispensing portion 34*d*.

The second receiving/dispensing portion 34 is arranged so as to be vertically arrayed with respect to the first receiving/dispensing portion 32. In this embodiment, the second receiving/dispensing portion 34 is arranged so as to be arrayed above the first receiving/dispensing portion 32. Moreover, a plurality of (four in this embodiment) second receiving/dispensing portions 34 are arranged so as to be arrayed in a horizontal direction (right-and-left direction as viewed from the front side of the device main body 12 in this embodiment). The second receiving/dispensing portion 34 can receive the drugs supplied thereto by being individually drawn out from the device main body 12, and can dispense the drugs by being pushed into the device main body 12. The plurality of (four in this embodiment) second receiving/dispensing portions 34 can be collectively and integrally drawn out from or pushed into the device main body 12.

Specifically, the second receiving/dispensing portion 34 includes a drawer member 34*h*, which is provided on the front side of the device main body 12 so as to be drawable and insertable through sliding with respect to the device main body 12. The drawer member 34*h* includes a plate-shaped drawer main body 34*i*, a grip portion 34*j*, and an operation piece 34*k*. The drawer main body 34*i* is supported so as to be slidable below the motor base 34*y* along a guide rail arranged in a depth direction of the device main body 12.

The grip portion 34*j* is a portion to be gripped by a user at the time of performing a sliding operation of the drawer member 34*h*. The grip portion 34*j* is provided so as to stand upright from the drawer main body 34*i*. The grip portion 34*j* is sized and shaped so as to be received in a cutout 34*m* formed on the front side of the motor base 34*y*. The grip portion 34*j* is engaged with a recess formed in a bottom surface of the cassette 34*x* on the front side. With this, the cassette 34*x* is supported by the grip portion 34*j*. Moreover, when a user holds the grip portion 34*j* to perform the sliding operation of the drawer member 34*h*, the cassette 34*x* can slide relative to the motor base 34*y*.

Moreover, the operation piece 34*k* is provided at a position apart from the grip portion 34*j* on a far side in the slide direction described above (back side of the device main body 12). The operation piece 34*k* is a member which operates in association with the sliding operation of the drawer member 34*h*. Specifically, the operation piece 34*k* falls down in association with an operation of allowing the drawer main body 34*i* to enter and exit the device main body 12 so as to be brought into a state of being accommodated in a cavity defined in the device main body 12. Therefore, when the drawer member 34*h* is allowed to enter and exit the device main body 12, the operation piece 34*k* does not interfere with the motor base 34*y*.

Meanwhile, when the drawer main body 34*i* is moved so as to exit from the device main body 12, the operation piece 34 is urged to protrude upward from an opening formed in a top surface of the drawer main body 34*i* so as to be brought into a state of standing upright. Moreover, the operation piece 34*k* has a shape to be fitted to the recess formed in the bottom surface of the cassette 34*x*. Therefore, even when the drawer main body 34*i* is drawn out so that the cassette 34*x* is separated away from the motor base 34*y*, a part of the cassette 34*x* on the depth side (back side of the device main body 12) can be supported from below.

Figure 17:
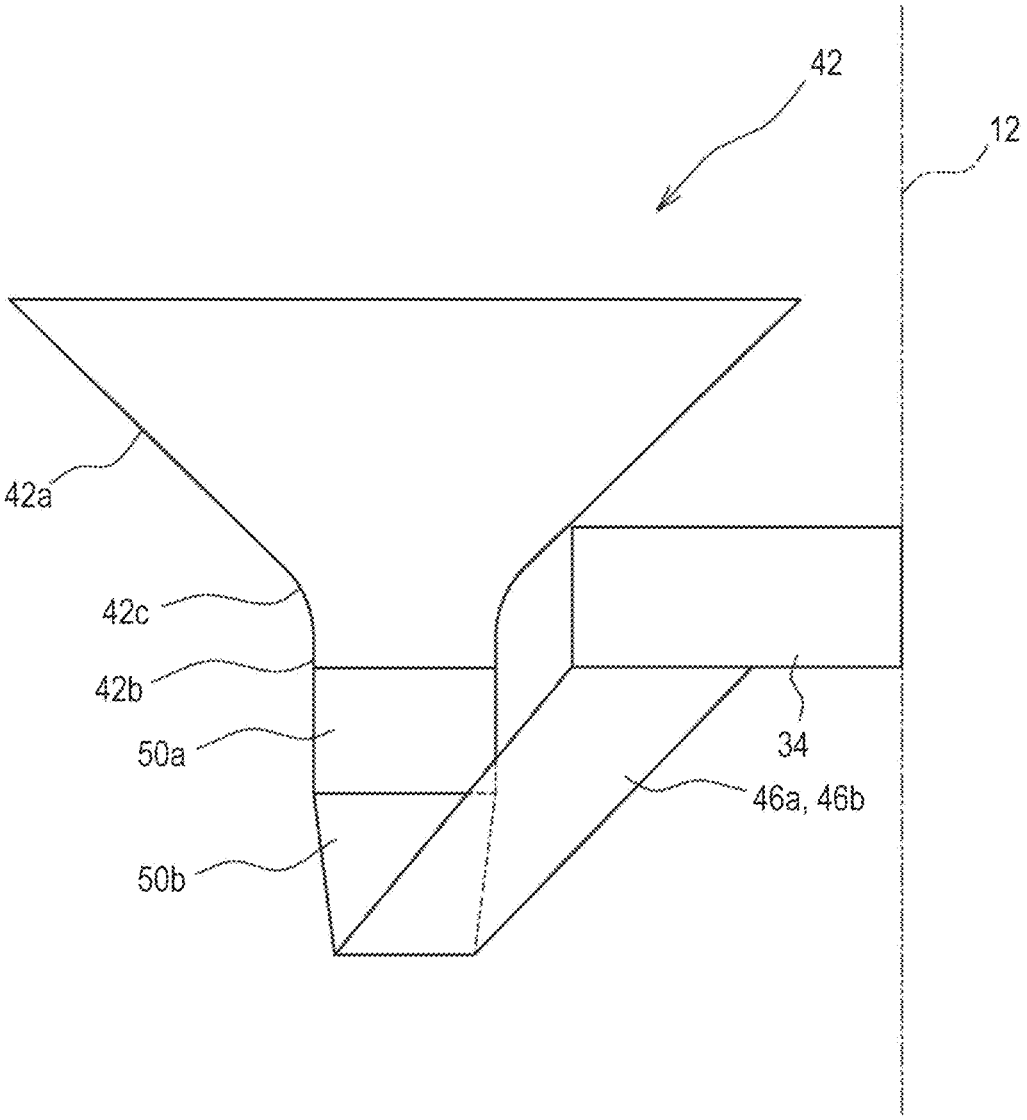
FIG. 17 is an explanatory view for illustrating a positional relationship between the first collection hopper and the second receiving/dispensing portion.

Moreover, the second receiving/dispensing portion 34 is arranged through effective use of a space defined below a hopper (upper side hopper) configured to collect drugs dispensed above the delivery portion 40 (first dispensing portion 22 in this embodiment) and supply the drugs to the delivery portion 40. Specifically, as described later in detail, in this embodiment, as the upper side hopper, there is provided a first drug collection hopper 42 configured to collect the drugs having been dispensed from the first dispensing portion 22 above the delivery portion 40. As illustrated in FIG. 17, the first drug collection hopper 42 includes a hopper main body 42*a*, a tubular portion 42*b*, and a neck portion 42*c*. The hopper main body 42*a* includes an inclination portion 42*d* which is inclined so that an opening region is narrowed from the upper side toward the lower side. The inclination portion 42*d* has an outer shape defined by an outer peripheral surface 42*e* formed along a substantially entire circumference of the hopper main body 42*a*. The second receiving/dispensing portion 34 is arranged so as to at least partially enter a space defined on the lower side of the inclination portion 42*d* when the second receiving/dispensing portion 34 slides relative to the device main body 12 to be pushed in. With the arrangement of the second receiving/dispensing portion 34 in such a manner, the space defined below the first drug collection hopper 42 is effectively used.

Figure 12:
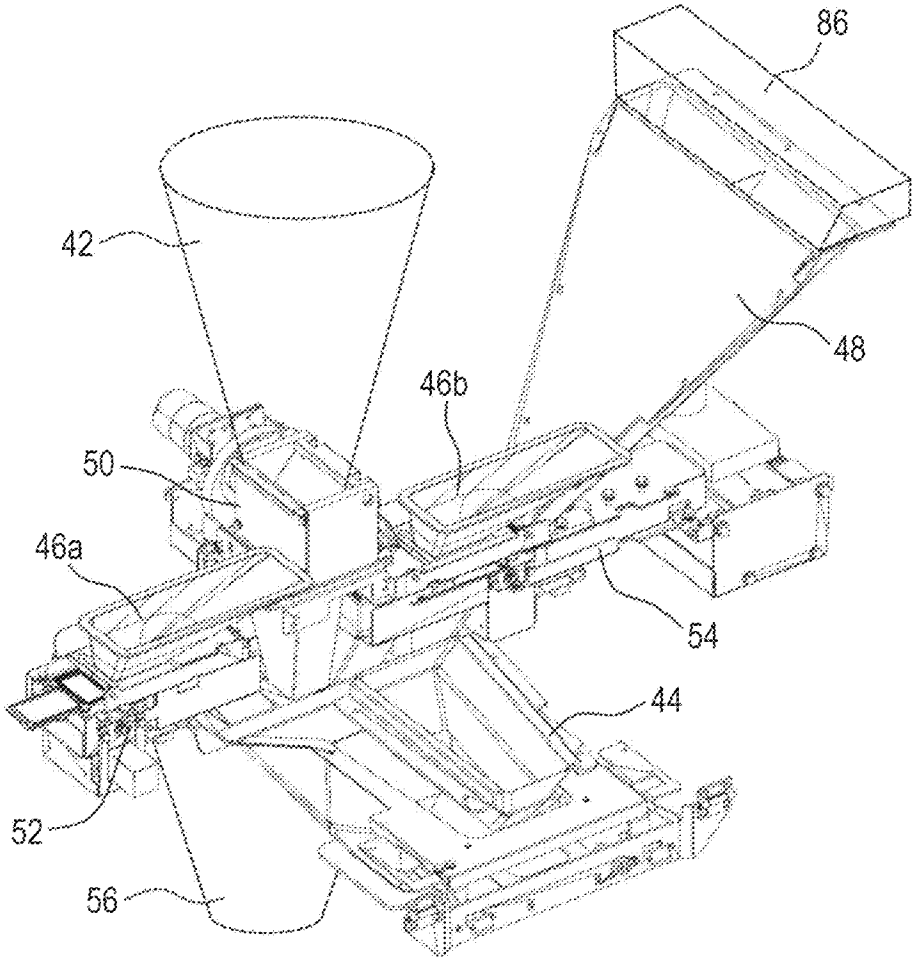
FIG. 12 is a perspective view for illustrating various hoppers, a shutter mechanism section, a first moving mechanism, and a second moving mechanism in the delivery portion.
Figure 13:
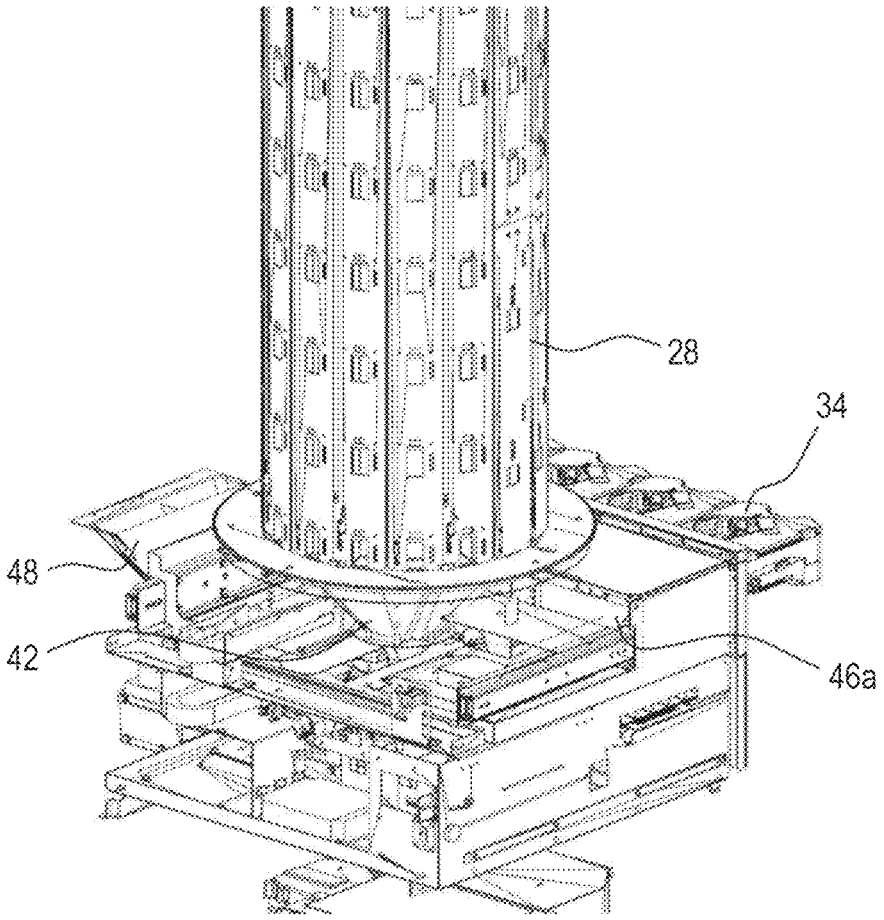
FIG. 13 is an enlarged perspective view for illustrating a vicinity of the delivery portion of FIG. 5.

The delivery portion 40 is provided in midway of a movement passage for the drugs, which are dispensed at the dispensing portion 20 described above and move toward the packaging portion 60. The delivery portion 40 temporarily receives the drug having fallen from the dispensing portion 20 and thereafter discharge the drugs to the packaging portion 60. The delivery portion 40 may be any delivery portion having such function. In this embodiment, the deliver portion 40 has a configuration as illustrated in FIG. 12.

Specifically, the delivery portion 40 includes five hoppers including the first drug collection hopper 42, a second drug collection hopper 44, a third drug collection hopper 46*a*, a fourth drug collection hopper 46*b*, and a fifth drug collection hopper, and the drugs dispensed from the first dispensing portion 22, the second dispensing portion 24, and an auxiliary dispensing portion 80 described later can be collected with those hoppers. Moreover, the delivery portion 40 includes a shutter mechanism section 50 (first opening/closing mechanism section) and first and second moving mechanisms 52 and 54 (second opening/closing mechanism section), and the drugs collected by the hoppers described above can be dispensed, at an appropriate timing, toward a collective hopper 56 provided below the delivery portion 40.

The first drug collection hopper 42 is a hopper arranged below the first dispensing portion 22. The first drug collection hopper 42 is configured to collect drugs having fallen from the drug cassettes 26 forming the first dispensing portion 22. The first drug collection hopper 42 has a lower end portion connected to the shutter mechanism section 50. Therefore, the first drug collection hopper 42 is capable of collecting the drugs having been discharged from the drug cassettes 26 and supplying the drugs to the shutter mechanism section 50.

Figure 14A:
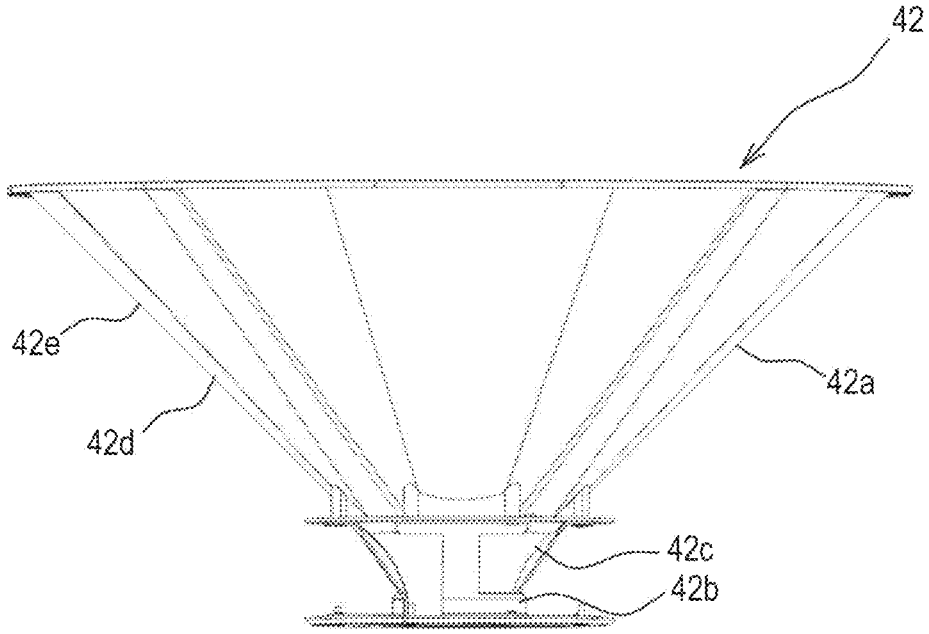
FIG. 14A is a side view of a first collection hopper.
Figure 14B:
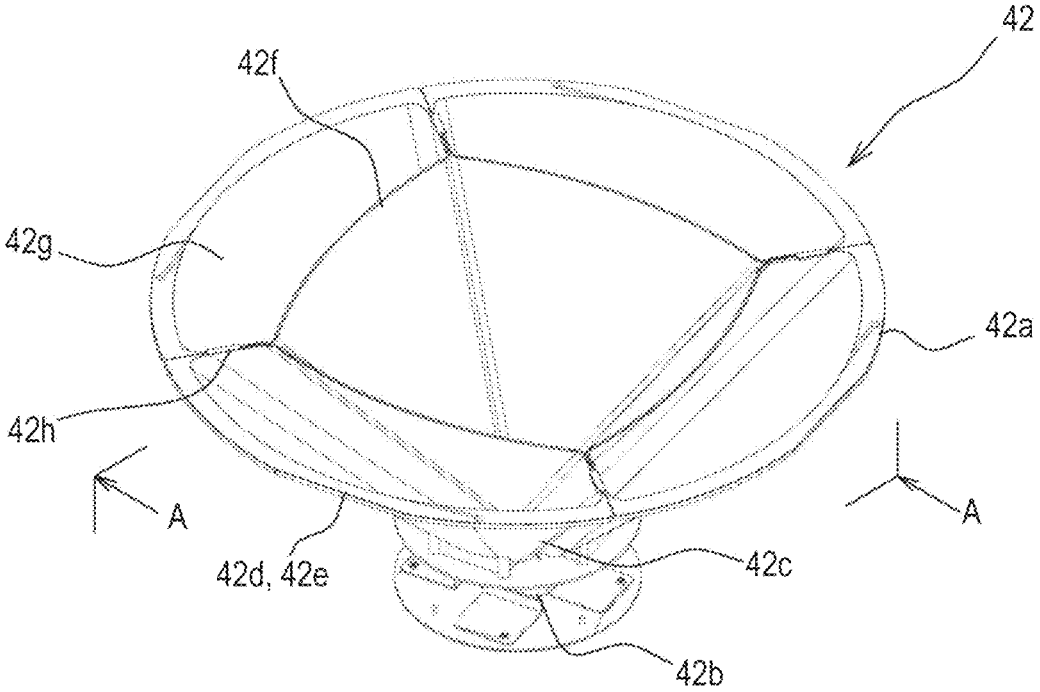
FIG. 14B is a perspective view of the first collection hopper.
Figure 16A:
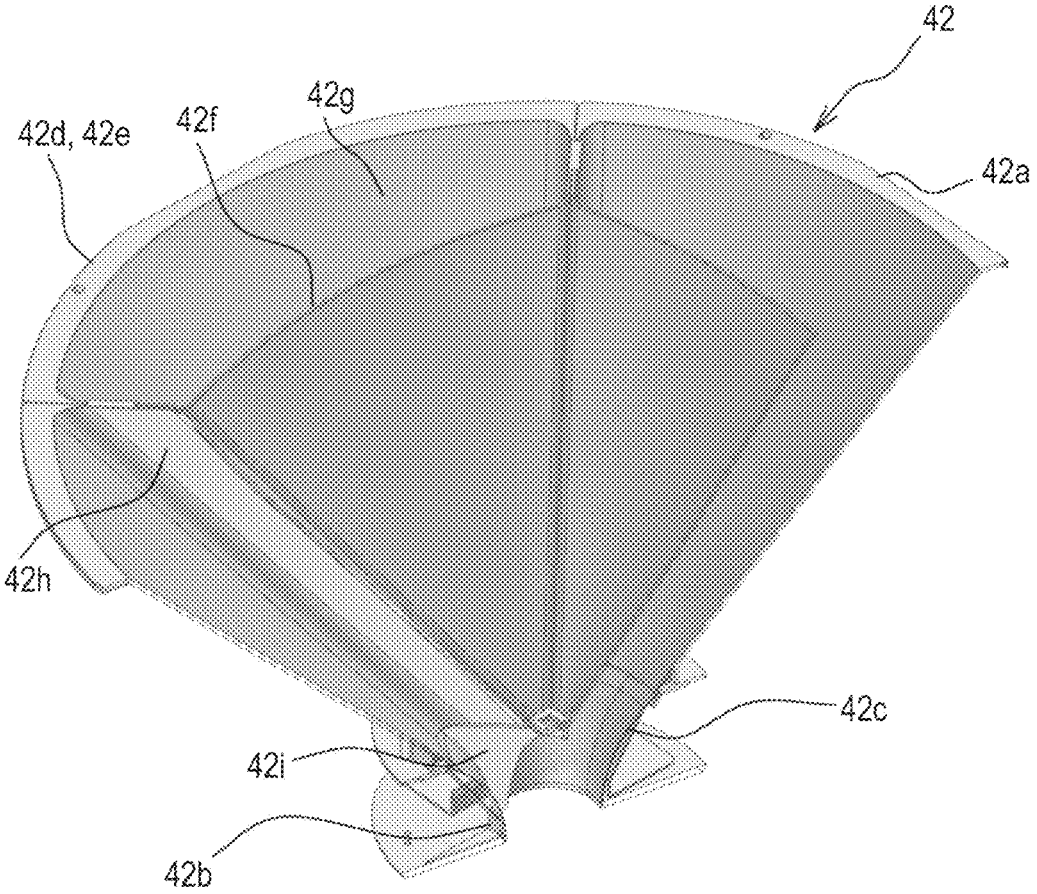
FIG. 16A is a sectional view taken along the line A-A of FIG. 14B.

As illustrated in FIG. 14A and FIG. 14B, the first drug collection hopper 42 includes the hopper main body 42*a*, the tubular portion 42*b*, and the neck portion 42*c*. The hopper main body 42*a*, as described above, has the outer shape defined by the outer peripheral surface 42*e*. Moreover, the hopper main body 42*a* includes an inner peripheral surface 42*f* formed at a substantially center portion in the radial direction. A region on a radially inner side with respect to the inner peripheral surface 42*f* is closed on a lower end side as illustrated in FIG. 16A. In the first drug collection hopper 42, a space 42*g* defined between the outer peripheral surface 42*e* and the inner peripheral surface 42*f* pass therethrough in the up-and-down direction. The space 42*g* communicates to the neck portion 42*c* on the lower end side and allows the drugs to pass inside thereof.

Figure 15A:
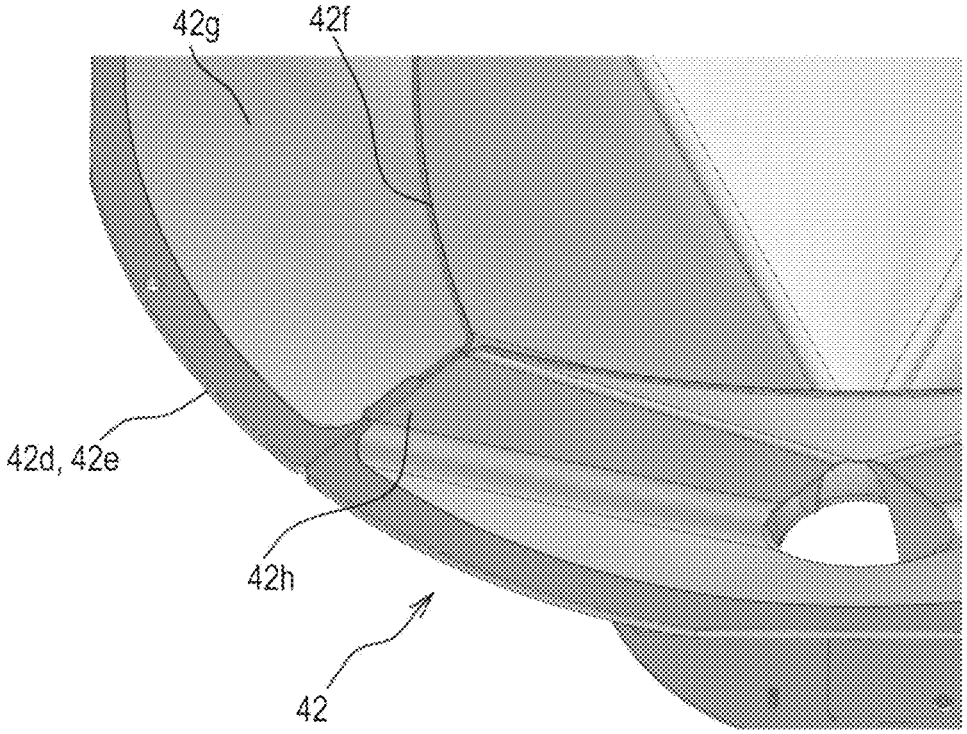
FIG. 15A is an enlarged perspective view for illustrating main parts of the first collection hopper illustrated in FIGS. 14A and 14B.
Figure 15B:
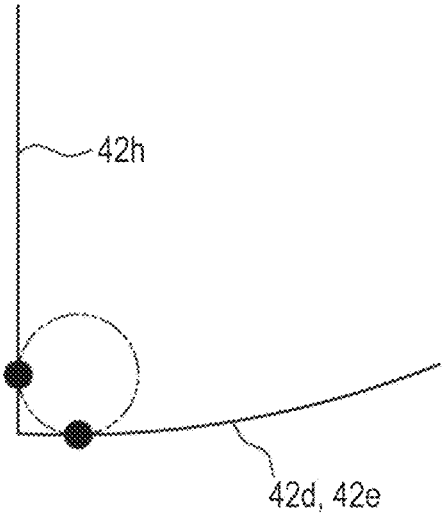
FIG. 15B is an explanatory view for illustrating a contact position between the drug and the first collection hopper.
Figure 15C:
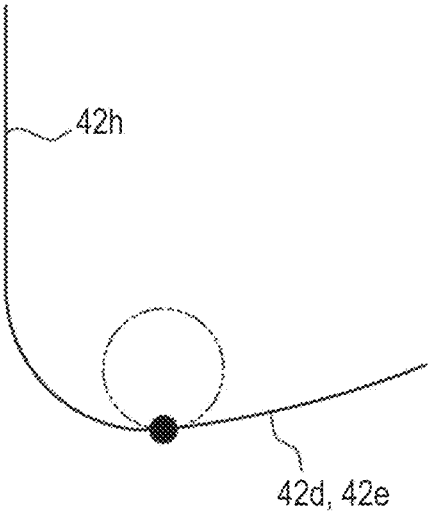
FIG. 15C is an explanatory view for illustrating a contact position between the drug and the first collection hopper.

The space 42*g* is partitioned into a plurality of (four in this embodiment) by partitions 42*h* provided so as to extend between the outer peripheral surface 42*e* and the inner peripheral surface 42*f*. As illustrated in FIG. 15A and FIG. 15C, the partitions 42*h* are each formed so as to significantly curve at a part on a root side (part continuous to the outer peripheral surface 42*e*). With such configuration, as compared to the case with the configuration in which the root of the partition 42*h* does not curve as illustrated in FIG. 15B for example, a contact point (indicated by solid circles in FIG. 15B and FIG. 15C) with the drug (indicated by the two-dot chain line) passing through the space 42*g* can be suppressed as small as possible. That is, in the case of the configuration illustrated in FIG. 15B, there is assumed a case in which the drug falls inside the space 42*g* while being in contact with the partition 42*h* at two positions indicated by the solid circles. In contrast, in the case of the configuration illustrated in FIG. 15C, even when the drug falls while being in contact with the outer peripheral surface 42*e*, the contact occurs only at one position indicated by the solid circle. In general, when the drug moves while being in contact with other members, there is a fear in that the drug adheres to the other members due to the influence of, for example, static electricity. Therefore, through suppression of the contact of the drug passing through the space 42*g* as small as possible with the configuration illustrated in FIG. 15C, the drug can fall smoothly without adhesion inside the first drug collection hopper 42.

The tubular portion 42*b* of the first drug collection hopper 42 is provided so as to communicate to a lower side of the hopper main body 42*a*. Moreover, the neck portion 42*c* is provided between the hopper main body 42*a* and the tubular portion 42*b*. In the first drug collection hopper 42, the hopper main body 42*a* and the tubular portion 42*b* are curved so as to be gently connected to each other at the neck portion 42*c*. Moreover, in the first drug collection hopper 42, parts below the neck portion 42*c* (tubular portion 42*b* and neck portion 42*c*) are made of a material which is softer than that of a part above the neck portion 42 (hopper main body 42*a*). Specifically, the hopper main body 42*a* is made of ABS resin having a thickness of 1.5 mm, and the neck portion 42*c* is made of PET resin having a thickness of 0.3 mm.

Figure 16B:
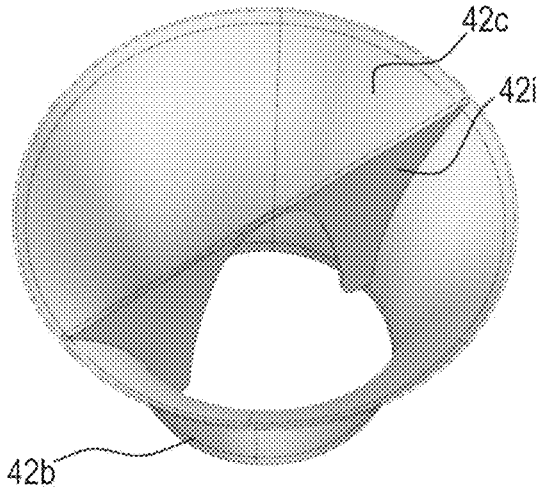
FIG. 16B is an enlarged perspective view for illustrating a tubular portion and a neck portion of the first collection hopper.

As illustrated in FIG. 16A and FIG. 16B, one or a plurality of (two in this embodiment) ribs 42*i* are provided so as to extend from the neck portion 42*c* to the tubular portion 42*b* on an inner side of the first drug collection hopper 42. The ribs 42*i* are provided so as to project toward the radially inner side. With the ribs 42*i* provided to the first drug collection hopper 42, defects such as the drugs turn along the inner peripheral surface of the tubular portion 42*b* and are less likely to fall can be prevented.

The second drug collection hopper 44 is a hopper which is arranged below the first receiving/dispensing portion 32 of the second dispensing portion 24. The second drug collection hopper 44 is capable of collecting the drugs dispensed from the first receiving/dispensing portion 32 and dispense the drugs to the collective hopper 56 provided therebelow.

The third drug collection hopper 46*a* and the fourth drug collection hopper 46*b* are hoppers which are configured to allow the drugs dispensed from the second receiving/dispensing portion 34 of the second dispensing portion 24 to pass therethrough. The third drug collection hopper 46*a* is configured to collect the drugs dispensed from the second receiving/dispensing portion 34 located first or second from the left side as seen from the front side of the device main body 12. Moreover, the fourth drug collection hopper 46*b* is configured to collect the drugs dispensed from the second receiving/dispensing portion 34 located first or second from the right as seen from the front side of the device main body 12. The third drug collection hopper 46*a* and the fourth drug collection hopper 46*b* are connected at respective lower end portions to the first and second moving mechanisms 52 and 54.

The fifth drug collection hopper 48 is a hopper configured to allow the drugs dispensed from the auxiliary dispensing portion 80 to pass therethrough. The fifth drug collection hopper 48 is connected at its lower end portion to the second moving mechanism 54.

Figure 18B:
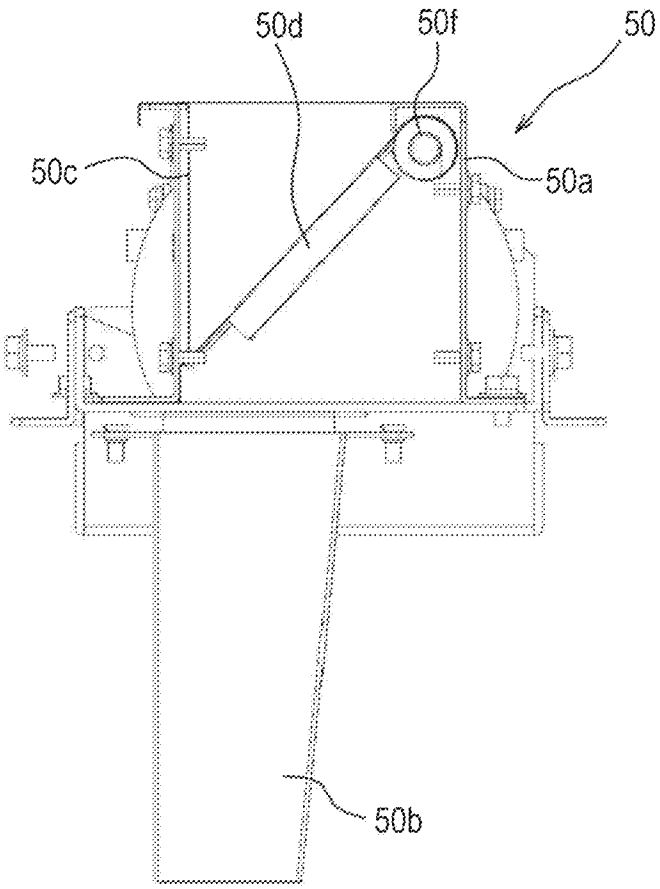
FIG. 18B is a sectional view of the shutter mechanism section.
Figure 18A:
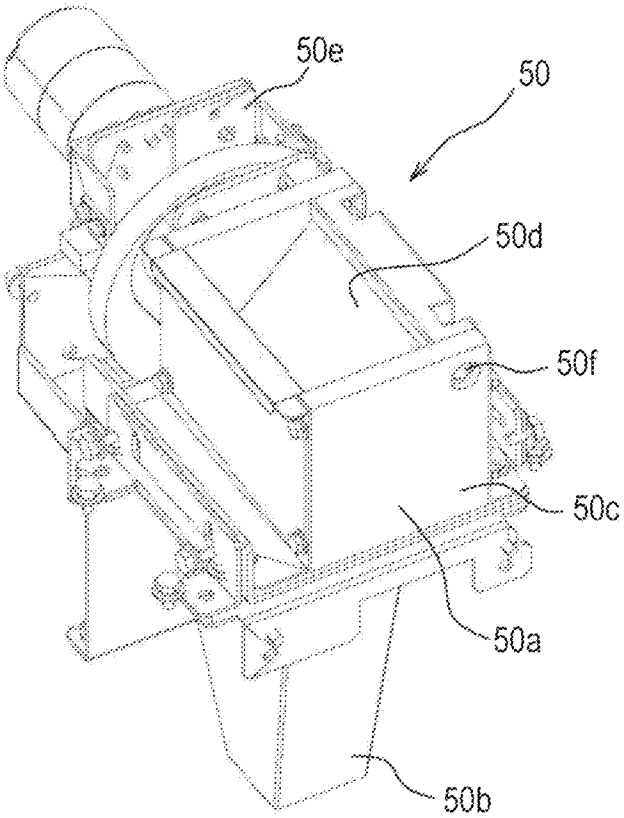
FIG. 18A is a perspective view for illustrating the shutter mechanism section.

As illustrated in FIG. 18A and FIG. 18B, the shutter mechanism section 50 (first opening/closing mechanism section/storage portion) includes a shutter mechanism main body 50*a* and a discharge portion 50*b*. The shutter mechanism section 50 has a function to temporarily receive drugs, which are dispensed from the first dispensing portion 22 forming the dispensing portion 20 to be prepared for individual packaging, and discharging the drugs to the packaging portion 60. The shutter mechanism main body 50*a* includes a shutter case 50*c*, a shutter 50*d* (first opening/closing member), and a drive mechanism 50*e*. The shutter case 50*c* may be any shutter case capable of receiving the drugs from the first drug collection hopper 42 and allowing the drugs to pass therethrough. In this embodiment, the shutter case 50*c* is a case which is communicable in the up-and-down direction and has a tubular shape with a substantially rectangular sectional shape.

Moreover, the shutter 50*d* (first opening/closing member) is capable of opening and closing a passage defined inside the shutter case 50*c*. The shutter 50*d* may be any shutter having such function. In this embodiment, the shutter 50*d* is rotatable at its base end portion around a rotation shaft 50*f*, and is suitably switchable between a close state and an open state. In the close state, a distal end portion is held in abutment against an inner surface of the shutter case 50*c* to receive the drugs. In the open state, the distal end portion separates away from the inner surface of the shutter case 50*c* to allow falling of the drugs. Therefore, the shutter 50*d* is brought into the close state to temporarily receive the drugs having fallen from the first drug collection hopper 42, and thereafter is brought into the open state so that the drugs can be discharged to the lower side. The drive mechanism 50*e* is coupled to the rotation shaft 50*f* of the shutter 50*d*. Therefore, through operation control of the drive mechanism 50*e*, opening/closing control of the shutter 50*d* can be performed.

On this occasion, it is desired that configurations of the shutter 50*d* as well as other components be optimized so as to prevent jumping of the drugs to a height exceeding an estimated height, such as the case in which the drugs jump in an unexpected direction when the drugs have fallen onto the shutter 50*d*. When the shutter 50*d* is made of rubber, the effect of absorbing a shock to some extent can be expected, but there is difficulty in stabilizing the direction of jumping of the drugs having fallen onto the shutter 50*d* due to deformation of the shutter 50*d* into a curved sectional shape. Moreover, when the shutter case 50*c* has such a sectional shape of expanding upward in a tapered shape, jumping of the drugs having fallen onto the shutter 50*d* cannot be suppressed. Moreover, when an axis center of the rotation shaft 50*f* of the shutter 50*d* is located at an intermediate portion inside the shutter case 50*c*, there is a fear in that the drugs having fallen collide with the rotation shaft 50*f* and scatter in unexpected directions.

With the assumption of the fear described above, this embodiment has the following configuration. As a first configuration, the shutter 50*d* has a multilayer structure in some or all of surfaces of the shutter case 50*c* and the shutter 50*d* with which the drugs having fallen from the upper side collide. In this embodiment, each of the shutter case 50*c* and the shutter 50*d* is formed by processing metal plates, and has a double-layer structure in which the metal plates are arrayed with a predetermined clearance therebetween. The clearance of the metal plates may suitably be set in accordance with an experiment or a theoretical calculation. In this embodiment, the metal plates forming each of the shutter case 50*c* and the shutter 50*d* have a clearance of from about 0.1 mm to 0.2 mm. With such configuration, the metal plate provided on a surface side (side on which the drugs having fallen collides) serves as a spring member, thereby being capable of suppressing jumping of the collided drugs to a height more than expected.

As another configuration besides those described above, the shutter 50*d* is formed of a flat plate, and the axis center of the rotation shaft 50*f* is arranged in the vicinity of an inner peripheral wall of the shutter case 50*c*. Through arrangement of the shutter 50*d* at a predetermined angle, the direction of jumping of the drugs having fallen onto the shutter 50*d* is stabilized. Moreover, in this embodiment, the shutter 50*d* is brought into the close state while being inclined at an angle falling within a range of equal to or more than 45 degrees and less than 90 degrees. With this, the direction of jumping of the drugs is oriented downward with respect to the horizontal direction. Further, through the arrangement of the rotation shaft 50*f* in the vicinity of the inner peripheral wall of the shutter case 50*c*, the drug having fallen collides with the rotation shaft 50*f*, thereby significantly reducing the fear of causing scattering of the drugs in unexpected directions.

Further, through formation of the surface which stands upright in the shutter case 50*c* so as to expand in a tapered shape in the vertical direction or downward (discharge side), the direction of jumping of the drugs is guided downward with respect to the horizontal direction.

The discharge portion 50*b* has a tubular shape and is formed so as to communicate to the lower end side of the shutter case 50*c*. The discharge portion 50*b* is capable of discharging the drugs, which have fallen from the shutter case 50*c* by bringing the shutter 50*d* into the open state, to the collective hopper 56.

Figure 19A:
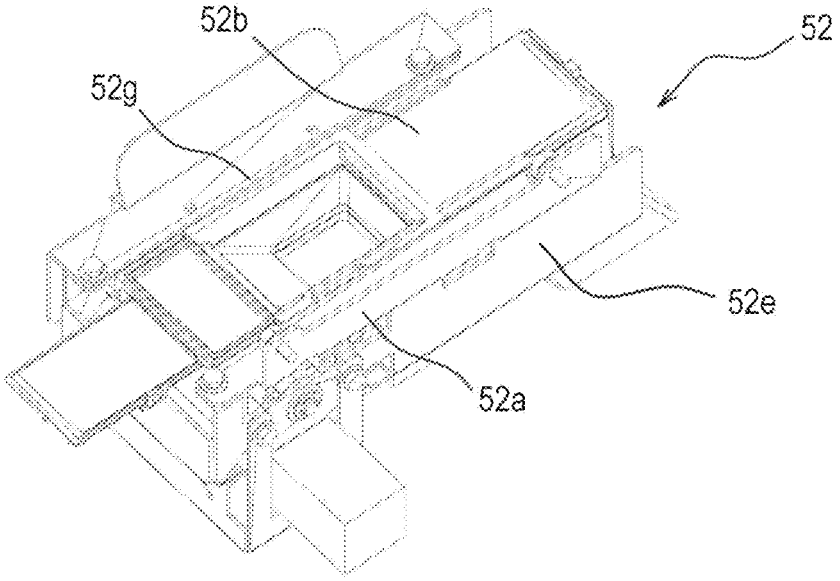
FIG. 19A is a perspective view for illustrating the first moving mechanism.
Figure 19B:
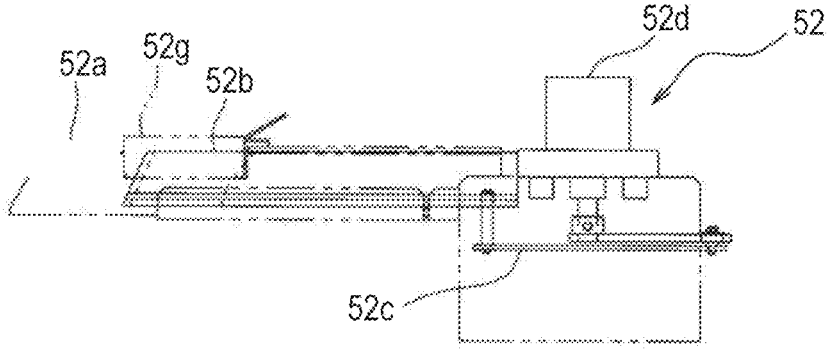
FIG. 19B is a side view for illustrating the first moving mechanism in a retreated state.
Figure 19C:
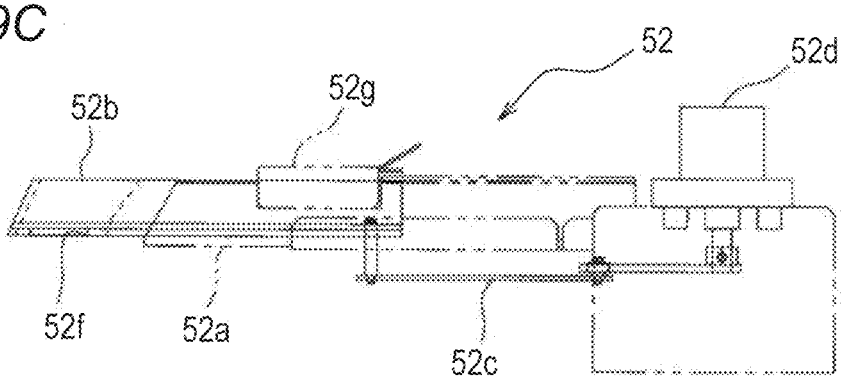
FIG. 19C is a side view for illustrating the first moving mechanism in an advanced state.

As illustrated in FIGS. 19A-19C, the first moving mechanism 52 (second opening/closing mechanism section/storage portion) includes a guide rail 52*a*, a slide container 52*b*, a link mechanism 52*c*, and a motor 52*d*. The first moving mechanism 52 has a function to temporarily receive the drugs, which have been dispensed from the second receiving/dispensing portion 34 to be prepared for individual packaging, and then discharge the drugs to the packaging portion 60. The guide rail 52*a* has a groove-shaped cross section and is provided so as to project laterally from the base 52*e*. Moreover, the slide container 52*b* is a rectangular container provided to the guide rail 52*a* so as to be slidable. The slide container 52*b* is opened upward, and has an opening 52*f* formed at a bottom. On an upper side of the slide container 52*b*, a frame 52*g* with which a lower end opening of the third drug collection hopper 46*a* is engaged is mounted to the guide rail 52*a*. The link mechanism 52*c* is configured to slide the slide container 52*b* along the guide rail 52*a*. The link mechanism 52*c* can be driven with a motive force input from the motor 52*d*.

As illustrated in FIG. 19B, when the slide container 52*b* retreats, the first moving mechanism 52 is capable of accommodating the drugs in the slide container 52*b*. When the motor 52*d* is driven to cause the slide container 52*b* to advance via the link mechanism 52*c* so that the opening 52*f* of the slide container 52*b* is separated away from the guide rail 52*a* (hereinafter also referred to as "advanced state"), the drugs in the slide container 52*b* fall to be collected to the collective hopper 56. Moreover, in the advanced state, a region surrounded by the frame 52*g* is brought into a state of being closed by the slide container 52*b* (hereinafter also referred to as "closed state"). In this state, the lower end portion of the third drug collection hopper 46*a* is brought into a state of being closed by a top surface of the slide container 52*b* in the region surrounded by the frame 52*g*. Moreover, when the slide container 52*b* is brought into a state of being retreated (hereinafter also referred to as "retreated state") from the advanced state, the lower end portion of the third drug collection hopper 46*a* having been closed by the top surface of the slide container 52*b* is opened so that there is given a state in which the drugs can be charged from the third drug collection hopper 46*a* into the slide container 52*b*. Therefore, in the first moving mechanism 52, the slide container 52*b* exerts a function as an opening/closing mechanism (second opening/closing mechanism section) configured to open and close the third drug collection hopper 46*a*. Moreover, the first moving mechanism 52 also exerts a function as a horizontal moving mechanism configured to move the drugs, which have been dispensed and fallen, in a direction intersecting the falling direction (horizontal direction in this embodiment).

Figure 20A:
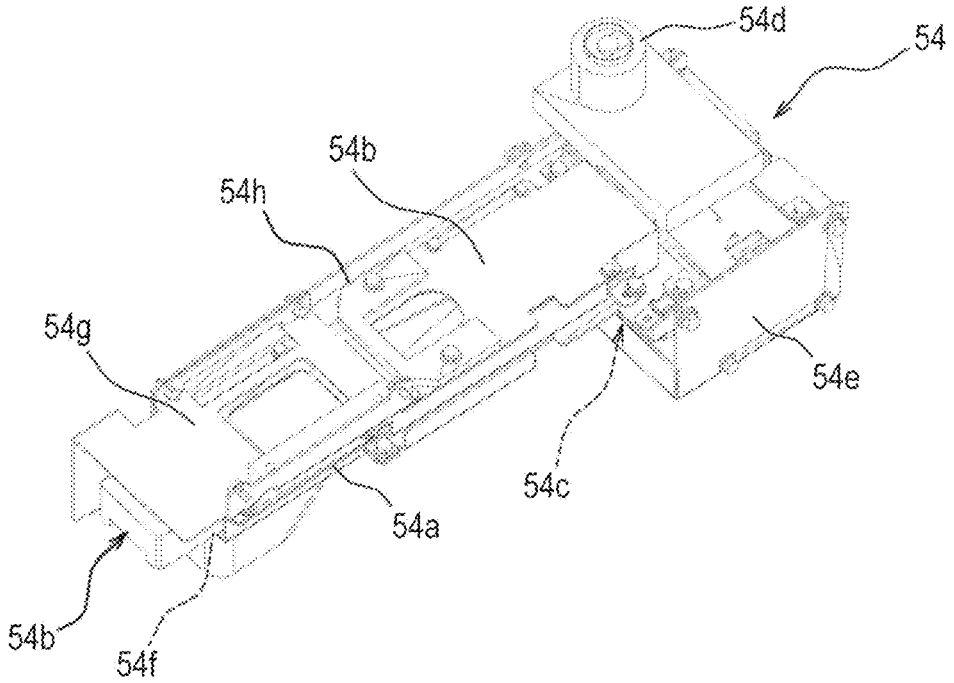
FIG. 20A is a perspective view for illustrating a second moving mechanism.
Figure 20B:
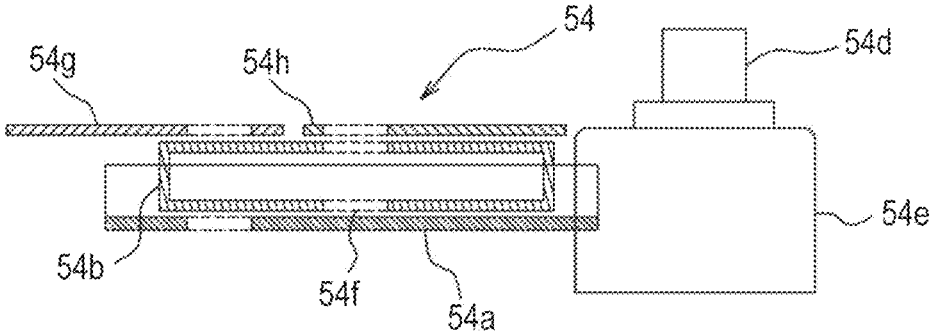
FIG. 20B is a side view for illustrating the second moving mechanism in a retreated state.
Figure 20C:
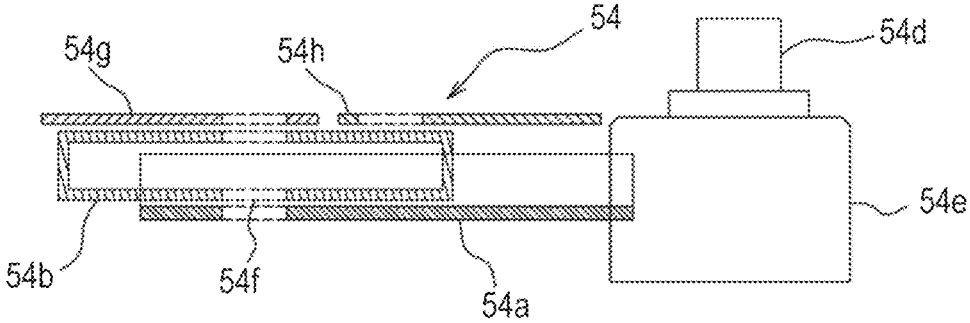
FIG. 20C is a side view for illustrating the second moving mechanism in an advanced state.

The second moving mechanism 54 has a function to temporarily receive the drugs, which have been dispensed from the second receiving/dispensing portion 34 to be prepared for individual packaging, and then discharge the drugs to the packaging portion 60. The second moving mechanism 54 is configured to operate based on the same operation principle as that of the first moving mechanism 52 described above. Specifically, the second moving mechanism 54 includes, as illustrated in FIGS. 20A to 20C, a guide rail 54*a*, a slide container 54*b*, a link mechanism 54*c*, and a motor 54*d*. The guide rail 54*a* has a groove-shaped cross section and is provided so as to project laterally from the base 54*e*. Moreover, the slide container 54*b* is a rectangular container provided to the guide rail 54*a* so as to be slidable. The slide container 54*b* is opened upward, and has an opening 54*f* formed at a bottom. On an upper side of the slide container 54*b*, a frame 54*g* with which a lower end opening of the fourth drug collection hopper 46*b* and the fifth drug collection hopper 48 is engaged is mounted to the guide rail 54*a*. The link mechanism 54*c* is configured to slide the slide container 54*b* along the guide rail 54*a*. The link mechanism 54*c* can be driven with a motive force input from the motor 54*d*.

As illustrated in FIG. 20B when the slide container 54*b* retreats, the second moving mechanism 54 is capable of accommodating the drugs in the slide container 54*b*. When the motor 54*d* is driven to cause the slide container 54*b* to advance via the link mechanism 54*c* so that the opening 54*f* of the slide container 54*b* is separated away from the guide rail 54*a* (hereinafter also referred to as "advanced state"), the drugs in the slide container 54*b* fall to be collected to the collective hopper 56. Moreover, in the advanced state, a region surrounded by the frames 54*g* and 54*h* is brought into a state of being closed by the slide container 54*b*. In this state, the lower end portion of the third drug collection hopper 46*b* is brought into a state of being closed by a top surface of the slide container 54*b* in the region surrounded by the frames 54*g* and 54*h* (hereinafter also referred to as "closed state"). Moreover, when the slide container 54*b* is brought into a state of being retreated (hereinafter also referred to as "retreated state") from the advanced state, the lower end portion of the third drug collection hopper 48 having been closed by the top surface of the slide container 54*b* is opened so that there is given a state in which the drugs can be charged from the third drug collection hopper 48 into the opening 52*f*. Therefore, in the second moving mechanism 54, the slide container 54*b* exerts a function as an opening/closing mechanism (second opening/closing mechanism section) configured to open and close the fourth drug collection hopper 46*b*. Moreover, the second moving mechanism 54 also exerts a function as a horizontal moving mechanism configured to move the drugs, which have been dispensed and fallen, in a direction intersecting the falling direction (horizontal direction in this embodiment).

As illustrated in FIG. 3, a collective hopper 56 (hopper) and a packaging hopper 58 are provided between the delivery portion 40 and the packaging portion 60, which are described above. The collective hopper 56 is configured to collect the drugs having been discharged from the delivery portion 40 side and send the drugs to the packaging portion 60 side.

The packaging hopper 58 is removably provided below the collective hopper 56. The packaging hopper 58 is configured to introduce the drugs, which fall from the collective hopper 56, to individual packaging paper described later.

As illustrated in FIG. 3, the packaging portion 60 is arranged more on the lower side with respect to the delivery portion 40 described above. In the packaging portion 60, the individual packaging paper which is prepared in a half-folded roll shape is sent out and fed. The individual packaging paper is fed in a state of being opened upward while being guided by a guide 62, and receives the drugs from the packaging hopper 58. The individual packaging paper having received the drugs is introduced to a heater roller 64. The individual packaging paper is sealed at the heater roller 64 in a vertical direction and a lateral direction per dose in accordance with prescription information, and sequentially package the drugs having been received. With this, an individual packaging bag having individually packaged the drugs is formed into a package band which is continuous, for example, in unit of a patient, in unit of a dosage period, and in unit of a kind of drug, and is sent out obliquely downward. The package band is conveyed obliquely upward by a conveyor (not shown), and is discharged from the discharge port 12*e* formed in the door.

Figure 21:
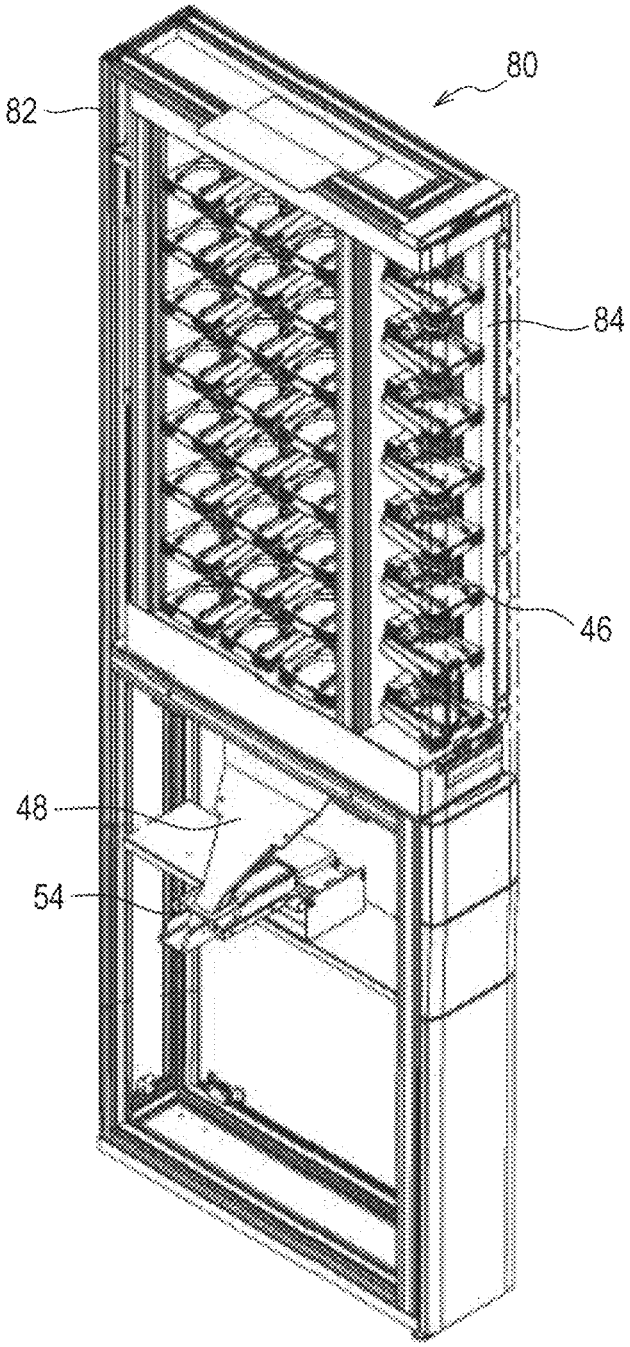
FIG. 21 is a perspective view for illustrating an auxiliary dispensing portion.
Figure 22:
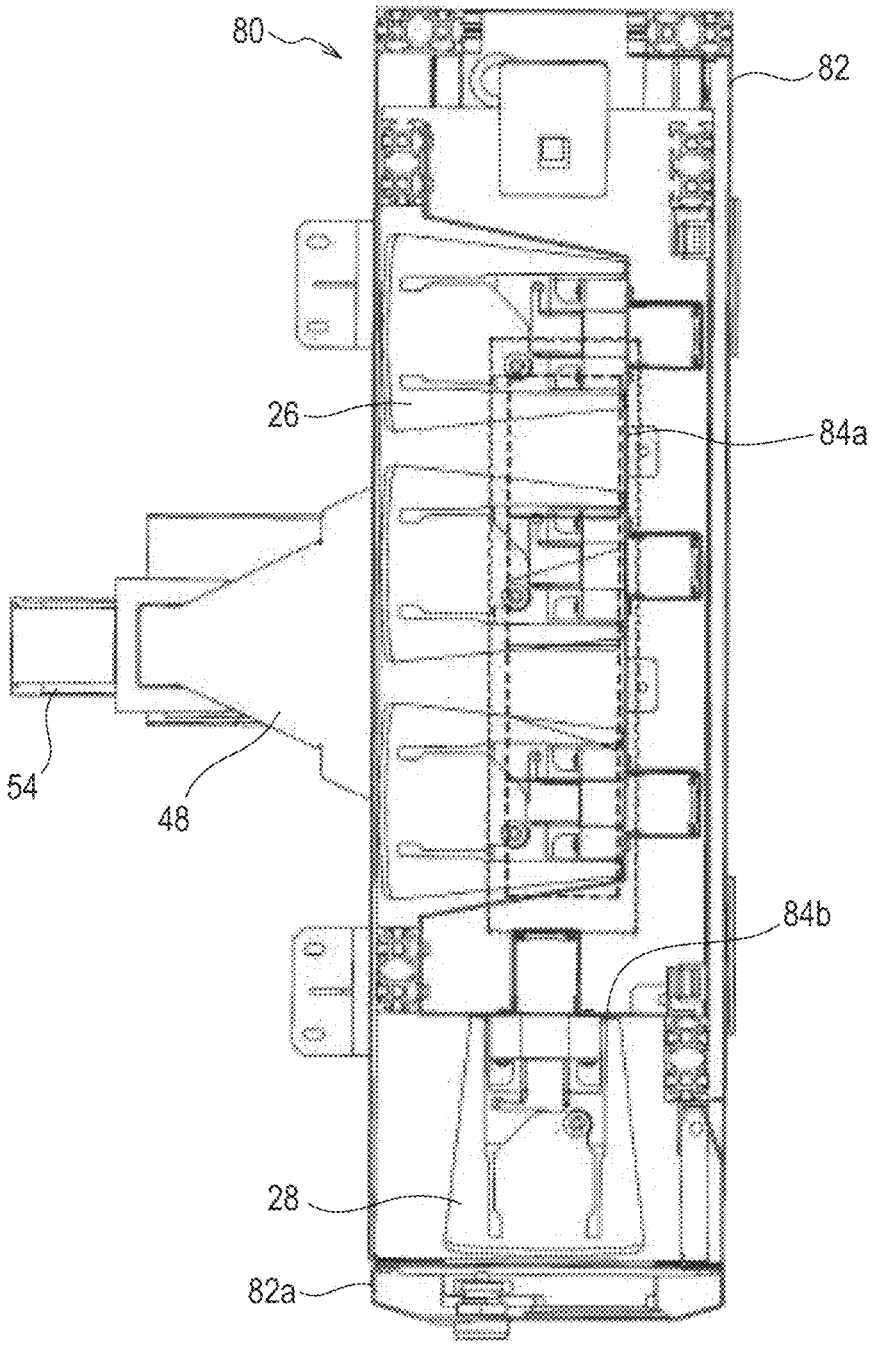
FIG. 22 is a plan view for illustrating the auxiliary dispensing portion.

As illustrated in FIG. 21 and FIG. 22, the auxiliary dispensing portion 80 includes a main body 82 and a drawer body 84.

The main body 82 has an outer shape which is a vertically elongated parallelepiped shape, with a height and a depth substantially equal to those of the device main body 12 and a width smaller than that of the device main body 12. In this embodiment, the main body 82 is mounted to the right side surface of the device main body 12. However, the main body 82 may be mounted to the left side surface of the device main body 12. A door 82*a* is provided at an upper half of the front surface of the main body 82.

The drawer body 84 includes a first support plate 84*a* and a second support plate 84*b*. The first support plate 84*a* is parallel to the drawing direction. The second support plate 84*b* is orthogonal to the first support plate 84*a*. In the drawer body 84, the support tables 30 each having the drug cassette 26 mounted thereto are arranged on the left surface of the first support plate 84*a* in the front-and-rear direction, are arranged in a plurality of stages in the up-and-down direction. The support tables 30 each having the drug cassette 26 mounted thereto are arranged in a plurality of stages in the up-and-down direction also on a front surface of the second support plate 84*b*. The drug cassette 26 has the same structure as that of the drug cassette 26 provided to the first dispensing portion 22. The drugs discharged from the drug cassette 26 pass through a passage defined on back surfaces of the first support plate 84*a* and the second support plate 84*b* to be introduced to the shutter mechanism section 86 (see FIG. 12). The shutter mechanism section 86 (storage portion) has a function to temporarily receive the drugs, which are dispensed for individual packaging in the auxiliary dispensing portion 80 forming the dispensing portion 20, and discharge the drugs to the packaging portion 60. The shutter mechanism section 86 has a configuration which is similar to that of the shutter mechanism section 50 described above, and hence detailed description thereof is omitted. Moreover, on a discharge side (lower side) of the shutter mechanism section 86, the fifth drug collection hopper 48 is connected. Therefore, the drugs having been discharged from the auxiliary dispensing portion 80 are delivered to the delivery portion 40 on the device main body 12 side via the fifth drug collection hopper 48 and thereafter are packaged.

As described above, the drug packaging device 10 according to this embodiment includes, as the dispensing portion 20, the second dispensing portion 24 in addition to the first dispensing portion 22 including the plurality of drug cassettes 26. Moreover, the second dispensing portion 24 includes not only the first receiving/dispensing portion 32 but also the second receiving/dispensing portion 34, thereby being capable of sequentially dispensing the drugs, which have been collectively supplied and prepared in the second receiving/dispensing portion 34, for packaging of the drugs. Therefore, with the drug packaging device 10, a user can package the drugs in the second receiving/dispensing portion 34 by only collectively preparing required drugs based on prescription information, thereby being capable of improving operation efficiency. Moreover, with the drug packaging device 10, a user is capable of suitably selecting use of the first receiving/dispensing portion 32 and the second receiving/dispensing portion 34. With this, a user is capable of performing a packaging operation in consideration of characteristics of the drugs and improving efficiency in the packaging operation.

Moreover, in the drug packaging device 10, the first receiving/dispensing portion 32 and the second receiving/dispensing portion 34 are arranged so as to be close to each other in the up-and-down direction. Therefore, a user is capable of efficiently performing the operation of feeding the drugs to the first receiving/dispensing portion 32 and the second receiving/dispensing portion 34 without movement. Moreover, through the arrangement of the first receiving/dispensing portion 32 and the second receiving/dispensing portion 34 so as to be close to each other in the up-and-down direction, a width of the drug packaging device 10 can be suppressed to minimum. Therefore, the drug packaging device 10 according to this embodiment is compact and well-ordered. With this, even in a limited space such as a space in a pharmacy, the drug packaging device 10 can be installed, thereby being capable of improving efficiency in drug preparation operation.

In this embodiment, description is made of the example configuration in which the first receiving/dispensing portion 32 and the second receiving/dispensing portion 34 are arranged in the up-and-down direction. However, the present invention is not limited to this. The first receiving/dispensing portion 32 and the second receiving/dispensing portion 34 may be arranged in the horizontal direction, such as a width direction. Moreover, in this embodiment, description is given of the example in which a plurality of second receiving/dispensing portion 34 are provided. However, the present invention is not limited to this. Only one second receiving/dispensing portion 34 may be provided. Further, in this embodiment, description is made of the example configuration in which a plurality of second receiving/dispensing portions 34 are arrayed in the substantially horizontal direction. However, the present invention is not limited to this. The plurality of second receiving/dispensing portions 34 may be arrayed in the up-and-down direction.

In the drug packaging device 10 of the present invention, the operation of supplying the drugs by drawing out the second receiving/dispensing portion 34 from the device main 12 body can be performed. Therefore, with the drug packaging device 10, a user can easily perform the operation of supplying the drugs to the second receiving/dispensing portion 34. Moreover, with the drug packaging device 10, the second receiving/dispensing portion 34 can be brought into a state of being pushed into the device main body 12. Therefore, with the drug packaging device 12, occurrence of the state in which the second receiving/dispensing portion 34 projects from the device main body 12 can be suppressed to minimum. Moreover, the drugs can be dispensed by pushing the second receiving/dispensing portion 34 into the device main body 12. With this, occurrence of the problems which may be assumed due to the exposure of the second receiving/dispensing portion to the outside of the device main body 12, such as erroneous touching by an operator on an operation portion for dispensing the drugs from the second receiving/dispensing portion 34 or entry of dusts into the second receiving/dispensing portion 34 can be suppressed to minimum.

In this embodiment, description is made of the example in which the second receiving/dispensing portions 34 are drawably inserted into the device main body 12. However, the present invention is not limited to this. For example, some or all of the second receiving/dispensing portions 34 may be used in an exposed state without being accommodated in the device main body 12.

As in the case of the second receiving/dispensing portion 34 described above, when the drugs prepared in the drug accommodation portion 34*e* are moved to the second rotation member 34*c* through rotation of the first rotation member 34*b*, and are transferred toward a downstream side of the second rotation member 34*c* in the rotation direction so that the drugs can be discharged from the drug dispensing portion 34*d*, with preparation of the drugs in the drug accommodation portion 34*e* in advance, through rotation control of the first rotation member 34*b* and the second rotation member 34*c*, the drugs can be sequentially, appropriately, and smoothly discharged one after another in accordance with the prescription information. With this, for example, the frequency of use of the first receiving/dispensing portion 32 can be suppressed to minimum, and a burden on a user required for supply of drugs by manual distribution operation to respective accommodation parts (drug receiving boxes) of the first receiving/dispensing portion 32 can be alleviated, and occurrence of human errors caused by manual operations can be suppressed to minimum.

In this embodiment, description is made of the second receiving/dispensing portion 34 having the configuration described above as an example. However, the second receiving/dispensing portion 34 may have another configurations as long as similar actions and effects can be attained.

The drug packaging device 10 described above includes the delivery portion 40, and is capable of temporarily receiving the drugs, which have been dispensed from the dispensing portion 20 and move toward the packaging portion 60, and discharging the drugs to the packaging portion 60. With this, problems such as jumping of the drugs, which have been dispensed from the dispensing portion 20, to unexpected positions can be solved.

In this embodiment, description is made of the example in which the delivery portion 40 is provided to the drug packaging device 10. However, the present invention is not limited to this. Any component corresponding to the delivery portion 40 may be omitted. Moreover, description is made of the example in which, in the drug packaging device 10, the delivery portion 40 described above is capable of collecting the drugs, which have been dispensed from respective parts of the dispensing portion 20, to the delivery portion 40 and dispensing the drugs for packaging. However, for example, any component corresponding to the delivery portion 40 configured to deliver the drugs, which have been dispensed from respective parts of the dispensing portion 20, for packaging may be individually provided.

In the drug packaging device 10 according to this embodiment, the surfaces with which the drugs having fallen from the dispensing portion 20 at the shutter mechanism section 50 or the shutter mechanism section 86 provided to the delivery portion 40 have a multilayer structure in which plate members are arrayed with a predetermined clearance defined therebetween. With this, the shock given by the collision of the drugs is absorbed, thereby being capable of suppressing the jumping of the drugs to the minimum. In this embodiment, description is made of the example in which the shutter mechanism section 50 and the shutter mechanism section 86 have the multilayer structure. However, the present invention is not limited to this. One or both of the shutter mechanism section 50 and the shutter mechanism section 86 may have different configurations.

Moreover, in the drug packaging device 10, the drugs having fallen can be temporarily received by the first moving mechanism 52 and the second moving mechanism 54 forming the second opening/closing mechanism section, and thereafter discharged downward. Moreover, under a condition in which the first moving mechanism 52 and the second moving mechanism 54 are in the closed state, some or all of the surfaces with which the drugs having fallen from above collides are set to be smaller in thickness as compared to other parts. Specifically, when the drugs fall from above under the condition in which the first moving mechanism 52 and the second moving mechanism 54 are in the closed state, the drugs may collide with regions, which are top surfaces of the slide containers 52*b* and 54*b* and surrounded by the frame 52*g* or the frames 54*g* and 54*h*. In order to alleviate the shock given by the falling of the drugs and suppress the jumping of the drugs, portions of the slide containers 52*b* and 54*b* which are more liable to suffer collision of the drugs are set to be smaller in thickness. Further in detail, for example, when the drugs are dispensed from the auxiliary dispensing portion 80, as illustrated in FIG. 20A, a receiving portion formed at a portion surrounded by the frame 54*h* of the second moving mechanism 54 is opened. In this state, the receiving portion surrounded by the frame 54*g* is closed. Therefore, when the drugs are dispensed from the second receiving/dispensing portion 34, the drugs collide with the top surface of the slide container 54*b*. In order to prevent jumping of the drugs due to the shock given by falling on this occasion, the top surface of the slide container 54*b* is set to be smaller in thickness. Moreover, in order to prevent the drugs, which have been received by the slide container 54*b* through the frame 54*h* of the second moving mechanism 54, from jumping and flying out, the bottom surface of the slide container 54*b* is also set to be smaller in thickness, thereby absorbing the shock of falling. The first moving mechanism 52 also has a configuration similar to that of the second moving mechanism 54. With this, jumping of the drugs due to the collision at the first moving mechanism 52 and the second moving mechanism 54 can be suppressed to the minimum.

In this embodiment, as a countermeasure for the jumping of the drugs, the top surfaces of the slide containers 52*b* and 54*b* in the first moving mechanism 52 and the second moving mechanism 54 are partially formed so as to be smaller in thickness. However, the present invention is not limited to this. Specifically, instead of forming the small-thickness portions in the top surfaces of the slide containers 52*b* and 54*b*, other countermeasure for the jumping may be made, or no countermeasure for the jumping may be made.

Moreover, as described above, in the drug packaging device 10, the first moving mechanism 52 and the second moving mechanism 54 may be provided to the delivery portion 40, to thereby move the drugs in the direction crossing the falling direction (substantially horizontal direction). Therefore, the drug packaging device 10 has a high degree of freedom in setting the passage for the drugs, and the device configuration may be set compact.

In this embodiment, description is made of the example in which the first moving mechanism 52 and the second moving mechanism 54 are provided. However, one or both of the first moving mechanism 52 and the second moving mechanism 54 may be omitted. Moreover, the first moving mechanism 52 and the second moving mechanism 54 are merely examples of the configuration for moving the drugs in the substantially horizontal direction, and other configurations may be employed to move the drugs in the substantially horizontal direction.

As described above, the collective hopper 56 configured to collect the drugs, which have been dispensed from the dispensing portion 20, and send the drugs to the packaging portion 60 side is curved so as to allow the hopper main body 42*a* and the tubular portion 42*b* to be gently connected to each other at the neck portion 42*c*. Moreover, a part of the collective hopper 56 below the neck portion 42*c* is made of a material softer than a part above the neck portion 42*c*. With this, jumping of the drugs, which have been introduced to the collective hopper 56, can be suppressed to minimum, thereby being capable of smoothly introducing the drugs to the packaging hopper.

In this embodiment, description is made of the example of preventing jumping of the drugs with the configuration of the collective hopper 56 described above. The shape of the neck portion 42*c* connecting the hopper main body 42*a* and the tubular portion 42*b* to each other may be formed into another shape, or the part below the neck portion 42*c* may have a hardness which is equivalent to that of the part of the part above the neck portion. Moreover, in place of the collective hopper 56 or in addition to the collective hopper 56, a similar configuration may be applied to another hopper.

Moreover, the cassette arrangement portion 14 may include a weight measurement device such as a balance capable of measuring the weight. With such configuration, through arrangement of the drug cassettes 26 and the cassette 34*x* of the second receiving/dispensing portion 34 in the cassette arrangement portion 14, quantities of the drugs accommodated in those cassettes may be determined through calculation processing. For example, the quantities of the drugs can be determined by subtracting weights of the drug cassettes 26 and the cassette 34*x* from the weight derived in the cassette arrangement portion 14 and dividing the determined weight by a weight per drug accommodated in those cassettes. In addition to the weight measurement device described above, a recording medium such as an RF-ID may be provided to the drug cassettes 26 and the cassette 34*x*, and a communication device capable of at least writing information on the recording medium may be provided to the cassette arrangement portion 14. With this, the quantities of the drugs derived by the calculation processing described above may be written on the recording medium, thereby being capable of effectively using the information for stock management. Moreover, a display device may be provided in addition to the weight measurement device, to thereby display the quantities of the drugs derived by the weight measurement device on the display device.

Figure 23:
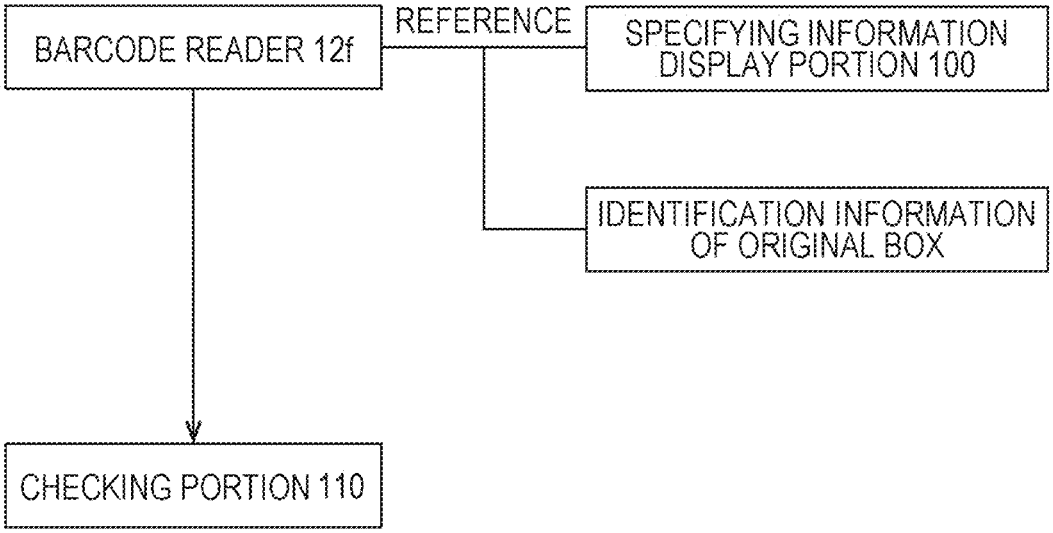
FIG. 23 is an explanatory block diagram for illustrating a modification example in which a specifying information display portion and a checking portion are provided.

The drug packaging device 10 described above according to the present invention includes a barcode reader 12*f* as an identification information reading portion capable of reading identification information such as a barcode attached to a box of the drugs. The drug packaging device 10 may further include, for example, as illustrated in FIG. 23, a specifying information display portion 100 configured to display specifying information, such as a barcode, for specifying the drugs accommodated in the second receiving/dispensing portion 34. Specifically, the specifying information display portion 100 may be provided by displaying identification information such as a barcode on a display device formed of a liquid crystal panel or electronic paper for each of the cassettes 34*x* forming the second receiving/dispensing portion 34. With such configuration, when the drugs are to be filled into the cassettes 34*x* of the second receiving/dispensing portion 34, the drugs to be filled may be specified by reading the identification information from the box, and the drugs accommodated in the cassette 34*x* may be specified by reading the specifying information from the specifying information display portion 100 corresponding to the cassette 34*x* into which the drugs are to be filled, thereby being capable of suppressing erroneous filling of the drugs with respect to the cassette 34*x*. Further, for example, as illustrated in FIG. 23, when a checking portion 110 capable of checking whether or not the drugs specified through reading of the identification information form the box and the drugs specified through reading of the specifying information match each other is provided to a control device for the drug packaging device, the checking operation can be performed by machines, thereby being capable of further suppressing the erroneous filling of the drugs with respect to the cassette 34*x*.

The second receiving/dispensing portion 34 described above may be used in a fixed manner for preparing and dispensing a specified drug determined by a user for some or all of the plurality of cassettes 34*x* provided thereto. That is, the second receiving/dispensing portion 34 may be mounted to the device main body 12 so as to be used not only in a method of, for example, charging drugs different for prescriptions and charging the drugs but also in a method of preparing a specified drug similarly to the drug cassettes 26 and suitably dispensing the drug. Moreover, the second receiving/dispensing portion 34 may be used in a dynamic manner of suitably changing the drugs to be prepared and dispensed for some or all of the plurality of cassettes 34*x*.

Moreover, in the case of using some or all of the cassettes 34*x* in a fixed manner for a specified drug as described above, it is desired that a verification operation for verifying whether or not a charging operation for the drugs to the cassette 34*x* to be used in a fixed manner has been correctly performed can be performed. On this occasion, a medium such as an RF-ID is provided to the drug cassette 26 as described above, and the cassette is recognized through such a medium. Therefore, for example, an RF-ID number, an operator identification code such as a barcode for identifying a pharmacist being an operator, and a drug identification code (for example, so-called "JAN code" or "GS1 code") indicated on a box for the drug are separately identified to perform the verification operation at the time of charging drugs. The RF-ID may be similarly mounted to the cassette 34*x* to be used in a fixed manner, but it is to be expected that the RF-ID be always used in a fixed manner as in the case of the drug cassettes 26. In such case, it is desired that a unique barcode for the cassette 34*x* to be used in a fixed manner be displayed on a liquid crystal screen of electronic paper mounted to the cassette 34*x* to be used in a fixed manner, and the number of digits (length) of the code number be different. With such configuration, it can be determined that the code having been read belongs to which one of the identification code of the drug cassette 26, the operator identification code, or the drug identification code based on the number of digits. In the case of providing the cassette 34*x* to be used in a fixed manner, identification of whether or not the code relates to the cassette 34*x* by similarly differentiating the number of digits (length) of the identification code for identifying the cassette 34*x* from the number of digits of other code. On the electronic paper of the cassette 34*x*, there may be displayed, in addition to the unique barcode described above, the name of the drug, the name of a patient, the number of pieces of the drug, and a sign indicating the operation condition of the cassette 34*x*.

Figure 24:
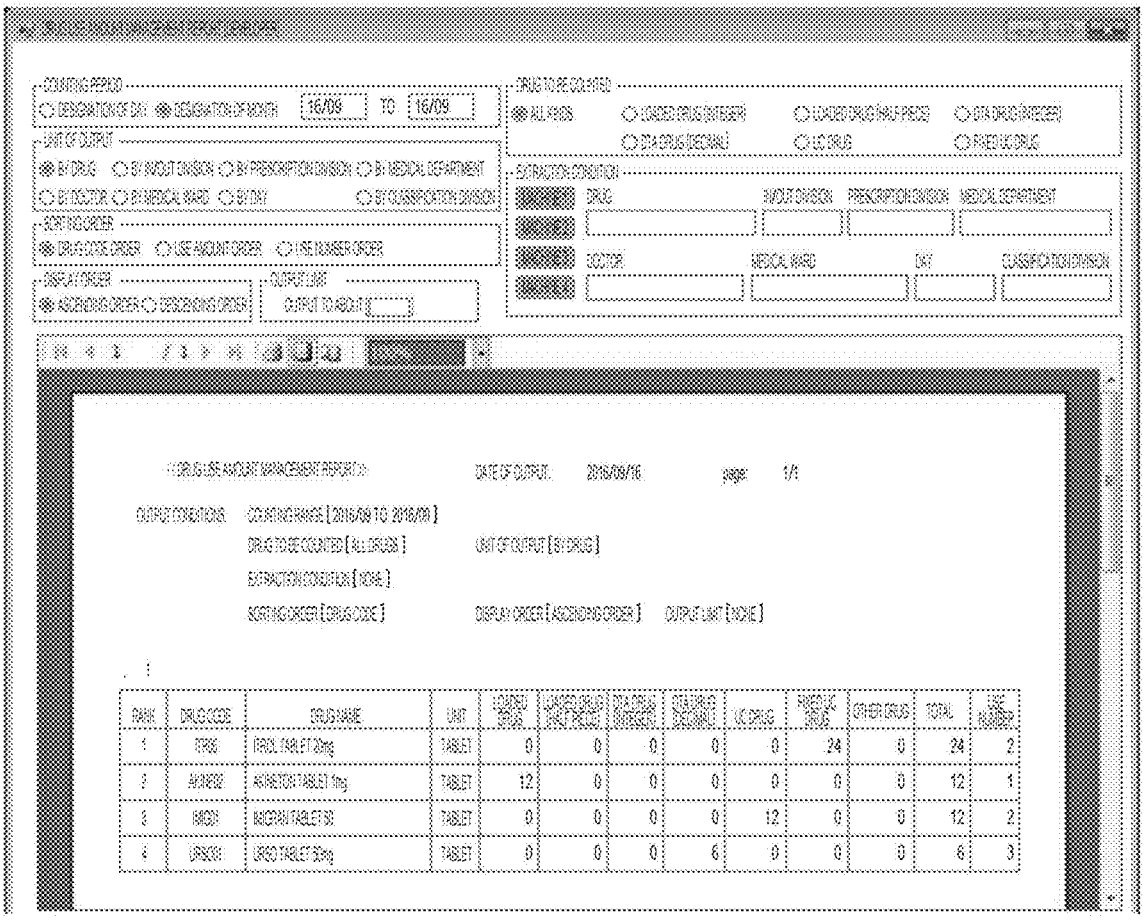
FIG. 24 is an image view for illustrating a report being one example of a quantity management method for a drug dispensed from relevant portions.

Moreover, the drug packaging device 10 may be configured to manage a condition of dispensing of the drugs for each kind by, for example, outputting the quantity of the drugs dispensed from respective portions such as the first receiving/dispensing portion 32 and the second receiving/dispensing portion 34 forming the first dispensing portion 22 and second dispensing portion 24, as a screen display or a printed matter in a form such as a report as illustrated, for example, in FIG. 24. Moreover, the management of the dispensing condition may be performed not only in the viewpoints of the dispensing passage or the quantity of the drug but also in the viewpoint of the dispensing mode. Specifically, for example, when the drug can be dispensed in a shape of one-half (half piece) from the first receiving/dispensing portion 32, a quantity of the drug dispensed one after another from the first receiving/dispensing portion 32 and a quantity of the drug dispensed in the state of being a half piece may be separately managed. Moreover, as described above, in the case of using some of the plurality of cassettes 34*x* provided to the second receiving/dispensing portion 34 in a fixed manner for a specified drug (also referred to as "fixed cassette 34*x*") and using a remainder of the cassettes 34*x* are to be used in a dynamic mode of use capable of changing a kind of the drug in accordance with a user's need (non-fixed cassette 34*x*), counting can be performed as to the drugs having been dispensed from which of the fixed cassette 34*x* or the non-fixed cassette 34*x*.

Moreover, when some or all of the plurality of cassettes 34*x* provided to the second receiving/dispensing portion 34 are to be used in a fixed manner (fixed cassette 34*x*), there is a fear in that a drug of the same kind as a drug having already been allocated to any one of the drug cassettes 26 provided to the first dispensing portion 22 is set in an overlapping manner as the drugs to be prepared for the fixed cassette 34*x*. In contrast, there is a fear in that a drug of the same kind as the drug having already been allocated as the drug to be prepared for the fixed cassette 34*x* is set in an overlapping manner as the drugs to be prepared for the drug cassette 26. Therefore, in order to avoid such overlapping setting against the user's intention, when there is a fear of overlapping setting, warnings may be displayed on the screen, or notification may be given on the fear of the overlapping setting through alarming sound and voice. Moreover, when the drugs are registered in, for example, a database as being allocated to any one of the drug cassette 26 and the fixed cassette 34*x* provided to the first dispensing portion 22, the registered information may be changed to change the registration to the other one of the drug cassette 26 or the fixed cassette 34*x*.

Figure 25:
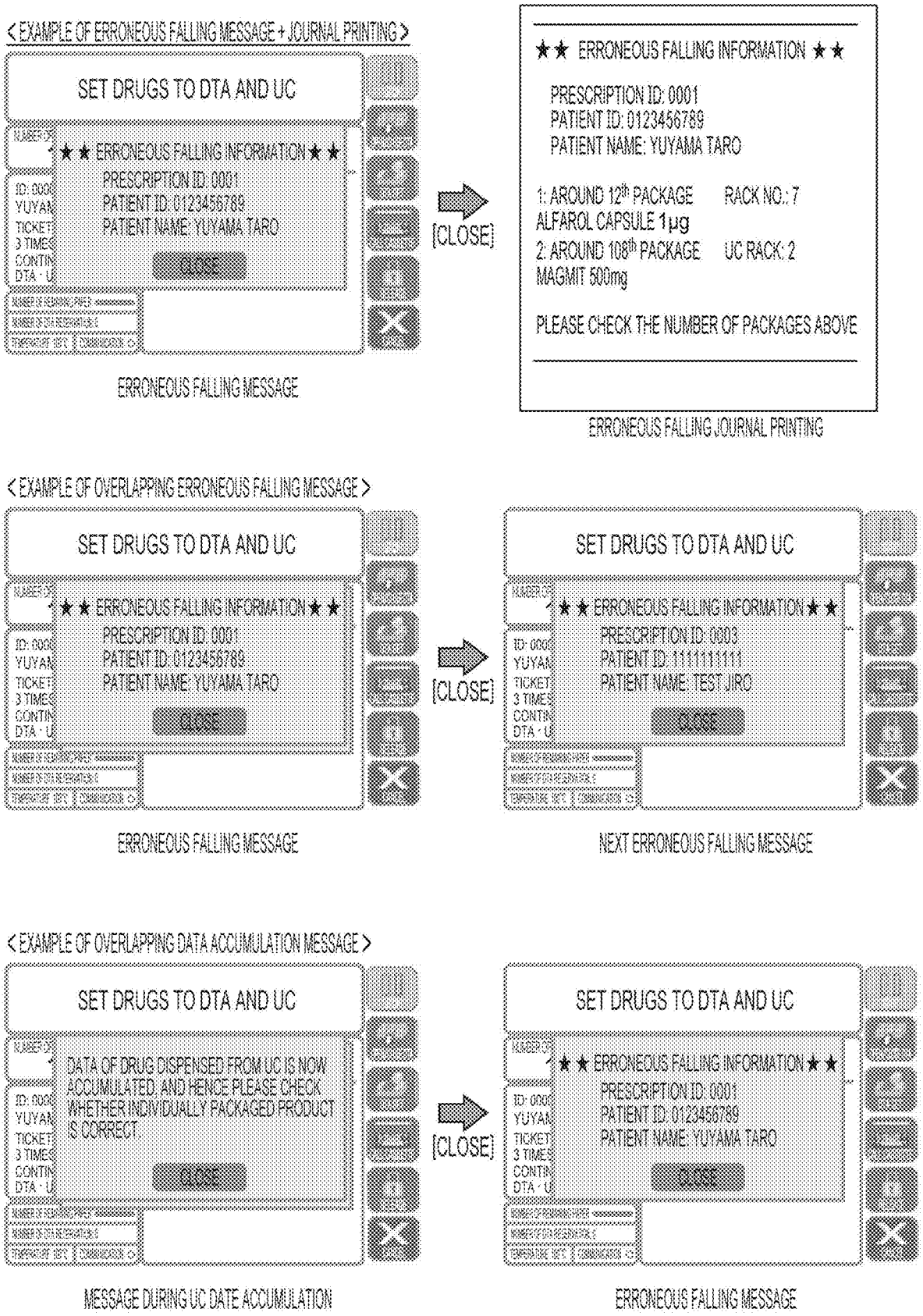
FIG. 25 is an explanatory view for illustrating one example of a notification method for notifying, through a reconfirmation information notifying function, that erroneous falling of a drug has occurred during individual packaging.

It is desired that the drug packaging device 10 described above have a function to, when the drugs erroneously fall into the first dispensing portion 22 or the second dispensing portion 24 forming the dispensing portion 20, allow an operator to clearly and reliably recognize the occurrence of the erroneous falling and check whether or not erroneous individual packaging occurs due to the erroneous falling (hereinafter also referred to as "reconfirmation information notifying function"). Specifically, for example, as illustrated in FIG. 25, when the erroneous falling of the drugs occurs during the individual packaging, the drug packaging device 10 may notify the erroneous falling at the time of completion of the prescription through a method such as displaying the occurrence of the erroneous falling on the operation panel 12*c*. Moreover, it may be so configured that, after an operation of turning off the display indicating the occurrence of the erroneous falling (pressing "close" button in the illustrated example), a journal showing details such as the name and the number of packages of the drugs having erroneously fallen may be output by a journal printer 12*d*. In the drug packaging device 10, it is not preferred that the individual packaging operation be stopped at the time of occurrence of the erroneous falling. Therefore, it is preferred that the individual packaging continue without stopping even when the notification of the occurrence of the erroneous falling is given.

«First Modification Example of Hopper»

The drug packaging device 10 described above includes hoppers at respective locations. Specifically, various hoppers such as the first drug collection hopper 42, the second drug collection hopper 44, the third drug collection hopper 46*a*, the fourth drug collection hopper 46*b*, the fifth drug collection hopper 48, the collective hopper 56, and the packaging hopper 58 are provided to the drug packaging device 10. When the drug packaging device 10 is capable of cutting the drug into small pieces (for example, halves) in the drug cassette 26 and dispensing the drugs, powder which may be formed along with the cutting of the drug (hereinafter also referred to as "cutting powder") may hinder packaging in the packaging portion 60. Therefore, it is preferred that some or all of the hoppers to be used for the drug packaging device 10 be configured to, as a countermeasure, suppress the influence of the cutting powder.

Figure 26A:
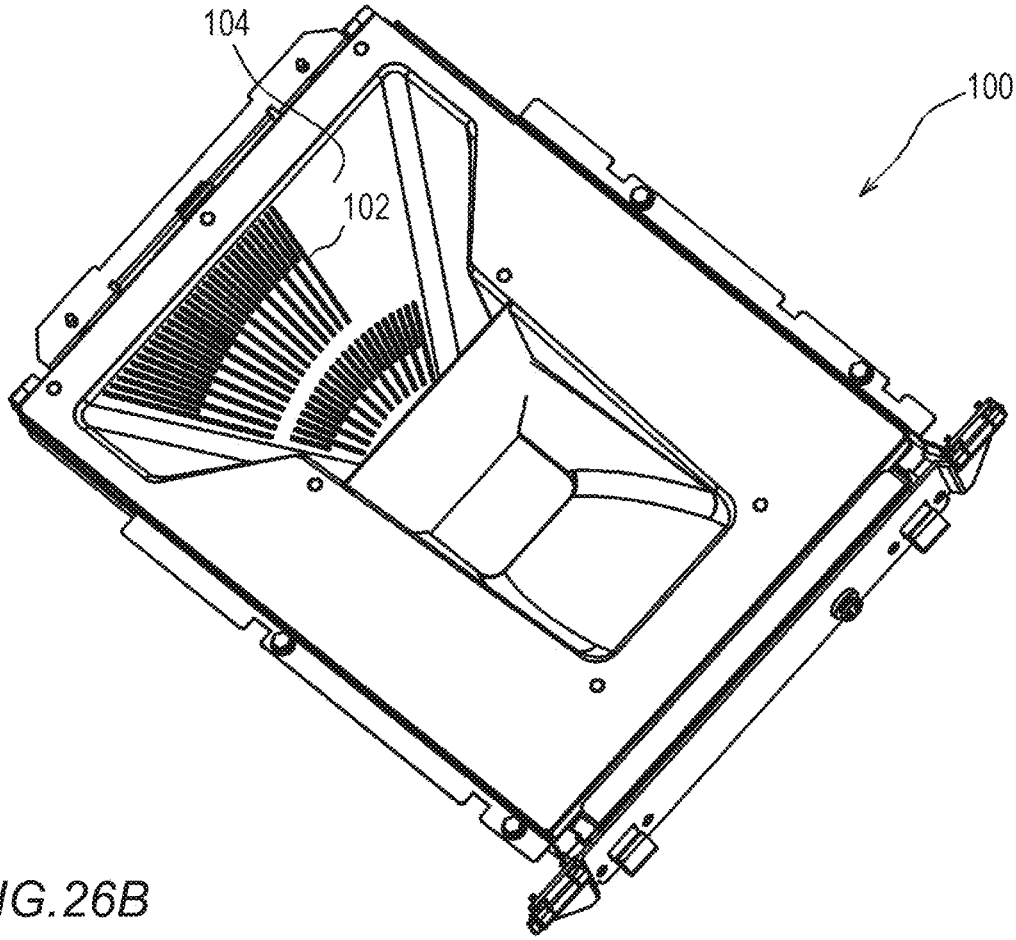
FIG. 26A is a perspective view for illustrating a first modification example of the hopper.
Figure 26B:
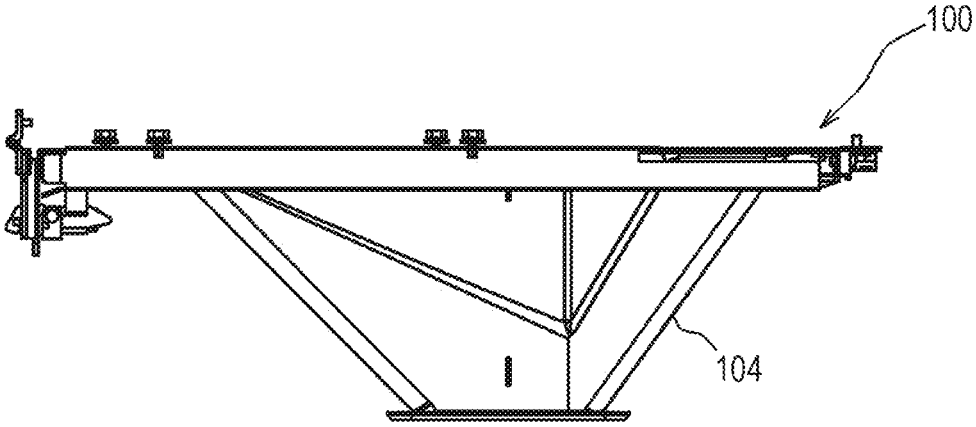
FIG. 26B is a side view of FIG. 26A.

Specifically, as in the case of the hopper 100 illustrated in FIGS. 26A and 26B, there may be used a hopper having such holes 102 that allow passage of cutting powder of the drug while not allowing passage of the drug. The holes 102 may be formed into a slit shape as illustrated in FIG. 26A or openings each having an opening diameter smaller than a drug which is expected to be handled in the drug packaging device 10. Moreover, when the hopper 100 is to be used, it is preferred that a collection member configured to collect the cutting powder by receiving the cutting powder passing through the holes 102 and falling. Specifically, as the collection member for powder, it is desired that, for example, a tray be provided.

As in the case of the hopper 100 described above, with the configuration in which the holes 102 for collecting the cutting powder are formed in a peripheral surface 104, the adverse influence on the packaging in the packaging portion 60 can be suppressed. Moreover, with the collection member configured to collect the cutting powder having been removed from the hopper 100 through the holes 102, occurrence of a secondary adverse effect due to flying of the cutting powder having been removed from the hopper 100 onto an unexpected location in the drug packaging device 10 can be suppressed.

«Second Modification Example of Hopper»

As described above, the drug packaging device 10 includes various hoppers provided at respective locations. In those hoppers, the drugs may adhere due to the influence of the static electricity, which may result in falling of the drugs. Therefore, it is desired that the hoppers to be used for the drug packaging device 10 employ a countermeasure for suppressing the adhesion of the drugs to the hopper due to the influence of the static electricity.

Figure 27:
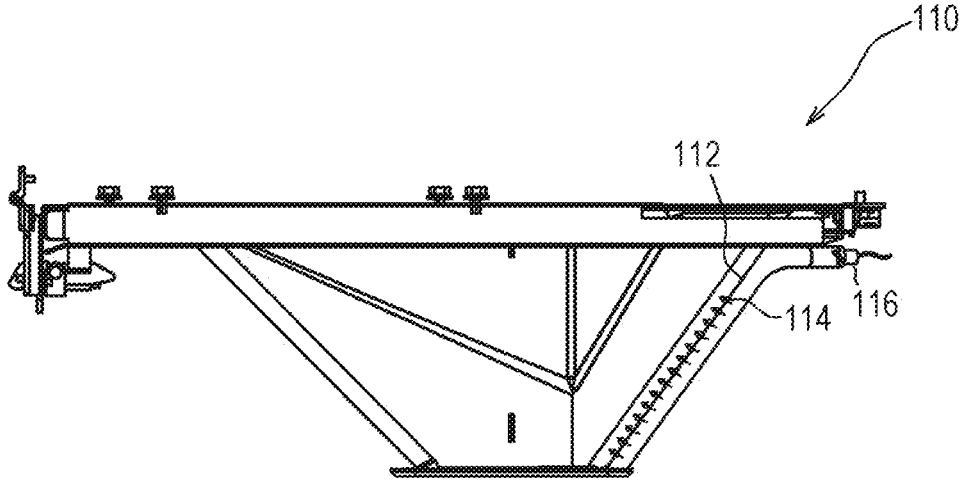
FIG. 27 is an explanatory view for illustrating the first modification example of the hopper.

Specifically, as in the case of the hopper 110 illustrated in FIG. 27, in place of some or all of the various hoppers described above, there may be used a hopper having air-through holes 114 formed in an inclined surface 112 for allowing the drugs having fallen to slide thereon and including a gas supply device 116 configured to supply gas such as air through the air-through holes 114. The air-through holes 114 are each an opening which is smaller than a size of the drug, and a plurality of air-through holes 114 are formed in at least some regions of the inclined surface 112. When the gas supply device 116 is operated, as indicated by the arrows in FIG. 27, air flows out through the air-through holes 114 so that a gentle air stream is generated toward the inner side of the holler 110 on the front surface of the inclined surface 112. Due to the influence of the air stream, the drugs having fallen toward the inclined surface 112 are brought into, for example, a state of slightly floating from the inclined surface 112, thereby smoothly falling without adhering to the inclined surface 112. Therefore, through the use of the hopper 110, adhesion of the drugs onto the hopper 110 due to the influence of the static electricity can be suppressed.

«Modification Example of Providing Indication Forming Device»

In the drug packaging device 10 described above, it is also possible to add indication to the individual packaging bag having individually packaged the drugs so as to enable easy and appropriate distinguishment in accordance with needs of a user. For example, the drug packaging device 10 may be configured to add indication for distinguishing a dosage period for a patient or indication for allowing easy distinguishment of drugs for a pharmacist.

Figure 28:
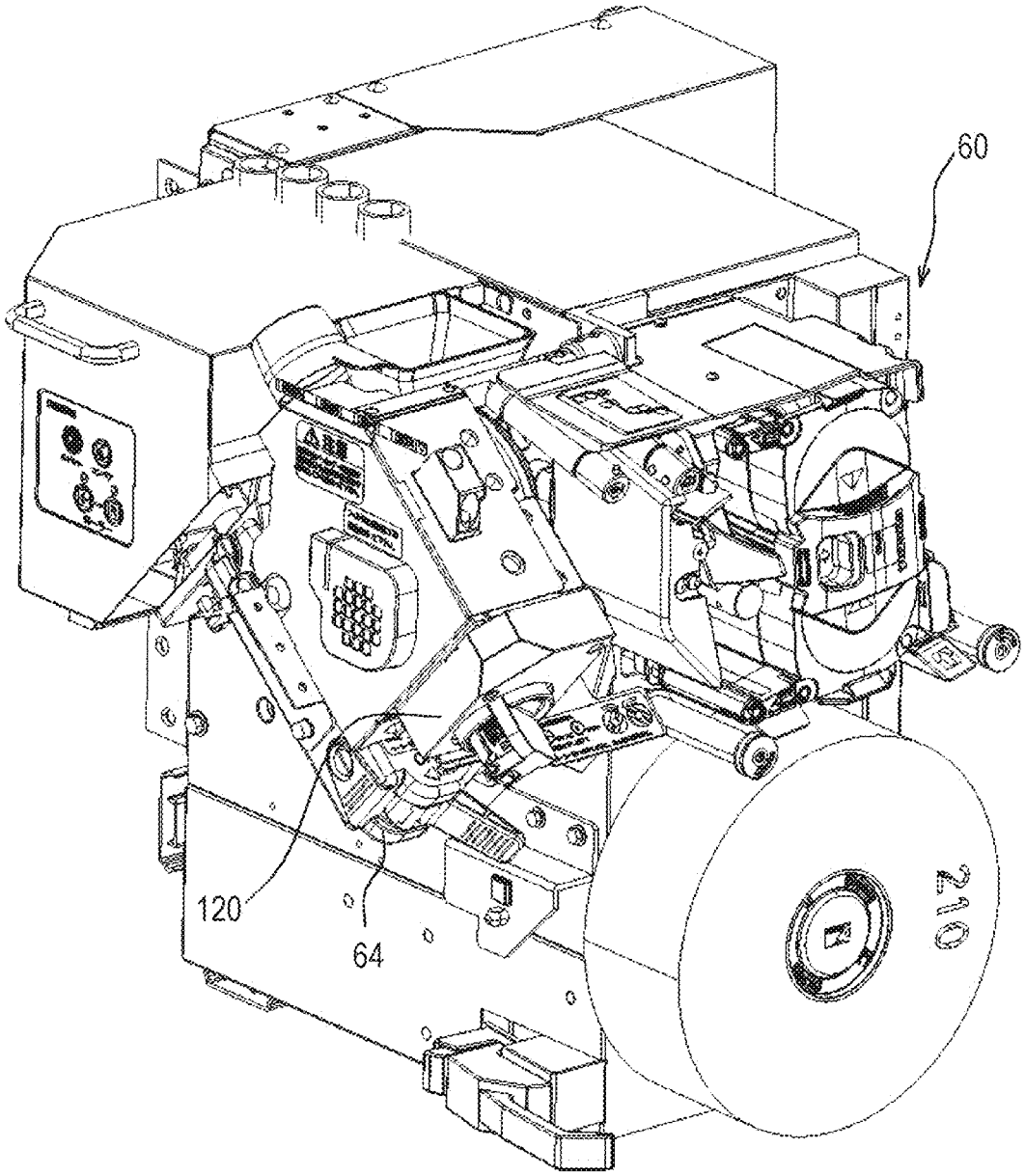
FIG. 28 is a perspective view for illustrating an installation state of the indication forming device.
Figure 29A:
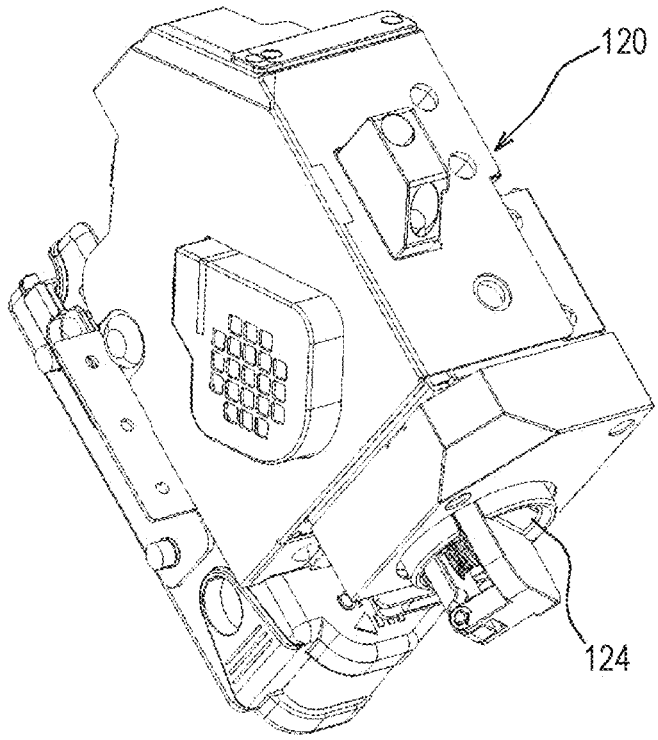
FIG. 29A is a perspective view for illustrating the indication forming device.
Figure 29B:
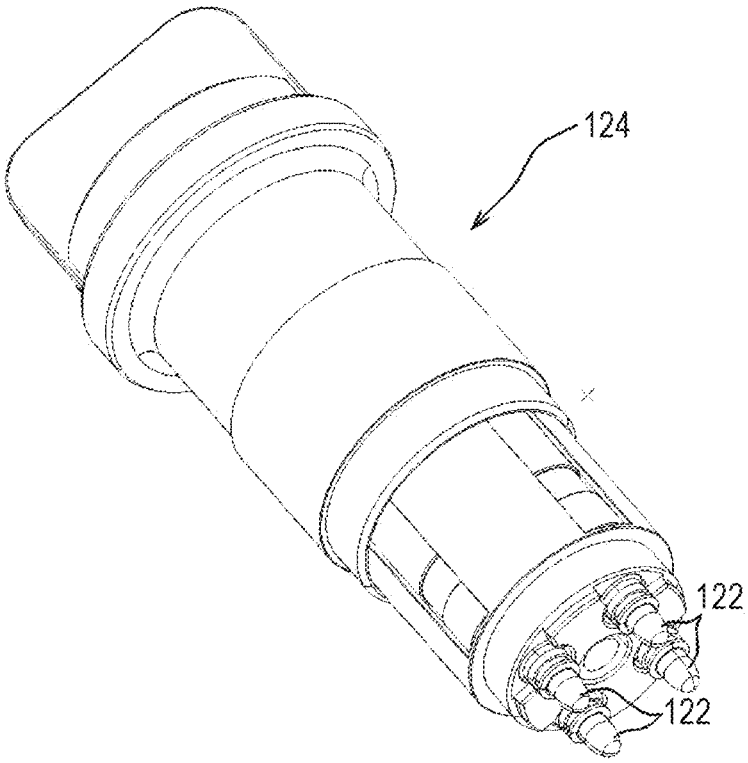
FIG. 29B is a perspective view for illustrating a pen holder and pens of the indication forming device.

Specifically, the drug packaging device 10 may include, as the device for adding the indication described above, the indication forming device 120 as illustrated in FIG. 28 and FIGS. 29A and 29B. The indication forming device 120 may be set to any location. However, for example, as illustrated in FIG. 28, the indication forming device 120 is provided in the vicinity of the heater roller 64 in the packaging portion 60.

As illustrated in FIGS. 29A and 29B, in the indication forming device 120, a plurality of (four in this embodiment) pens 122 having different colors may be set in a holder 124. The indication forming device 120 is capable of drawing lines on individual packaging paper by pressing selected one of the pens 122 set in the holder 124 against the individual packaging paper which passes through the packaging portion 60. The holder 124 may have any configuration. However, for example, the holder 124 may have the configuration as illustrated in FIG. 29B. The holder 124 illustrated in FIG. 29B has a revolver-like shape, and the plurality of (four in this embodiment) pens 122 can be mounted in an array in a circumferential direction. The indication forming device 120 includes a mechanism configured to turn the holder 124. In order to add marks, the indication forming device 120 turns the pen 122 to a predetermined position, thereby being capable of adding marks of desired colors to the individual packaging paper. With such indication forming device 120, the drug packaging device 10 may have a function to add indication which enables easy and appropriate distinguishment in accordance with the need of a user.

In the case of providing the indication forming device 120 as described above, there is a fear in that the indication cannot be well added at the time of adding the indication due to drying of the pens 122 in a standby state. Therefore, in the case of providing the indication forming device 120, it is desired to take such a countermeasure that defects such as blur of the lines due to drying of the pen tips of the pens 122 can be suppressed. Specifically, the pen 122 expected to be used for the next prescription may be configured to perform an operation of preliminarily ejecting ink (preliminary ejection) by performing test-writing on a log bass for loss which may occur in the package for previous prescription or an inspection package to be formed before packaging of the drug for next prescription.

Moreover, in the case of performing the test-writing on the loss bag or the inspection package before the timing of adding the indication with the pens 122 as described above, it is desired that the pen 122 to be used for test-writing be selected in consideration of use condition, use estimation, and characteristics of each pen 122 of the plurality of pens 122. Specifically, when the next prescription is determined, and there is a pen 122 which is not used for the current prescription, it is desired that the test-writing of the pen 122 be preferentially performed. More specifically, for example, when the first prescription involves adding indication of red on the individual packaging bag for the morning, blue on the individual packaging bag for the noon, and green for the individual packaging bag for the afternoon, and the second prescription involves adding indication of black on the individual packaging bag for the timing before sleeping, the test-writing such as drawing lines with use of the black pen 122 to be used for the second prescription on the loss bag is to be continuously formed after the individual packaging for the first prescription. When the next prescription is not determined, the test-writing is performed with use of the pen 122 which is not used in the current prescription. Through the test-writing of the pen 122 based on a predetermined rule, defects caused by drying of the pen tip of the pen 122 can be suppressed.

Moreover, among the plurality of pens 122, when there is a tendency that the pen tip of the pen 122 of the specified color is more liable to dry, the ink may be preliminarily ejected by preferentially performing the test-writing for the pen 122 having a pen tip more liable to dry. With this, the preliminary ejection can be performed at an optimum timing in consideration of the characteristics of the pen 122 provided to the indication forming device 120.

«Registration of Information with Regard to Drug to be Prepared in First Receiving/Dispensing Portion 32 and Second Receiving/Dispensing Portion 34»

With regard to the first receiving/dispensing portion 32 and the second receiving/dispensing portion 34 described above, as in the case of the drug cassette 26 provided to the first dispensing portion 22, a predetermined drug is not always prepared regardless of the prescription, but the drug having been selected in accordance with the prescription is charged and filled. Therefore, there is a problem in that it is difficult to secure traceability through association of the prescribed drug and the patient information. Therefore, in the drug packaging device 10, it is desired that, with regard to the drugs to be prepared in the first receiving/dispensing portion 32 or the second receiving/dispensing portion 34, information such as a lot number (serial number) or a use limit can be registered. Specifically, for example, it is desired that a user interface as illustrated in FIGS. 30A to 30C and FIG. 31 be displayed to allow input of information with regard to the drugs through the interfaces, thereby enabling registration of the information in a database.

Figure 30A:
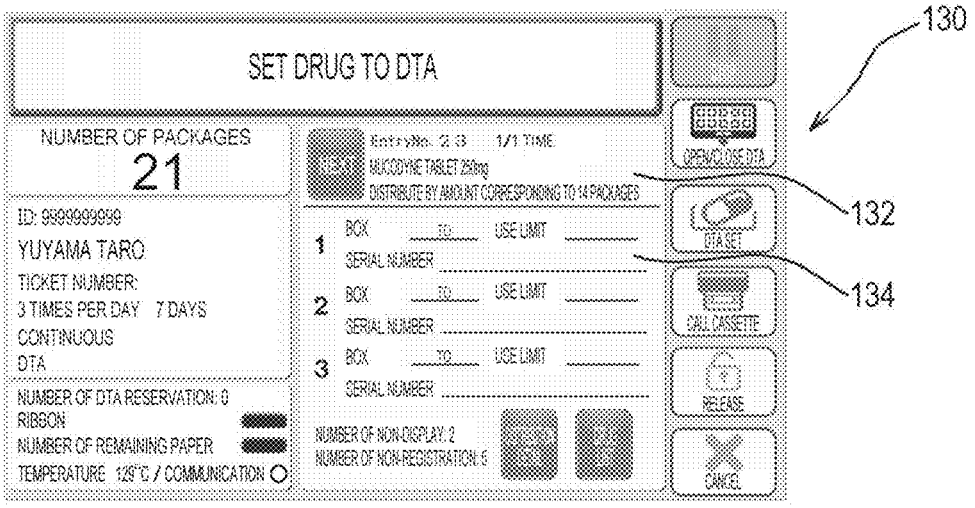
FIGS. 30A to 30C are image views for illustrating one example of an interface to be displayed on the drug packaging device.
Figure 30B:
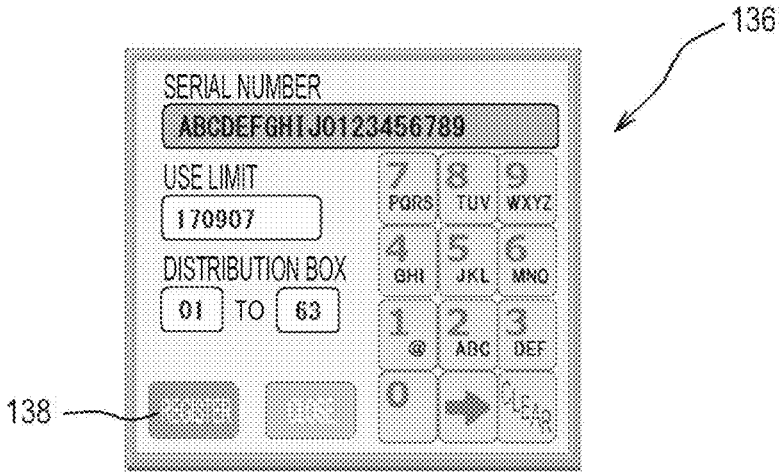
Figure 30C:
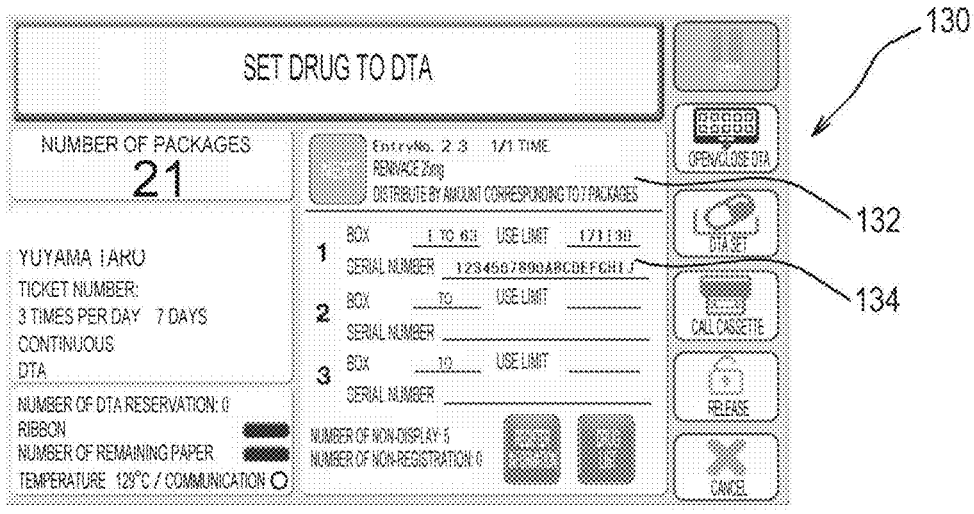

More in detail, FIGS. 30A to 30C are illustrations of an interface 130, which relates to a drug to be prepared in the first receiving/dispensing portion 32 and is provided for registration of information such as the lot number (serial number) or the use limit. In the example illustrated in FIGS. 30A to 30C, the basic information display portion 132 displays information including general information which does not change regardless of the manufacture lot of the drugs such as drug name with regard to the drug to be prepared in the first receiving/dispensing portion 32 and the number of drugs (number of packages) to be prepared in the first receiving/dispensing portion 32.

Moreover, a unique information display portion 134 is provided to the interface 130. The unique information display portion 134 is capable of displaying information including information unique to the drug (unique information) based on the manufacturing lot, such as the lot number (serial number) and the use limit, and a box number in which the drug is to be prepared. When the information such as the unique information has not yet been registered, as illustrated in FIG. 30A, the unique information display portion 134 performs display in a state in which the unique information is blank. When the unique information display portion 134 is selected (for example, touching in the case of a touch panel) in the state of FIG. 30A, an input screen 136 such as a pop-up screen as illustrated in FIG. 30B is displayed so that the information including the unique information such as the lot number (serial number) or the use limit and information of a number of the box to which the drug is to be prepared can be input. Moreover, when a barcode of the drug is read while the input screen 136 is displayed, the information such as the lot number (serial number) and the use limit registered in the barcode can be reflected after verification of the drug. Moreover, when the information such as the lot number (serial number) and the use limit is not registered in the barcode, or when the drug has a different barcode, the information is not registered. After the input of the information through the input screen 136 of FIG. 30B, when a registration button 138 is selected, an input value is registered to a database. Along with this, the input information is reflected on the unique information display portion 134 as illustrated in FIG. 30C.

Figure 31:
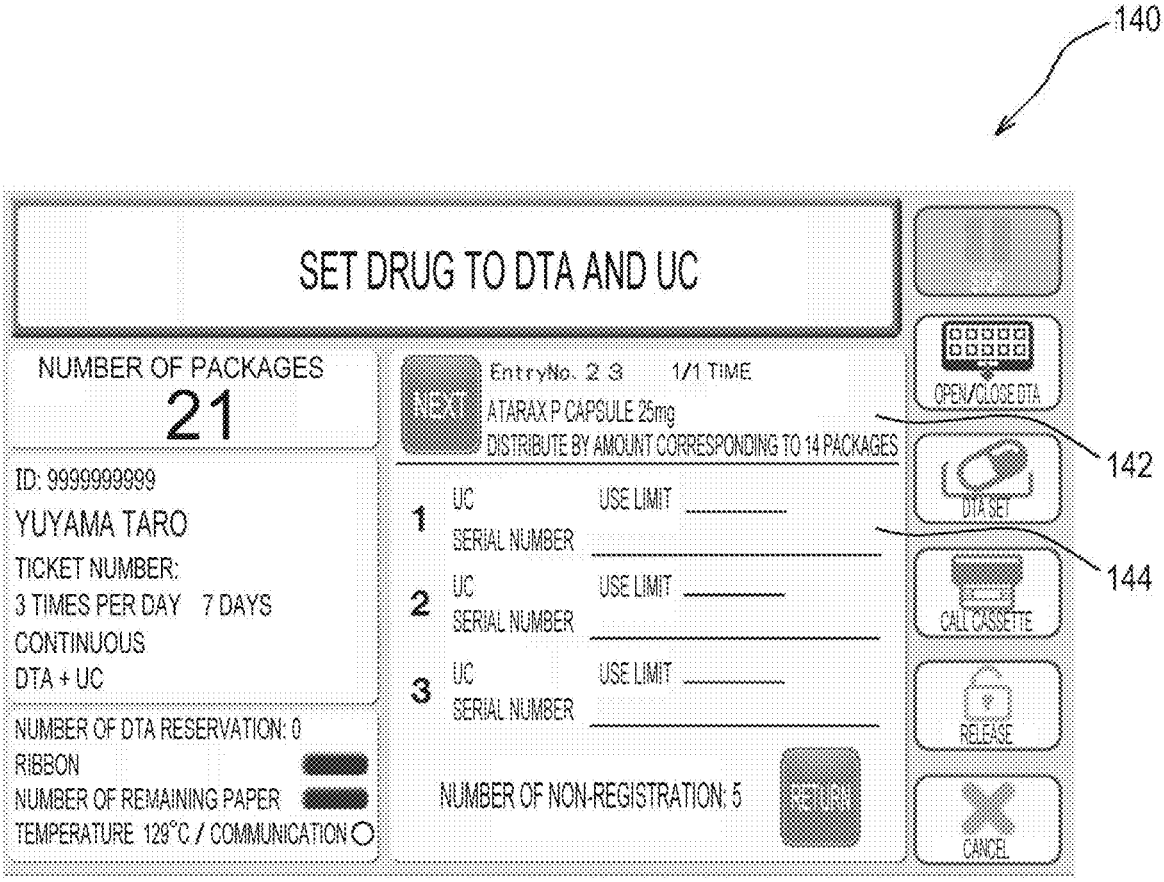
FIG. 31 is an image view for illustrating one example of the interface to be displayed on the drug packaging device.

Moreover, FIG. 31 is an illustration of an interface 140 provided for registration of information such as a lot number (serial number) and a use limit with regard to the drug to be prepared in the second receiving/dispensing portion 34. The interface 140 of FIG. 31 is substantially the same as the interface 130 of FIGS. 30A to 30C, and has substantially the same function. Similarly to basic information display portion 132 and the unique information display portion 134 of the interface 130, the interface 140 includes a basic information display portion 142 and a unique information display portion 144. Moreover, when the unique information display portion 144 is selected, an input screen 136 similar to that illustrated in FIG. 30B is displayed, so that unique information such as the lot number (serial number) and the use limit can be input. Moreover, after the input of the information and selection of the registration button 138 through the input screen 136, the input value is registered to the database.

With the configuration described above, even when the drugs selected in accordance with the prescription are to be charged and filled as in the case of the first receiving/dispensing portion 32 and the second receiving/dispensing portion 34, the traceability can be secured through association of the prescribed drug and the patient information given through registration of the unique information such as the lot number (serial number) and the use limit each time of the prescription.

«Individual Packaging Processing in Consideration of Special Prescription»

When the drugs are individually packaged in the drug packaging device 10 described above, there is a case in which not only the drugs to be dosed every day but also the drug to be dosed in a predetermined cycle as in the case of the drug to be dosed every predetermined days or every specified day are present. When the drug for dose for X days is to be individually packaged, it is only required that drugs to be dosed every day be prepared by the amount corresponding to X days. However, with regard to the drug to be dosed in a predetermined cycle, rather than simply preparing drugs by the amount corresponding to X days, it is required that the quantity of the drugs required for prescription be calculated by an operator or a pharmacist in accordance with the cycle. Such an operation is very cumbersome, and may cause errors. Specifically, for example, when the drugs which are to be dosed every other day starting from Monday to another Monday of two weeks later are to be prescribed, it is required that the drugs for eight days including Monday, Wednesday, Friday, Sunday, Tuesday, Thursday, Saturday, and Monday. As compared to the prescription of dosage of every other day as in this example, for example, when the drugs are dosed with a complex period of dosing for three days and not dosing for two days, the operation of deriving the number of days of dosing the drugs and deriving the quantity of the drugs required for the prescription becomes extremely cumbersome.

Figure 32:
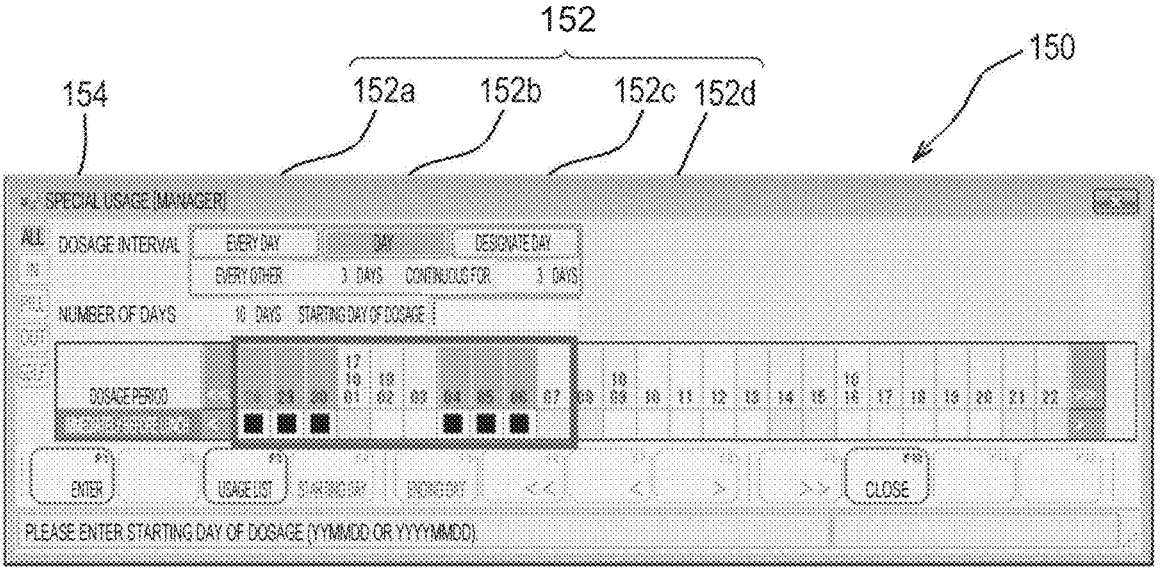
FIG. 32 is an image view for illustrating one example of the interface to be displayed on the drug packaging device.

In order to solve the above-mentioned problem, it is preferred that, when the drug is prescribed so as to be dosed in a predetermined cycle, the dosage cycle be specified, and a period (dosage period) from the starting day of the dosage to the ending day of the dosage be specified, thereby deriving the number of days of dosing the drugs in the dosage period and deriving the required quantity of the drugs to enable individual packaging. Specifically, as in an interface 150 illustrated in FIG. 32, it is preferred to prepare the interface 150 including a cycle input portion 152 configured to receive input of a dosage cycle and a dosage period input portion 154 configured to receive input of the dosage period, deriving the number of days of dosage of the drug during the dosage period through internal calculation, derive the required quantity of the drugs, thereby enabling individual packaging in accordance with prescription. In the example of FIG. 32, the cycle input portion 152 includes cycle designation buttons 152*a*, 152*b*, and 152*c*. The cycle designation button 152*a* is a button to be selected in the case of the drugs to be dosed every day. The cycle designation button 152*b* is a button to be selected in the case of the drug to be dosed at predetermined intervals. Moreover, the cycle designation button 152*c* is a button to be selected in the case of the drugs to be dosed every specified days. Moreover, the cycle input portion 152 includes a numerical value input portion 152*d* configured to receive input of a numerical value corresponding to a cycle when the cycle designation buttons 152*b* and 152*c* are selected. In FIG. 32, illustration is given of the case in which the cycle designation button 152*b* has been selected. As described above, a cycle can be designated through a designation method for drugs to be dosed every other "a" days consecutively for "b" days.

When the dosage cycle and the dosage period are designated as described above, the package to be used for individual packaging of the drug is determined. In the example of FIG. 32, illustration is given of the example in which the drugs to be dosed every other three days consecutively for three days are individually packaged with the dosage period of ten days. In FIG. 32, as indicated in the region surrounded by a bold frame, the days on which the drugs are to be dosed in ten days set as the dosage period are indicated by "■". The drug packaging device 10 is configured to individually package the drugs in the individual packing bags by the number corresponding to the days selected as the days on which the drugs are to be dosed. With this, the drug packaging device 10 is capable of individually packaging the drugs so that the drugs can be dosed in a predetermined cycle.

The prescription information described above can be input and set for each patient. However, especially when the prescription for a plurality of patients (occupants) who occupy facility is to be collectively processed, more effect is exerted. For example, in a case in which, for a plurality of patients (occupants) in the same facility, the individual packaging processing is to be performed collectively for prescription of every one within a period of ten days from a predetermined day, some patients (occupant) may dose the drugs every day, or some patients may have special prescription of dosing every other day or specified days. In such case, in the related art, dosage days are set for every patient (occupant), or a total days for dosage are separately calculated, and after performing the operation of inputting the calculation result, it was required to perform the processing of starting the operation of collectively performing individual packaging for all of the prescription. However, when a program capable of achieving the packaging method for the drugs as described above is installed to a controller to achieve the method in the drug packaging device 10, an operator such as a pharmacist is only required to designate a common period with respect to the plurality of patients (occupants) without especially paying attention to the patient having a special prescription, thereby being capable of automatically calculating a total number of days for individual packaging based on setting information of dosage intervals (cycle) such as "every other day" or "designated days" set in advance for every patient (occupant).

«Stockout Estimation Function»

The drug packaging device 10 handles a large number of drugs, and hence it requires significant labor for, for example, a pharmacist to check the stockout of the drugs one after another. Therefore, when the stockout of the drugs can be estimated and foster preparation in the drug packaging device 10, the drug preparation operation can be performed more efficiently. In order to solve such problem, it is desired that the drug packaging device 10 have a function to perform stockout estimation for drugs provided therein at a predetermined timing such as issuance of prescription (stockout estimation function).

The stockout estimation function can be achieved in various methods. For example, the stockout estimation function can be achieved by, for example, deriving a stock amount with reference to a provided drug master provided to the controller of the drug packaging device 10 at the time of is issuance of the prescription and enabling estimation of whether or not the provided drug becomes stockout after the issuance of the prescription. When indicating the presence of the drugs which may become stockout at the time of issuance of prescription or the drug having a stock amount below the filling reference amount is output, information such as the name, the stock amount, the prescription amount (the number of drugs to be dispensed), shortage, and the cassette number of the drugs to become stockout before issuance of the prescription is displayed, to thereby foster filling. Moreover, when a plurality of drug packaging devices 10 configured to dispense the drugs are provided, it is desired that the machine number of the drug packaging device 10 for which the stockout of the drugs is estimated be displayed. Moreover, when the function to dispense the drug in a divided manner is provided, it is preferred that the distinguishment on whether or not the drugs for which the stockout is estimated are to be dispensed in a divided manner be displayed.

Moreover, the stockout estimation function is further improved in estimation accuracy through estimation with a total of the prescription amount given at the time of issuance of prescription and the prescription amount of prescription having been issued but not subjected to individual packaging (standby dispensing amount). Moreover, when the drug cassette 26 having the function of dispensing the drugs in a divided manner is present, estimation can be made based on the assumption that all of the cassettes are used regardless of the number of cassettes. Moreover, in a case in which a plurality of drug packaging devices 10 configured to dispense the drugs are provided, and in which there is given a prescription for which the machine number is not determined even after the issuance of the prescription, estimation is made with the assumption that the drugs are dispensed in the drug packaging device 10 having the same machine number.

«Function to Enable Comparison Between Previous Prescription Result and Current Result»

The drug packaging device 10 may have a function to accumulate prescription results of drugs for each patient in a database and compare the prescription result and the current prescription with respect to the patient. For example, the quantity of the drugs may be accumulated as the prescription results corresponding to the number of prescription of the drug (hereinafter referred to as "daily number") based on the number of days of dosage and the number of dosage in each day, the daily number related to the previous prescription and the daily number related to the prescription at this time (current prescription) with regard to the prescription subject of the drug may be comparable in the controller. Moreover, when the daily number has been changed as a result of comparison, the interface 160 as illustrated in FIG. 33 may be displayed, to thereby display a massage for confirming, for example, a pharmacist whether or not the change has been made only on the daily number. Moreover, at the time of comparison of the daily number, it is desired that comparison be made with the prescription having been performed previously for the same patient and in the same hospital department.

«Modification Example of Shutter Mechanism Section (First Opening/Closing Mechanism Section)»

As in the case of the shutter mechanism section 50 described above, in the shutter mechanism capable of performing closure by changing a posture of the shutter 50*d* so that the shutter 50*d* (first opening/closing member) in the shutter case 50*c* forming the shutter mechanism main body 50*a*, in the viewpoint of hindering passage of the drugs, it is not always required that the end portion of the shutter 50*d* be brought into abutment against the shutter case 50*c*. Specifically, there may be defined a gap between the shutter case 50*c* and the end portion of the shutter 50*d* such that the drugs cannot pass therethrough.

When the drugs can be cut into small pieces (for example, half) and dispensed in the drug cassettes 26 as described above, it is desired that a countermeasure for the cutting powder which is to be formed along with cutting of the drug be made. Specifically, when a gap is defined between the shutter case 50*c* and the end portion of the shutter 50*d*, the cutting powder may leak through the gap, to thereby hinder the packaging and other procedures in the packaging portion 60.

Specifically, in order to package the drug for each dosage in the packaging portion 60, at the time of forming a drug-sealing portion through formation of a seal on the individual packaging paper, when the cutting powder is taken by the seal portion, it may cause defects in packaging. More in detail, for example, when the packaging portion 60 forms a lateral seal, which extends along the proceeding direction of the individual packaging paper, and a vertical seal, which is orthogonal to the lateral seal, through use of the heater roller 64, there is a fear in that the cutting powder is taken at the time of formation of the seal.

Figure 34:
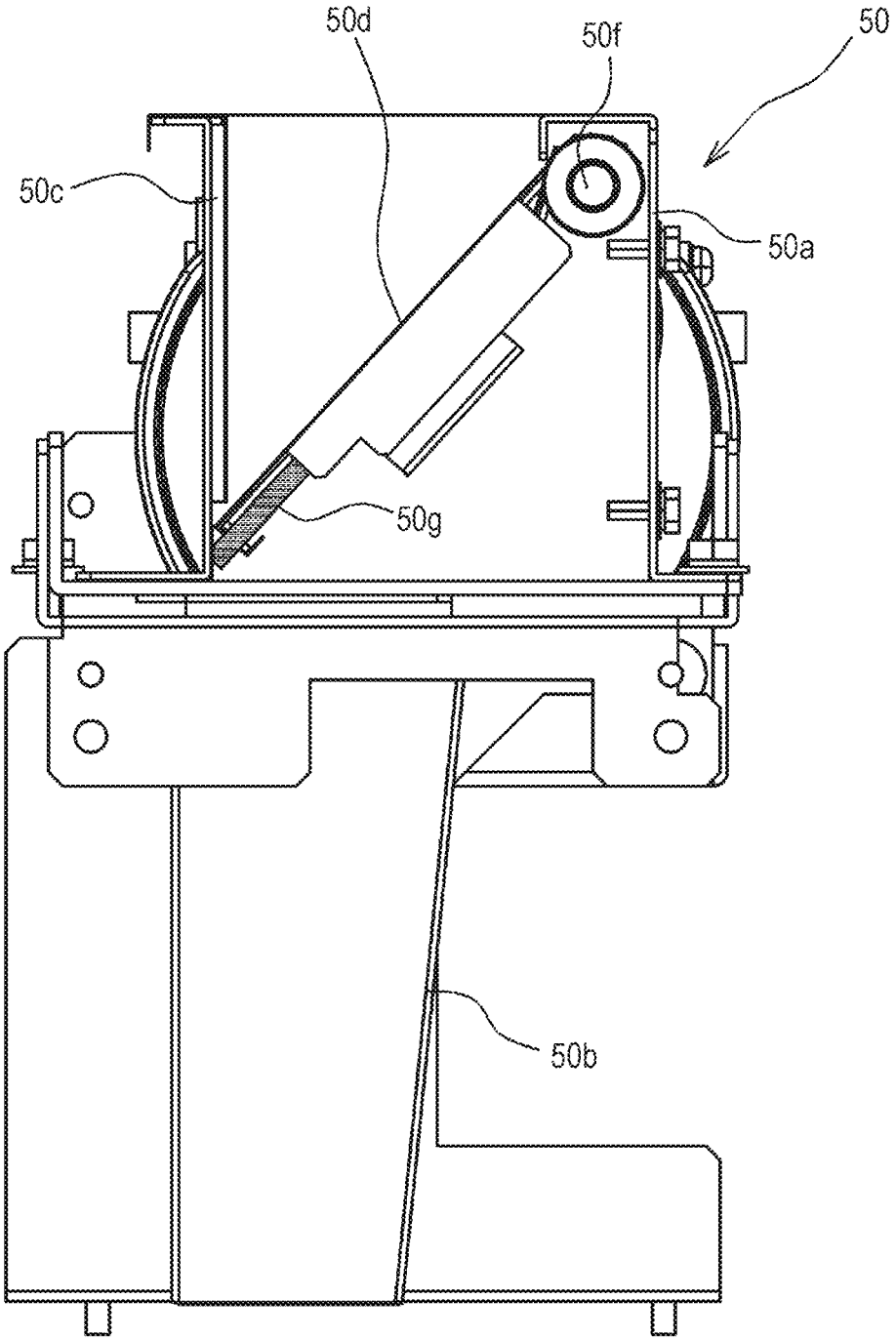
FIG. 34 is a sectional view of a shutter mechanism section according to a modification example.

Therefore, in order to solve the problem described above, the shutter mechanism section 50 may have a configuration including an abutment body 50*g* provided to the shutter 50*d* as illustrated in FIG. 34. The abutment body 50*g* is provided so as to further project from the distal end of the shutter 50*d*, and operates while following the shutter 50*d*. When the shutter 50*d* is to be closed, the abutment body 50*g* is brought into abutment against the inner peripheral surface of the shutter mechanism main body 50*a*, thereby filling a space defined between the distal end of the plate body forming the shutter 50*d* and the inner peripheral surface of the shutter mechanism main body 50*a*. With this, unexpected passage of the cutting powder, which is formed along with cutting of the drug, through the shutter mechanism section 50 can be suppressed.

As described above, when the abutment body 50*g* is provided to the shutter mechanism section 50, through adjustment of opening and closing timings of the shutter 50*d*, the cutting powder can be prevented from being taken at the time of formation of the seal on the individual packaging paper. Specifically, when the drug is to be packaged while forming the vertical seal between packages continuing in the proceeding direction of the individual packaging paper as described above, after formation of the vertical seal defining a boundary between the drug-sealing portion on the front side in the proceeding direction of the individual packaging paper and the drug-sealing portion continuing to the rear side, operation control is performed on the shutter mechanism section 50 so that the shutter 50*d* is opened at the timing of starting formation of the drug-sealing portion on the rear side. It is desired that the timing of opening the shutter 50*d* be adjusted, in consideration of the positional relationship of the shutter mechanism section 50, so as to open at the timing of not affecting formation of the vertical seal even when the cutting powder falls. Similarly in the case of sealing with other configuration rather than through use of the heater roller 64 provided to the packaging portion 60 as described above, it is desired that the shutter 50*d* be opened at the timing that the cutting powder is not bitten or taken into the portion having the seal formed thereat. With the abutment body 50*g*, even when the cutting powder is formed, through the operation control of the shutter mechanism section 50, adjustment can be performed so that the cutting powder falls at an optimum timing in consideration of influence on formation of the seal.

In the above, description is made of the drug packaging device according to the representative embodiment of the drug packaging device. However, the present invention is not limited to this. An exemplary embodiment of the present invention has been described above, but various design changes can be made within the scope of the technical spirit of the present invention described in Claims, and are all included in the present invention.

INDUSTRIAL APPLICABILITY

The present invention can be generally used for a drug packaging device configured to package and dispense a drug in a preferred manner.

The invention claimed is:

1. A drug packaging device, comprising:

a first dispensing portion comprising a plurality of drug cassettes configured to store a drug and individually dispense the stored drug in accordance with prescription information;

a second dispensing portion configured to receive a drug other than the drug stored in the first dispensing portion and dispense the drug in accordance with prescription information; and a delivery portion provided on a movement path and configured to guide drugs dispensed from the first dispensing portion and the second dispensing portion toward a packaging portion, wherein the second dispensing portion includes:

a first receiving/dispensing portion configured to align and arrange a plurality of drug receiving boxes lengthwise and crosswise, prepare a drug in each of the plurality of drug receiving boxes for dispensing in accordance with prescription information, and dispense the drug from each drug receiving box of the plurality of drug receiving boxes; and a second receiving/dispensing portion configured to collectively receive a plurality of drugs of a same kind, and dispense a drug, from the collectively received plurality of drugs, required for a package in accordance with prescription information, the first receiving/dispensing portion and the second receiving/dispensing portion are vertically arrayed, and the delivery portion is configured to move and collect part or all of drugs, which have been dispensed in a first direction from the first dispensing portion and the second dispensing portion, in a second direction crossing the first direction, and dispense the collected drugs toward the packaging portion, the delivery portion includes a drug collection hopper arranged below the first dispensing portion, and further drug collection hoppers associated with moving mechanisms, respectively, the moving mechanisms being configured to move linearly in the second direction.

2. The drug packaging device according to claim 1, wherein the drug collection hopper is an upper side hopper configured to collect a drug having been dispensed above the delivery portion and to feed the collected drug to the delivery portion, wherein the upper side hopper comprises an inclination portion having a peripheral surface inclined so that an opening region of the upper side hopper becomes narrower from an upper side toward a lower side, and the second dispensing portion is arranged so as to enter the opening region of the inclination portion on the lower side.

3. The drug packaging device according to claim 1, wherein the delivery portion comprises, on the movement path toward the packaging portion, a storage portion configured to temporarily receive some or all of the drugs prepared for individual packaging, and discharge the temporarily received drugs toward the packaging portion.

4. The drug packaging device according to claim 1, wherein the delivery portion includes a first opening/closing mechanism section including a first opening/closing member being openable and closable, and is configured to temporarily receive a dispensed drug and discharge the dispensed drug downward at the first opening/closing mechanism section, and some or all of surfaces with which the dispensed drug collides in the first opening/closing mechanism section have a multilayer structure formed of plate members arrayed with a clearance.

5. The drug packaging device according to claim 1, wherein the delivery portion further comprises a second opening/closing mechanism section including a second opening/closing member being openable and closable, and is configured to temporarily receive a dispensed drug, and to discharge the dispensed drug downward at the second opening/closing mechanism section, and some or all of surfaces with which the dispensed drug collides in the second opening/closing mechanism section is smaller in thickness than another surface with which the dispensed drug does not collide.

6. The drug packaging device according to claim 1, wherein the delivery portion includes the moving mechanisms configured to move the drugs, that have been dispensed in the first direction, in the second direction crossing the first direction.

7. The drug packaging device according to claim 1, wherein the second receiving/dispensing portion enables preparation for dispensing of the drug when the second receiving/dispensing portion is drawn out from a main body of the drug packaging device, and the second receiving/dispensing portion enables dispensing of the drug when the second receiving/dispensing portion is pushed into the main body.

8. The drug packaging device according to claim 1, wherein the drug collection hopper is configured to collect a drug from an upstream side and send the drug to a downstream side, wherein the drug collection hopper comprises a hopper main body having an opening area narrowed from an upper side toward a lower side;

a tubular portion which communicates to the lower side of the hopper main body; and a neck portion formed between the hopper main body and the tubular portion, in the neck portion, the hopper main body and the tubular portion are gradually curved so as to be connected to each other, and a part of the tubular portion below the neck portion is made of a material which is softer than a part of the hopper main body above the neck portion.

9. The drug packaging device according to claim 1, wherein the second receiving/dispensing portion comprises:

a cassette configured to accommodate and dispense a drug; and a base portion configured to give a motive force for dispensing the drug to the cassette, the cassette comprises:

a peripheral wall forming member forming a peripheral wall of a drug accommodation portion configured to receive the drug;

a first rotation member inclined from a bottom side toward an upper end side of the peripheral wall forming member, the first rotation member configured to rotate around a first rotation shaft inclined with respect to an axis line of the peripheral wall forming member;

a second rotation member, arranged on an outer periphery on the upper end side of the peripheral wall forming member, the second rotation member configured to rotate around a second rotation shaft; and a drug discharge portion configured to discharge the drug, the first and second rotation members are configured such that the drug received-in the drug accommodation portion is moved to the second rotation member by rotation of the first rotation member, transferred toward a downstream side in a rotation direction of the second rotation member, and discharged from the drug discharge portion.

10. The drug packaging device according to claim 9, further comprising a drawer member configured to be drawn out from a main body of the drug packaging device, wherein, when the drawer portion is drawn out, the cassette is drawn out from the main body, is held by the drawer portion and is separated from the base portion, and when the drawer portion is returned to be adjacent to the main body, the cassette is returned to be adjacent to the main body and is coupled to the base portion.

11. The drug packaging device according to claim 1, further comprising:

an identification information reading portion configured to read identification information attached to an original box of a drug;

a specifying information display portion configured to display specifying information for specifying a drug accommodated in the second receiving/dispensing portion; and a checking portion configured to verify a drug specified from the specifying information displayed on the specifying information display portion and a drug specified from the identification information read from the identification information reading portion.

12. The drug packaging device according to claim 1, wherein the drug collection hopper is configured to collect the drug from the first dispensing portion, the further drug collection hoppers are configured to collect the drug from the second receiving/dispensing portion of the second dispensing portion, and the drug collection hopper is located between the further drug collection hoppers in the second direction.

13. The drug packaging device according to claim 1, wherein the further drug collection hoppers are aligned with each other in a straight line, and the moving mechanisms are configured to linearly move the drugs, which have been dispensed in the first direction, in the second direction.

14. A drug packaging device, comprising:

a first dispensing portion comprising a plurality of drug cassettes configured to store a drug and individually dispense the stored drug in accordance with prescription information;

a second dispensing portion configured to receive a drug other than the drug stored in the first dispensing portion and dispense the drug in accordance with prescription information; and a delivery portion provided on a movement path and configured to guide drugs dispensed from the first dispensing portion and the second dispensing portion toward a packaging portion, wherein the second dispensing portion includes:

a first receiving/dispensing portion configured to align and arrange a plurality of drug receiving boxes lengthwise and crosswise, prepare a drug in each of the plurality of drug receiving boxes for dispensing in accordance with prescription information, and dispense the drug from each drug receiving box of the plurality of drug receiving boxes; and a second receiving/dispensing portion configured to collectively receive a plurality of drugs of a same kind, and dispense a drug, from the collectively received plurality of drugs, required for a package in accordance with prescription information, the first receiving/dispensing portion and the second receiving/dispensing portion are vertically arrayed, the delivery portion is configured to move and collect part or all of drugs, which have been dispensed in a first direction from the first dispensing portion and the second dispensing portion, in a second direction crossing the first direction, and dispense the collected drugs toward the packaging portion, the delivery portion includes a first opening/closing mechanism section including a first opening/closing member being openable and closable, and is configured to temporarily receive a dispensed drug and discharge the dispensed drug downward at the first opening/closing mechanism section, and some or all of surfaces with which the dispensed drug collides in the first opening/closing mechanism section have a multilayer structure formed of plate members arrayed with a clearance.

15. A drug packaging device, comprising:

a first dispensing portion comprising a plurality of drug cassettes configured to store a drug and individually dispense the stored drug in accordance with prescription information;

a second dispensing portion configured to receive a drug other than the drug stored in the first dispensing portion and dispense the drug in accordance with prescription information; and a delivery portion provided on a movement path and configured to guide drugs dispensed from the first dispensing portion and the second dispensing portion toward a packaging portion, wherein the second dispensing portion includes:

a first receiving/dispensing portion configured to align and arrange a plurality of drug receiving boxes lengthwise and crosswise, prepare a drug in each of the plurality of drug receiving boxes for dispensing in accordance with prescription information, and dispense the drug from each drug receiving box of the plurality of drug receiving boxes; and a second receiving/dispensing portion configured to collectively receive a plurality of drugs of a same kind, and dispense a drug, from the collectively received plurality of drugs, required for a package in accordance with prescription information, the first receiving/dispensing portion and the second receiving/dispensing portion are vertically arrayed, the delivery portion is configured to move and collect part or all of drugs, which have been dispensed in a first direction from the first dispensing portion and the second dispensing portion, in a second direction crossing the first direction, and dispense the collected drugs toward the packaging portion, the drug packaging device further comprises a hopper configured to collect a drug from an upstream side and send the drug to a downstream side, the hopper comprises a hopper main body having an opening area narrowed from an upper side toward a lower side;

a tubular portion which communicates to the lower side of the hopper main body; and a neck portion formed between the hopper main body and the tubular portion, in the neck portion, the hopper main body and the tubular portion are gradually curved so as to be connected to each other, and a part of the tubular portion below the neck portion is made of a material which is softer than a part of the hopper main body above the neck portion.

* * * * *